US012686535B2

(12) United States Patent
Hiltser et al.

(10) Patent No.: US 12,686,535 B2
(45) Date of Patent: Jul. 21, 2026

(54) CONTAINER, CLOSURE, AND METHODS FOR MANUFACTURE

(71) Applicant: H.J. Heinz Company Brands LLC, Pittsburgh, PA (US)

(72) Inventors: Balint Hiltser, Lent (NL); Jonathan Ralph de Jong, Arnhem (NL); Geert Petrus Jacobus Scholte, Roggel (NL); Bastiaan Pieter Hemmes, Eindhoven (NL); Fredrik Cornelis Stam, Veldhoven (NL); Charlotte Catherine Erik Devries, Ede (NL)

(73) Assignee: H.J. Heinz Company Brands LLC, Pittsburgh, PA (US)

( * ) Notice: Subject to any disclaimer, the term of this patent is extended or adjusted under 35 U.S.C. 154(b) by 0 days.

(21) Appl. No.: 18/725,591

(22) PCT Filed: Jan. 11, 2023

(86) PCT No.: PCT/US2023/010581
§ 371 (c)(1),
(2) Date: Jun. 28, 2024

(87) PCT Pub. No.: WO2023/137052
PCT Pub. Date: Jul. 20, 2023

(65) Prior Publication Data
US 2025/0100757 A1 Mar. 27, 2025

Related U.S. Application Data

(60) Provisional application No. 63/298,522, filed on Jan. 11, 2022.

(51) Int. Cl.
*B65D 47/08* (2006.01)

(52) U.S. Cl.
CPC ..... *B65D 47/0804* (2013.01); *B65D 2401/15* (2020.05)

(58) Field of Classification Search
CPC ..... B65D 47/36; B65D 2251/0003; B65D 2401/20; B65D 43/02; B65D 35/247;
(Continued)

(56) References Cited

U.S. PATENT DOCUMENTS 4,527,701 A 7/1985 Schaubeck
4,711,363 A 12/1987 Marino
(Continued)

FOREIGN PATENT DOCUMENTS

DE 202007019300 U1 12/2011
DE 102015101946 A1 8/2016
(Continued)

OTHER PUBLICATIONS

International Search Report and Written Opinion for PCT/US2023/010581, mail date May 4, 2023, 15 pages.
(Continued)

*Primary Examiner* — Kareen K Thomas
(74) *Attorney, Agent, or Firm* — Fitch, Even, Tabin & Flannery LLP

(57) ABSTRACT

In some embodiments, apparatuses and methods provided herein are useful for dispensing a fluid from a bottle that includes a closure cap with a flip-top lid, a base, and a tamper evident structure configured to indicate whether the closure cap has been previously opened. In some configurations, an area of the closure cap that a user manually leverages to open the cap includes a recess. By one approach, prior to initial opening, the movable wall covers most portion of the recess, and then upon initial opening, a user manually rotates the movable wall from the first gen-
(Continued)

erally vertical configuration to a second configuration that is moved inward into the recess.

21 Claims, 60 Drawing Sheets

(58) Field of Classification Search
CPC ..... B65D 33/25; B65D 51/04; B65D 43/16; B65D 47/00–0804; B65D 2401/00–15; B65D 47/0833
See application file for complete search history.

(56) References Cited

U.S. PATENT DOCUMENTS

| | | | | |
|---|---|---|---|---|
| 5,201,440 | A * | 4/1993 | Gross | B65D 47/0861 222/541.9 |
| 5,875,907 | A * | 3/1999 | Lay | B65D 47/0804 215/901 |
| 6,269,986 | B1 * | 8/2001 | Gross | B65D 47/0804 222/153.06 |
| 8,292,101 | B1 | 10/2012 | Bragg et al. | |
| 9,409,680 | B2 | 8/2016 | Van Alfen | |
| 9,650,185 | B2 | 5/2017 | Kieffer | |
| 9,932,158 | B2 | 4/2018 | Rognard | |
| 10,252,845 | B2 | 4/2019 | Rognard | |
| 10,266,311 | B2 | 4/2019 | Rognard | |
| 10,358,273 | B2 | 7/2019 | Benoit-Gonin | |
| 10,427,847 | B2 | 10/2019 | Tiesberger | |
| 10,442,591 | B2 | 10/2019 | Rognard | |
| 10,618,711 | B2 | 4/2020 | Weir | |
| 10,894,642 | B2 | 1/2021 | Cerveny | |
| 10,926,923 | B2 | 2/2021 | Berroa Garcia | |
| 11,220,378 | B2 | 1/2022 | Garcia Alberola | |
| 11,780,653 | B2 | 10/2023 | Rognard | |
| 2006/0163190 | A1 | 7/2006 | Laveault | |
| 2008/0047976 | A1 | 2/2008 | Scheer | |
| 2008/0110933 | A1 | 5/2008 | Goncalves | |
| 2010/0264145 | A1 | 10/2010 | Benoit-Gonin et al. | |
| 2012/0067922 | A1 | 3/2012 | Benoit-Gonin | |
| 2012/0279966 | A1 * | 11/2012 | Mazurkiewicz | B65D 55/024 220/257.1 |
| 2015/0266632 | A1 | 9/2015 | Kieffer | |
| 2017/0015459 | A1 | 1/2017 | Warner | |
| 2019/0276210 | A1 | 9/2019 | Giese | |
| 2021/0309423 | A1 * | 10/2021 | Hiltser | B65D 43/0231 |
| 2022/0204224 | A1 * | 6/2022 | Hiltser | B65D 47/0838 |
| 2022/0258929 | A1 | 8/2022 | Königseder | |
| 2023/0017736 | A1 | 1/2023 | Holmes | |

FOREIGN PATENT DOCUMENTS

| | | | |
|---|---|---|---|
| DE | 102016014640 | A1 | 5/2018 |
| DE | 202017007371 | U1 | 1/2021 |
| EP | 1660383 | B1 | 7/2008 |
| EP | 1955963 | | 8/2008 |
| EP | 1955963 | A1 | 8/2008 |
| EP | 1892194 | B1 | 6/2010 |
| EP | 2213584 | B1 | 6/2011 |
| EP | 2782841 | B1 | 1/2017 |
| EP | 2953862 | B1 | 9/2017 |
| EP | 2953863 | B1 | 9/2017 |
| EP | 3256395 | B1 | 1/2019 |
| EP | 3303166 | B1 | 3/2019 |
| EP | 3472065 | A1 | 4/2019 |
| EP | 3350094 | B1 | 10/2019 |
| EP | 3105138 | B1 | 12/2019 |
| EP | 3383756 | B1 | 1/2020 |
| EP | 3604163 | A1 | 2/2020 |
| EP | 3817989 | A2 | 5/2021 |
| EP | 3444201 | B1 | 11/2021 |
| EP | 3837182 | B1 | 1/2022 |
| EP | 3921246 | B1 | 2/2022 |
| EP | 3325366 | B1 | 5/2022 |
| EP | 3765376 | B1 | 6/2022 |
| EP | 4072962 | B1 | 7/2023 |
| JP | 2009057090 | A | 3/2009 |
| WO | 2009141700 | | 11/2009 |
| WO | 2021116468 | | 6/2021 |
| WO | 2021204360 | | 10/2021 |
| WO | 2023137052 | | 7/2023 |

OTHER PUBLICATIONS

International Search Report and Written Opinion for PCT/US2024/011096, mail date May 16, 2024, 13 pages.
International Search Report and Written Opinion for PCT/US2024/011099, mail date May 17, 2024, 15 pages.
International Search Report and Written Opinion for PCT/US2024/011098, mail date May 8, 2024, 13 pages.

* cited by examiner

CONTAINER, CLOSURE, AND METHODS FOR MANUFACTURE

TECHNICAL FIELD

This disclosure relates generally to containers for fluids. More particularly, this disclosure generally relates to containers with closure caps.

BACKGROUND

Fluid containers are known for containing and dispensing fluids such as, e.g., personal care products and condiments, along with other foods and/or beverages. To easily dispense the contents of a container, these bottles often have closure caps with flip-top lids and openings in a base of the cap. In addition, for product or food safety purposes, tamper evident or package integrity features may be incorporated into such packaging.

For example, some fluid containers include a thin liner sealed to a neck of the container bottle. Depending on the structure of the closure cap, the liner provides a tamper evident indicator and may potentially assist with maintaining the product inside the bottle and/or the freshness thereof. In such configurations, a consumer unscrews or otherwise removes the flip-top closure cap from the bottle neck to access and remove the liner from the bottle. The liner is then typically discarded (as it is generally difficult to recycle such small components). In addition to the waste such packaging generates, consumers often find liner removal to be tedious and time consuming. Removal of the liner may also require fine motor skills and/or dexterity which may cause consumers with limited manual dexterity to have difficulty removing the liner and/or unscrewing the closure cap from the bottle. Furthermore, to determine if the bottle has been tampered with, a visual inspection of the liner is typically necessary. The inspection of the liner typically requires that the user remove the closure cap before inspecting the liner because the liner is disposed beneath the closure cap. This results in the need to remove the closure cap prior to purchasing the container bottle if one wants to confirm that the tamper evident feature has not been removed.

In other fluid containers, the closure caps include a tear strip that may be pulled or torn from a portion of the closure cap prior to initial opening, such that consumers may then open the closure cap upon removal of the tear strip. Similar to the liners on the bottle, such tear strips are generally completely removed from the closure cap and discarded in light of their smaller size that makes them difficult to recycle. For example, these are generally too small to include an indication of the type of plastic of which they are formed. Similar to the use of a liner, the tear strip may also require fine motor skills and/or dexterity, causing consumers with limited manual dexterity to have difficulty removing the tear strip.

BRIEF DESCRIPTION OF THE DRAWINGS

Disclosed herein are embodiments of systems, apparatuses and methods pertaining to a container, closure cap, and methods for manufacturing. This description includes drawings, wherein:

FIG. 19A is a partial detail view of portion 18A of FIG. 19.

Figure 1:
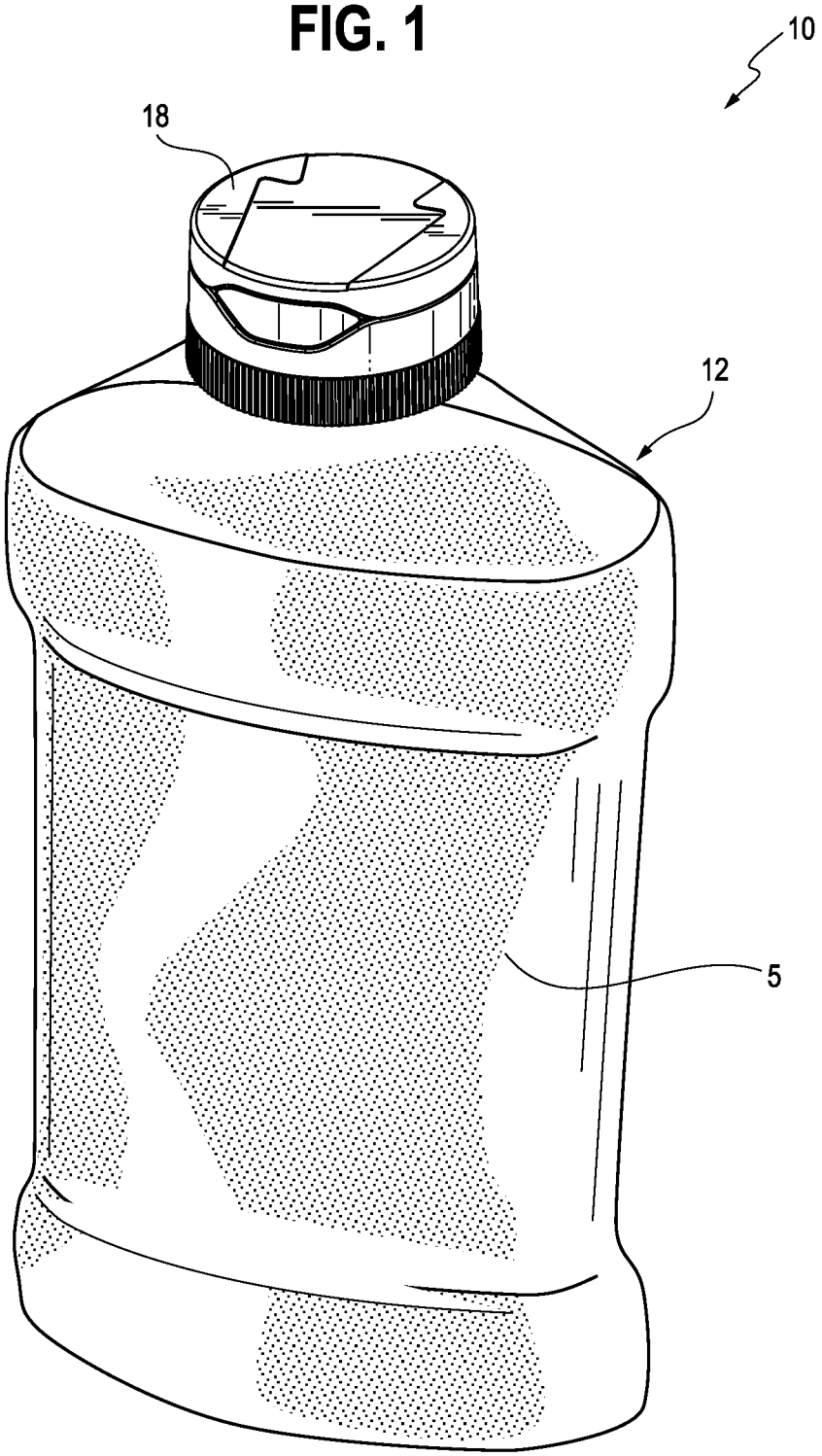
FIG. 1 is a perspective view of a bottle with a cap in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present disclosure. Also, common but well-understood elements that are useful or necessary in a commercially feasible embodiment may be omitted in order to facilitate a less obstructed view of these various embodiments of the present disclosure. Certain actions and/or steps may be described or depicted in a particular order of occurrence when such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Described herein are systems, apparatus, and methods for dispensing a fluid from a bottle, such as, consumer or food products including, e.g., condiments or drinks. In some embodiments, a bottle includes a closure cap with a flip-top lid, a base, and a tamper evident structure or a package integrity feature that is configured to indicate whether the closure cap has been previously opened. In some configurations, a portion of the closure cap includes a recess where a rotational panel or movable wall is located that a user manually leverages to open the flip-top lid. By one approach, the recess is an indented or open space in a sidewall at the juncture between a portion of the flip-top lid and base, generally disposed opposite the hinge connecting the two. The movable panel or wall may be used as a tamper evident structure. By one approach, prior to initial opening, the movable wall may extend substantially parallel to or continuously from a sidewall or an outer wall of the closure cap. Upon the initial opening, a user manually may move the movable panel or wall from a first substantially vertical configuration to a second secured configuration, where a portion of the movable panel or wall is moved inward into the recess formed by portions of the base and the flip-top lid. In some configurations, the movable panel is attached to a portion of the closure cap with a hinge and/or one or more breakable connectors. In these configurations once the one or more breakable connectors are separated, the movable panel may rotate or fold inward into a portion of the closure cap at the hinge.

Previous solutions (such as, e.g., the tear away strips or sealed liners described above) include a separate tamper evident structure that is distinct from the container bottle or closure cap. The present disclosure allows for a container bottle to incorporate the movable panel or wall, and the closure cap which allows for a container bottle that with fewer components. The closure cap containing the movable panel or wall also allows for the entire closure cap (including the tamper evident structure) to be recyclable.

Furthermore, if the movable panel or wall is partially moved toward the secured second configuration, the movable panel or wall may provide a tactile tamper evident indication. That is, after the initial activation of the hinge and/or severing of the breakable connectors, a consumer or user may be able to visually, or by tactile feel, determine that the bottle was previously opened. This may be evidenced by severed breakable connectors and/or the movable panel or wall moved from the first configuration.

Accordingly, as compared to previous tamper evident options, the tamper evident structure(s) or package integrity feature(s) described herein provide a readily discernable visual or tactile tamper evidence indication that may not require a consumer to remove the cap from the bottle. The present disclosure also permits the tamper evident structure of the closure cap to remain attached to or secured with a portion of the closure cap, thus allowing for the potential recycling of a greater portion of the closure cap.

FIG. 1 illustrates a packaged food product including a bottle 10 containing a fluid product 5, such as, e.g., a fluid food product including ketchup, mayonnaise, barbecue sauce, mustard, or another similar fluid product. As shown, the bottle 10 includes a closure cap 18 connected to a container body 12 via internal threads 32 of the closure cap 18, as described in more detail with reference to FIG. 5, engaging external threads 16 of the container body 12, with further reference to FIG. 10. As discussed further below, the closure caps described herein may be incorporated into a variety of packaging solutions. FIG. 1 depicts the bottle in an upright position (i.e., the closure cap 18 is substantially above the container body 12). The present disclosure further contemplates the bottle 10 to be stored in an inverted configuration such that the closure cap 18 is substantially below the container body 12. In the inverted configuration the container body 12 may rest on the closure cap 18. Accordingly, during storage and/or dispensing, the bottle 10 may have the closure cap 18 positioned substantially above or below the container body 12.

Figure 2:
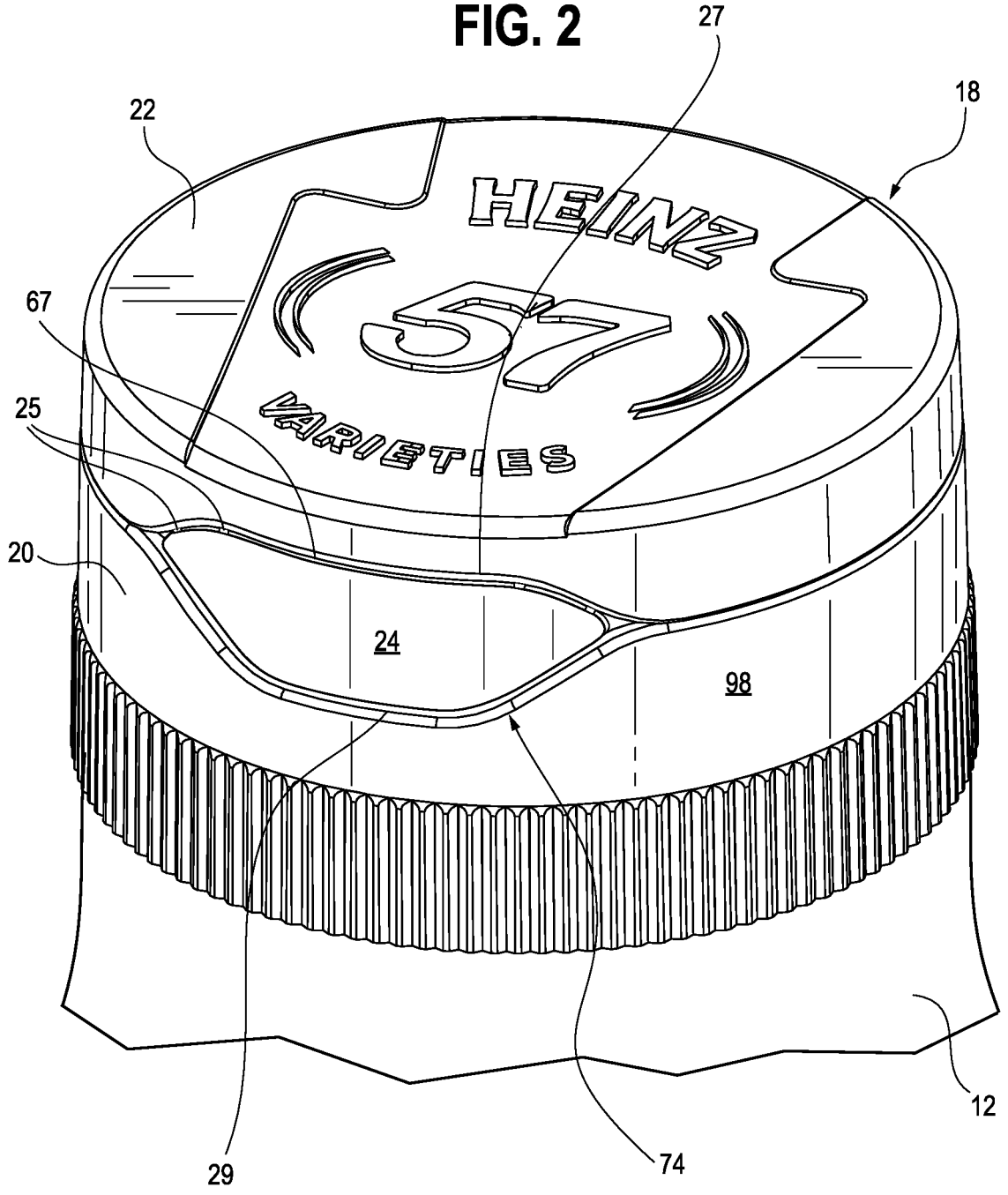
FIG. 2 is a perspective view of a cap and a portion of a bottle in accordance with several embodiments.
Figure 3:
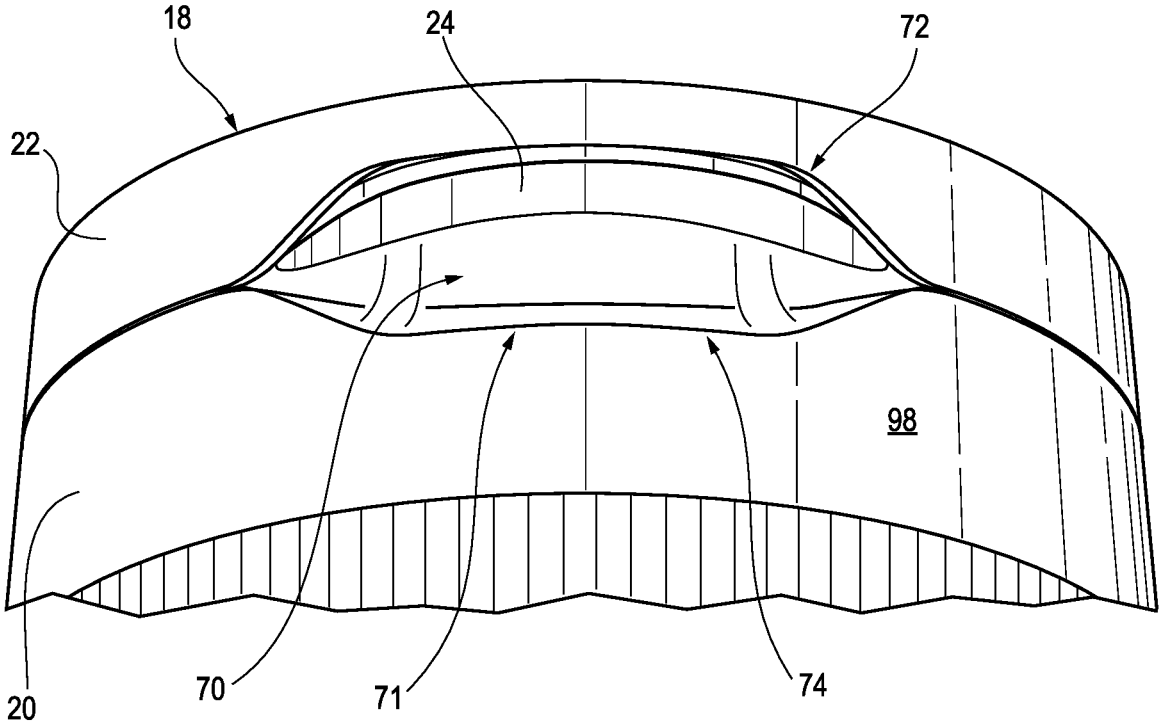
FIG. 3 is a perspective view of the cap of FIG. 2 in a previously opened configuration.
Figure 4:
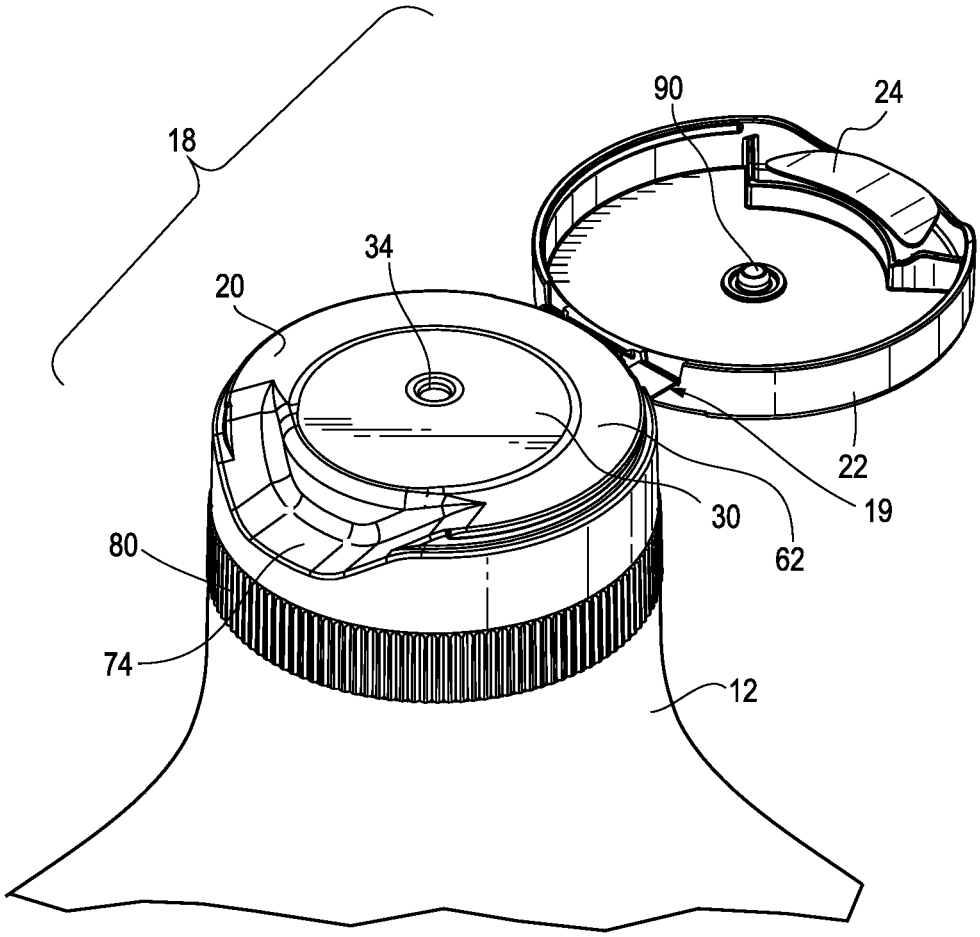
FIG. 4 is a perspective view of the cap of FIG. 2 in an opened configuration.

The closure cap 18, as shown in FIGS. 2-4, includes a base 20 and a flip-top lid 22 hingedly connected or attached to the base 20. To open the closure cap 18 a user may move or pivot the flip-top lid 22 from the closed configuration (see, e.g., FIG. 2) to the open configuration (see, e.g., FIG. 4). In the first position (i.e., the initial, closed configuration), the rotational or movable panel or wall 24 is disposed substantially adjacent to or flush with the outer sidewall wall 98 of the closure cap 20. The movable panel or wall may be located substantially adjacent to a mouth-shaped opening 71 in the sidewall 98.

In use, a user or consumer may apply pressure (such as via manual thumb pressure) to the rotational or movable panel or wall 24. The pressure may be exerted by the user, such as using an extremity of the user, but may also come from other external sources such as a utensil or other instrument. The pressure may rotate or move a portion of the moveable wall or panel 24 inward relative the sidewall 98 into a recess 70 disposed adjacent the mouth-shaped opening 71. In some embodiments, the recess 70, similar to the mouth shaped opening 71, may be mouth-shaped. In other embodiment that recess 70 may be disposed in a space between the flip-top lid 22 and the base 20, along a side of the closure cap 18, and may be opposite a hinge 19. The hinge 19 hingedly connects the flip-top lid 22 to the base 20.

When the movable wall 24 is moved inward relative to the sidewall 98 and flip-top lid 22, a portion may be snapped, broken, or severed such that at least a portion is displaced into the recess 70. The rotatable or moveable panel or wall 24 may be disposed in the second position. After initial opening, the rotatable or moveable panel or wall 24 generally remains disposed in the second position whether the flip-top lid 22 is disposed in the closed configuration, as illustrated in FIG. 2, or is in the open configuration, as illustrated in FIG. 4.

More particularly, the closure cap 18 includes a rotational or moveable panel or wall 24 having a first position (e.g., FIGS. 2 and 5) where the movable wall 24 extends from at least one of the base 20 and/or the flip-top lid 22 to at least partially cover or obstruct the mouth-shaped opening 71 to the recess 70. This obstructs a user from opening the closure cap 18 by not allowing the movement of the flip-top lid 22 relative to the base 20. The movable wall 24 may be attached to the at least one of the base 20 and/or the flip-top lid 22 such that the movable panel or wall 24 is is capable of being moved from the first position obstructing the recess 70 to a second position, which permits access to the recess 70 and may enable the user to move the flip-top lid 22 to the open position.

In some configurations, the rotational or moveable panel or wall 24 may have a shape or general structure similar to the outline of the recess 70. In this configuration, an upper edge 27 of the movable wall 24 generally corresponds to an upper edge 72 of the recess 70 and a lower edge 29 of the movable wall 24 generally corresponds to a lower edge 74 of the recess 70. In other approaches, the movable wall 24 may not have a corresponding shape to the recess 70, but instead, may include additional breakable members to cover at least a portion of the opening or recess 70 to prevent a user from moving the flip-top lid 22 to the open position without moving the movable wall 24 from the initial configuration.

Once the rotatable panel or movable wall 24 has been pressed inward (as discussed below), the user or consumer may apply a force to the flip-top lid 22 in a direction substantially away from the base 20. The movement of the flip-top lid 22 away from the base 20 may rotate or pivot the flip-top lid 22 about the hinge 19. By one approach, an upward force may be applied by engaging an upper edge or surface of the mouth-shaped opening 71 defined by the upper surface 72 (which is disposed opposite the lower surface 74 of the mouth-shaped opening 71). By another approach, a user may pull upward on the upper surface 72 pulling the upper surface 72 away from the base 20. The flip-top lid 22 may pivot about a hinge 19 which may be substantially opposite the mouth-shaped opening 71.

Figure 8:
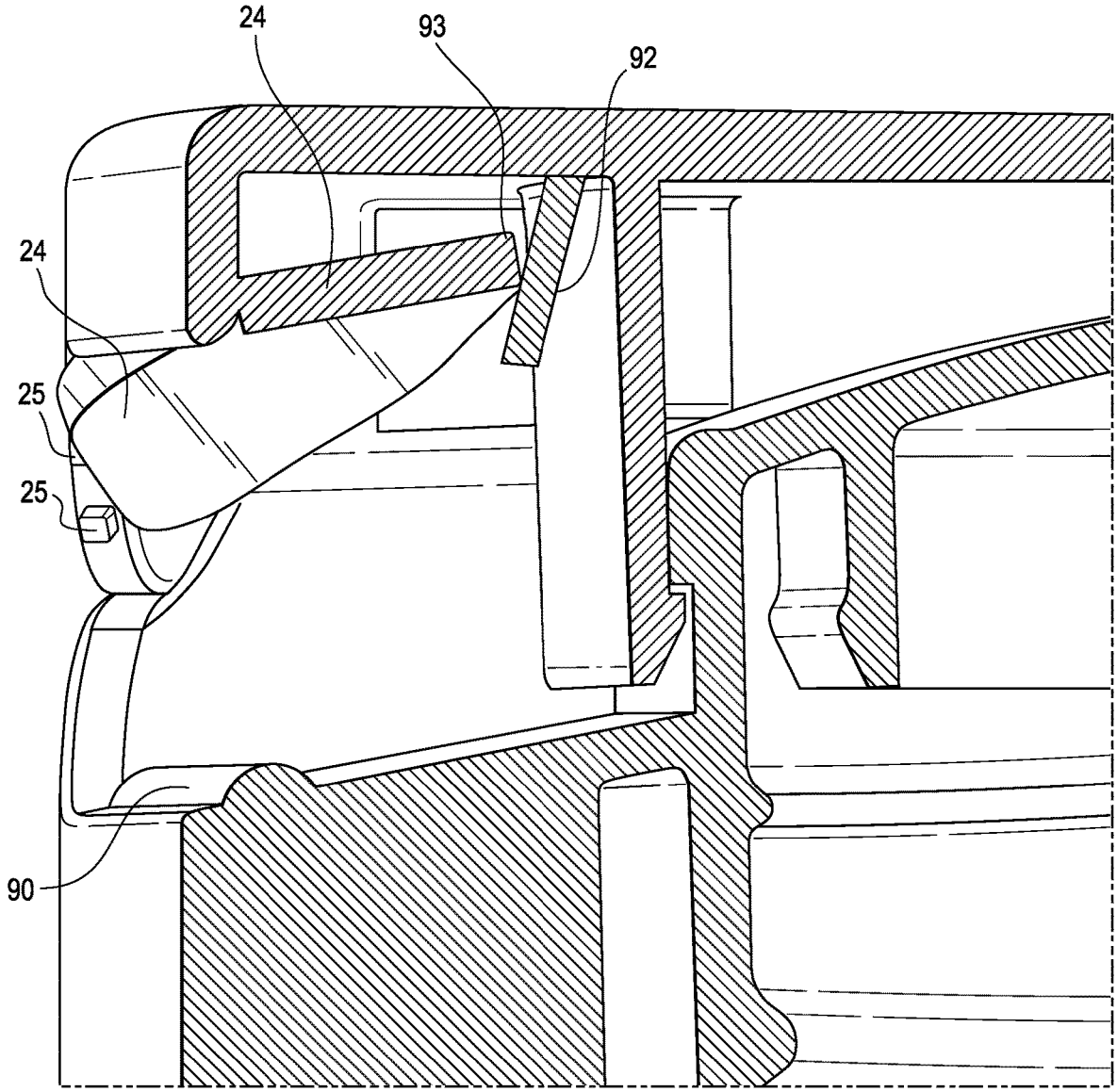
FIG. 8 is a cross sectional view of a portion of a closure cap in a previously opened configuration in accordance with some embodiments.

As illustrated in FIG. 8, the movable panel or wall 24 is disposed in the second position after the moveable wall or panel has been pivoted inward relative to the upper surface 72 of the mouth-shaped opening 71. In this configuration the user or consumer may apply or exert a force to move the movable panel or wall 24 upward to open the flip-top lid 22 and move the flip-top lid 22 from the closed configuration to the open configuration.

Returning now to FIG. 4, when the flip-top lid 22 is in the open configuration, a projection 90 of the flip-top lid 22 is moved from obstructing or blocking an opening 34 in the base 20 to a position away from the opening 34, such that the opening 34 is unobstructed, and the fluid 5 in the bottle 10 may exit therethrough. In some embodiments, as illustrated in FIG. 4, a central portion 30 of the base 20, through which the opening 34 extends, may include a substantially planar portion 62. The lower surface 74 of the mouth-shaped opening 71 may extends around the central portion 30.

Figure 5:
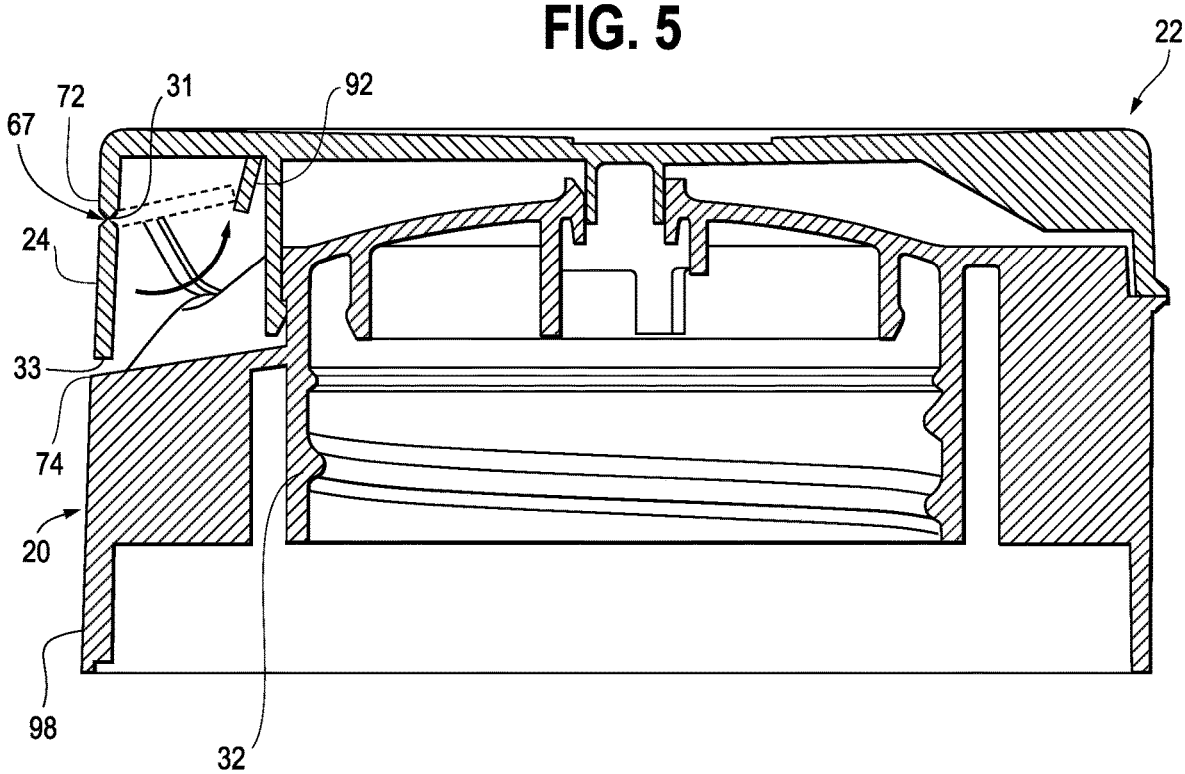
FIG. 5 is a cross sectional view of a portion of a cap in an initial closed configuration in accordance with some embodiments.

FIG. 5 illustrates an exemplary embodiment of the moveable panel or wall 24 in a first initial configuration. In the first initial configuration the moveable panel or wall 24 may be connected to the flip-top lid 22 and/or the base 20. When the moveable panel or wall is moved to a second configuration, the moveable panel or wall 24 may be secured to a remainder of the closure cap 18 in different configurations. This may be through the use of, or in combination with one or more hinges and/or one or more breakable, severable, frangible, or separable structures. The one or more hinges and/or breakable connectors or structures may be disposed in a variety of configurations. In one illustrative example, once the movable panel or wall 24 has been moved from its initial configuration, it may remain attached to at least a portion of the closure cap 18 via a hinge 67 at a first end 31 of the movable panel or wall 24. In addition, a second end 33 of the movable panel or wall 24 may move from a first initial position that is substantially aligned with a sidewall 98 to a second position pushed inward from the sidewall 98.

Figure 9A:
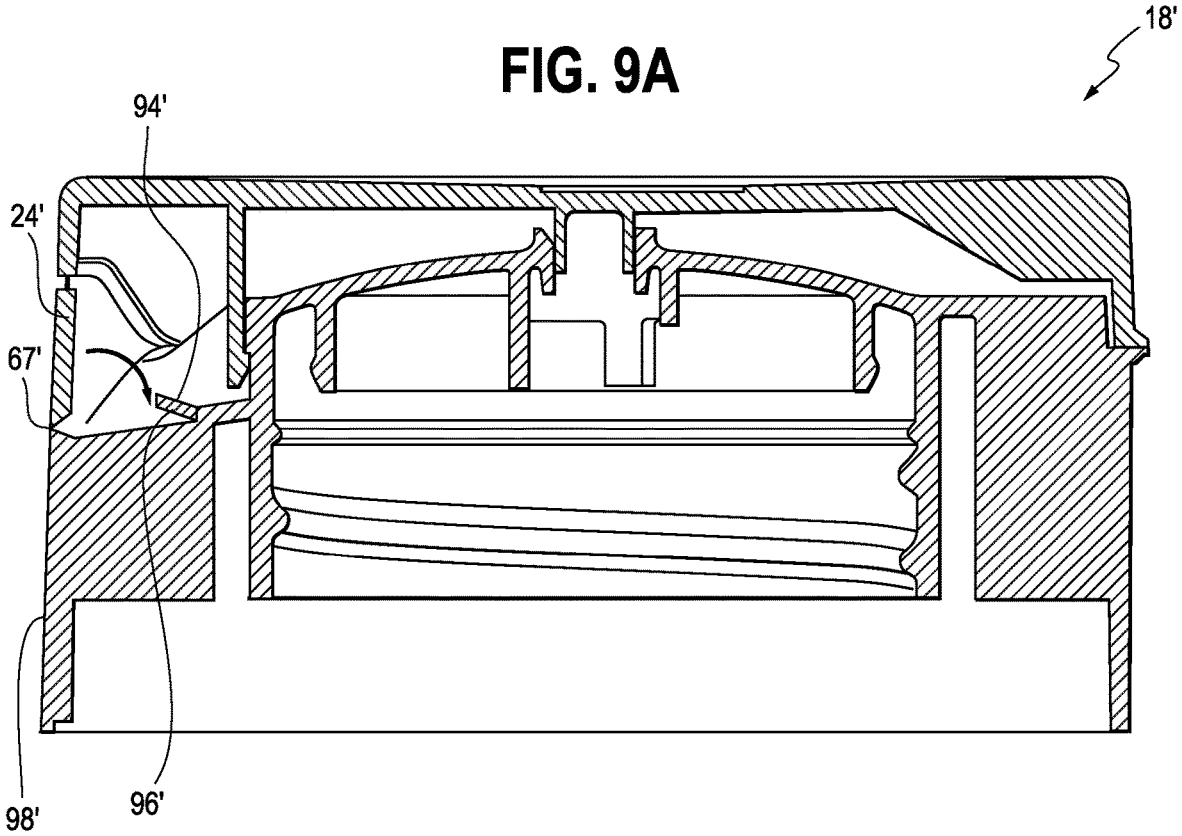
FIG. 9A is a cross sectional view of a closure cap in a closed configuration in accordance with some embodiments.
Figure 9B:
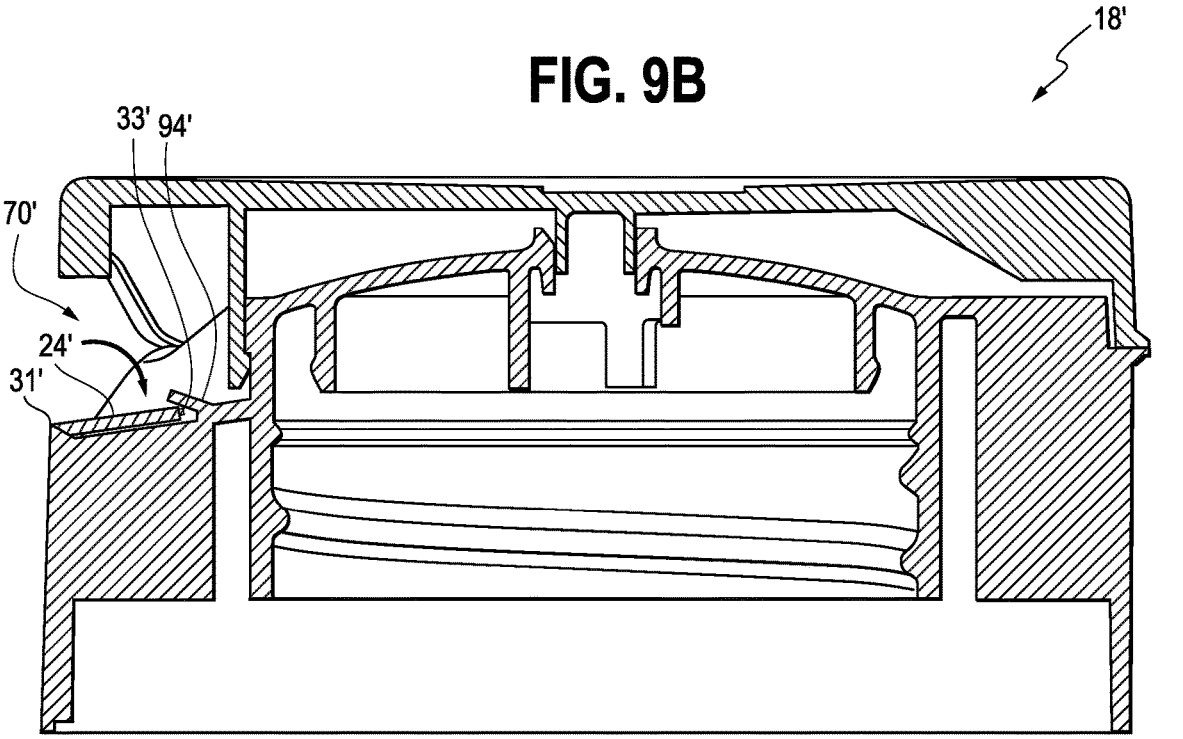
FIG. 9B is a cross sectional view of a closure cap in a previously opened configuration in accordance with some embodiments.

In the embodiment illustrated by FIGS. 5-8, the first end 31 of the movable panel or wall 24 may connect to at least a portion of the closure cap 18 or the flip-top lid 22. The first end 31 is disposed on a first or an upper end of the movable wall 24 when the closure cap 18 is positioned with the closure cap 18 on top of the bottle. In another illustrative example, as illustrated in FIGS. 9A and 9B, the first end 31' of the movable panel or wall 24' may connect to at least a portion of the closure cap 18'. The first end 31' is disposed on a second or lower end of the movable wall 24' when closure cap 18' is positioned with the closure cap 18' on top of the bottle.

As noted above, in some configurations, the movable wall 24 has a first end 31 adjacent a hinge 67 and a second end 31 thereof that may rotate or move into at least a portion of the recess 70. As shown in FIG. 5, the hinge 67 permits the movable panel or wall 24 to hinge or rotate inward into the recess 70. When the movable wall 24 is moved from its initial position, substantially flush with the outer wall 98, and disposed in front of the recess 70, to the second position with the moveable panel or wall 24 transverse to the outer wall 98, a user may visually and/or tactilely observe the movement. When the moveable panel or wall 24 is in the second position, the moveable panel or wall remains attached to at least a portion of the closure cap 18. Further, the moveable panel or wall 24 in the second position may not interfere with the opening or other operations of the closure cap 18. In this manner, the moveable panel or wall 24 may operate as a visual and/or tactile tamper evident closure or structure indicator. Furthermore, in some configurations, a user may be able to additionally visually and/or tactilely observe the breakable members 25 breaking, allowing for an additional or separate tamper evident indicator for consumers.

To facilitate the visual or tactile tamper evident feature disclosed herein, the hinge 67 permits the movable panel 24 to rotate from the first position to the second position, as mentioned above. The hinge 67 may be formed, for example, by having a pinched or narrowed section of the closure cap 18 between the outer wall 98 and the movable wall 24. In addition to molding the hinge 67 into the closure cap 18 when the closure cap 18 is formed, a laser, knife, or other implement or mechanism may be employed to form a line or area of weakness to facilitate formation of the hinge 67. In addition, by some approaches, the movable panel or wall 24 may be configured to rotate between about 45° and about 110° from its first position. In other approaches, the movable panel or wall 24 may rotate between about 60° and about 100° from its first position.

Figure 6:
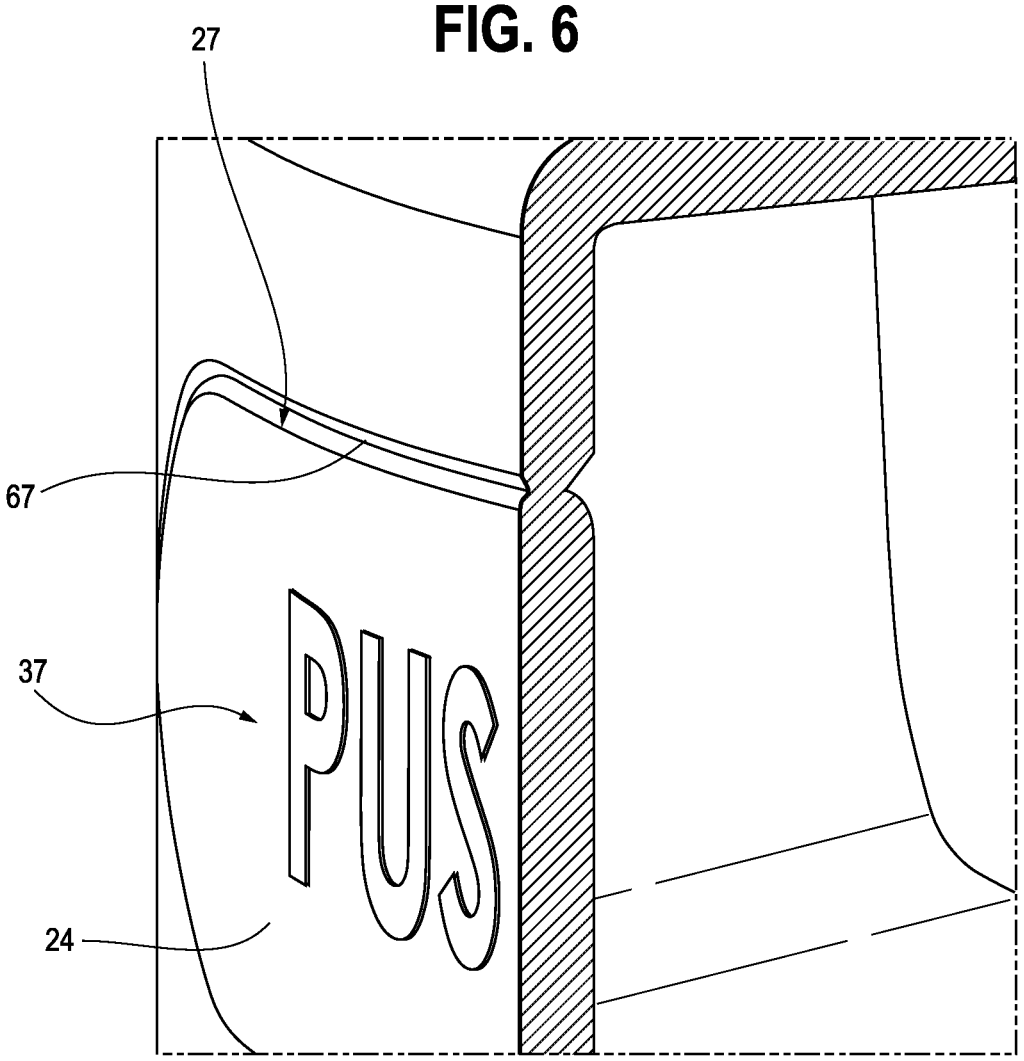
FIG. 6 is a cross sectional view of a portion of a closure cap in an initial closed configuration in accordance with some embodiments.
Figure 7:
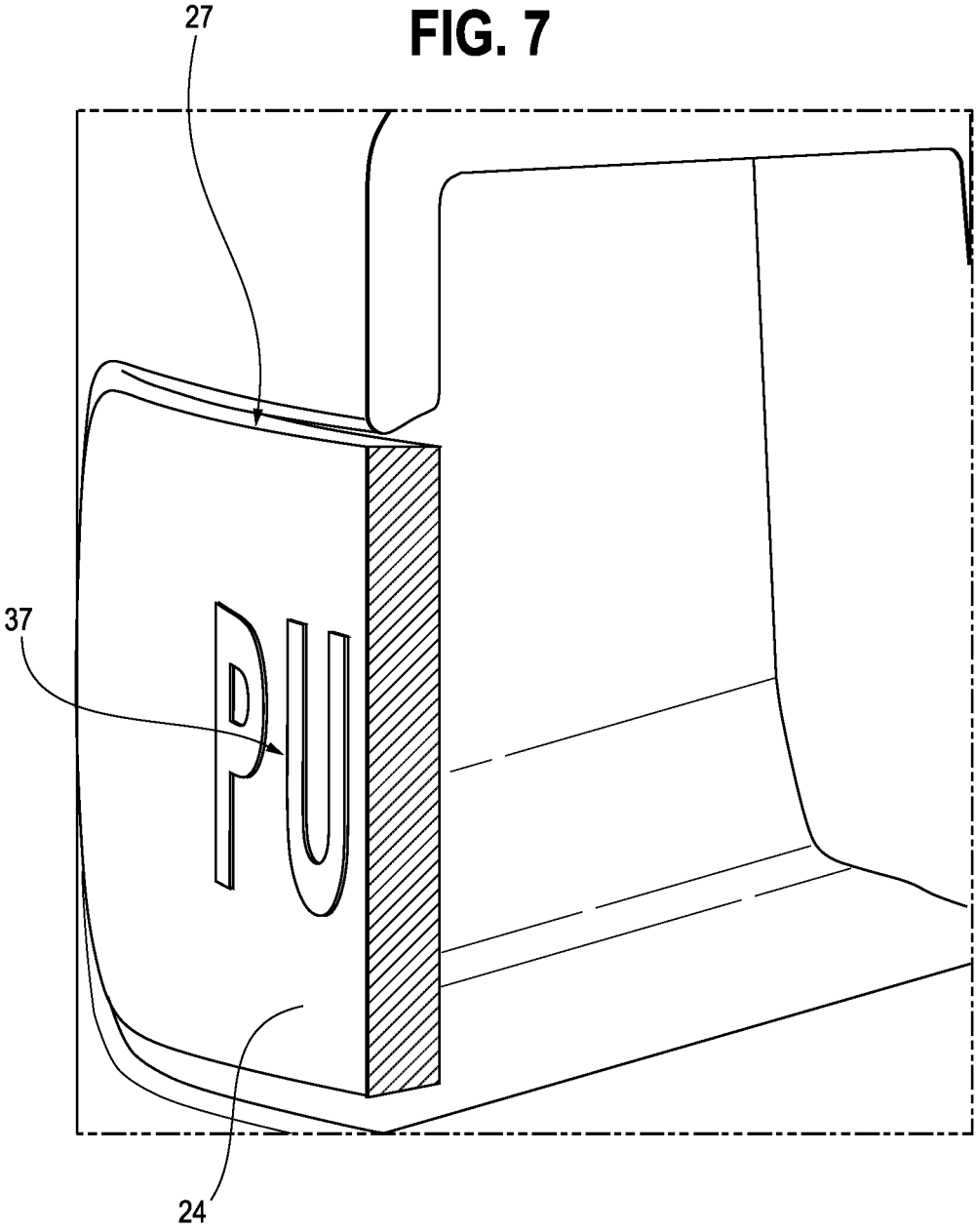
FIG. 7 is a cross sectional view of a portion of a closure cap in an initial closed configuration in accordance with some embodiments.

FIGS. 6 and 7 illustrate that the hinge may only extend over a portion of an upper surface 27 of the movable wall 24. FIG. 6 illustrates that the central portion of the movable wall 24 has the hinge 67 adjacent thereto, but the peripheral portions of the movable wall 24, as illustrated in FIG. 7, are not connected to the flip-top lid 22 via the hinge 67. As illustrated in FIG. 8, one or more breakable members 25 may be disposed on an outer and/or side portion of the movable panel or wall 24.

More particularly, FIG. 5 illustrates a cross section of the movable wall 24 in the first initial position adjacent the outer wall 98. As illustrated in dashed lines in FIG. 5, the moveable panel or wall 24 may move to the second position disposed within the recess 70. Furthermore, in reference to the moveable panel or wall 24 in the second position, the second end 33 of the movable panel or wall 24 may be pushed beyond a lower edge of a retention flange 92.

When the tamper evident structure (i.e., the movable panel or wall 24) is moved from the first initial position to the second position, the movable panel or wall 24 generally remains attached to the remainder of the closure cap 18. Further, in some configurations, the movable panel or wall 24 may remain attached to the remainder of the closure cap 18 in a secured manner.

In other embodiments where the moveable panel or wall 24 remains attached in a secured fashion, at least one of the flip-top lid 22 and the base 20 are configured to retain the movable panel or wall 24 in the second position to inhibit the wall from moving relative to a remainder of the closure cap 18 and returning at least partially to the first position (initial, unopened configuration). This may include, for example, a retention structure. By one approach, the closure cap 18 includes a retention flange 92 and the movable panel or wall 24 is configured to be pivoted or hinged into the recess 70 until the second end 33 of the movable panel or wall 24 passes over or past the retention flange 92 to a second position. In the second position in these embodiments, the movable panel or wall 24 is securely stored such that the retention flange 92 inhibits the movable panel or wall 24 from returning to the first position or otherwise moving relative to the remainder of the closure cap 18. As shown in FIGS. 4 and 8 the retention structure may include a retention flange 92 extending into the recess 70 that may catch or otherwise securely retain a rear portion 93 of the movable wall 24. This may be accomplished through the use of friction between the moveable panel or wall 24 and the retention structure 92, or through a latching mechanism. FIGS. 9A and 9B also illustrate retention structures such as retention mechanism 94', similar to retention flange 92, and may be configured to retain a portion of the movable panel or wall 24', such as the end opposite the hinge 67' remains in a secured position.

FIG. 8 illustrates how the moveable panel or wall 24 may be securely retained within the closure cap 18 after initial opening. Furthermore, by having the movable wall 24 rotated upward and secured adjacent upper portion of the recess 70 in the second position, the movable wall 24 may be a location for a user to contact and move the flip-top lid 22 from the closed configuration to the open configuration.

As mentioned, the closure cap 18 may further include one or more breakable members 25, as illustrated in FIGS. 2 and 8. The breakable members 25 may be configured to break upon the application of sufficient pressure on the movable wall 24, or where possible, the breakable members 25 themselves. The breakable members 25 may take a variety of forms, distributions, and/or configurations. By one approach, the breakable members 25 are molded along with a remainder of the closure cap 18. In addition, the breakable members 25 may be further weakened beyond their structural design, by application of an implement or tool, such as, for example, a laser or knife. In use, the pressure applied by a user, or some other object, to the movable panel or wall 24 may rotate or hinge the movable panel or wall 24 from the first position towards the second position. This movement may separate, sever, or otherwise damage or break the breakable members 25. The breakable members may break or separate into at least one of a first piece and a second piece. The at least one first piece and second piece both remain secured to portions of the closure cap 18. FIG. 2 illustrates the hinge 67 and the breakable members 25 being disposed on an upper edge 27 of the movable panel or wall 24. In other embodiments the hinge 67 and the breakable members 25 may be disposed upon a lower edge of the moveable panel or wall 24. As illustrated in FIGS. 9A and 9B, the hinge 67' and the breakable members 25' may be disposed on a lower surface 74' of the recess 70'. In yet other configurations, one or more hinges may be disposed on one side of the movable panel or wall and one or more breakable members may be disposed on another side opposite thereof.

Furthermore, in some embodiments, the one or more breakable members 25 may connect the moveable panel or wall 24 to either, or both, of the base 20 and/or the flip-top lid 22. In yet another embodiment, the one or more breakable member 25 may connect the base 20 directly to the flip-top lid 22, wherein movement of the flip-top lid 22 from the initial, or first, or closed position to the second or open position breaks the breakable members 25.

As waste, specifically plastic, is a growing problem, and small pieces of material are typically not suited for recycling, it is advantageous to minimize or completely eliminate small pieces that might become detached or otherwise separate from the packaging. The small portions or bits of plastic may be particularly concerning as they may find their way into waterways, food systems, and other sensitive environments. Thus, it may be beneficial if small bits, pieces, or portions of material, specifically plastic, are not removed, detached, or separated from larger pieces of plastic, which are generally easier to recycle. Accordingly, as illustrated herein, the movable wall 24 may remain attached to at least a portion of the closure cap 18 when the moveable panel or wall 24 is moved to the second position.

As mentioned above, and in particular reference to FIG. 8, the moveable panel or wall 24 may be attached to one of the base 20 and the flip-top lid 22 via a hinged connection 67. The other of the base 20 and/or the flip-top lid 22 that the moveable panel or wall 24 is not connected to may include an extension, a bulbous lip, or a ridge 90, configured to resist movement or rotation of the movable panel or wall 24. This ridge 90 may resist movement or rotation of the moveable panel or wall 24 such as movement from an inadvertent movement or force that might be experienced by the container during shipping or stocking of the container on store shelves. In some configurations the ridge 90 is disposed a short distance from a front edge of the recess 70 such that it is behind the lower edge 93 of the movable panel or wall 24. Moving or rotating the moveable panel or wall 24 past the ridge 90 allows for the moveable panel or wall 24 to be moved to the second or open position.

FIG. 8 further illustrates the flip-top lid 22 typically including a headspace or cavity within which to retain the movable wall 24 in the subsequently opened position. FIGS. 9A and 9B similarly illustrate the base 20' having a depression, cavity, or recessed portion 96' for receiving the movable wall 24'. In such a configuration, the movable wall 24' may snap into the recessed portion of the base such that the recessed portion 96' inhibits the wall from moving back to the first position. In one exemplary approach, the base 20' includes an extension 94' adjacent the recessed portion 96' to assist with retaining the movable wall 24' in the recessed portion 96'.

As the outer wall 98 may appear more continuous to a consumer given the movable panel or wall 24 extending over a recess or opening opposite the hinge 19, the closure cap 18 may also include a visual indication or other information assisting the user with opening the closure cap 18. As illustrated in FIGS. 6 and 7, in some configurations, the closure cap 18 may further include a visual indication 37 or instructions therein, such as, for example, by including the word "PUSH" on the outer facing surface of the movable panel or wall 24. Thus, as a user is attempting to open the closure cap 18 the user may press on the movable panel or wall 24 and feel the movable panel 24 move inward into the recess of the closure cap 18 as and/or after the breakable members 25 are broken or severed.

The filled receptacle or container body, in some configurations, is sealed with the fluid therein by a liner associated with the closure cap. For example, a liner, such as a liner of a paperboard, plastic, and/or metallic material may be secured to a neck of the container body to seal the fluid in the container bottle. In this manner, the containers may include multiple tamper evident features such as a liner secured to the neck of the container body, or a liner secured to the opening of the container body.

If a liner is included on the bottle neck, the closure cap 18 typically includes a texture or multiple ribs (ribbing) 80 on the outer skirt, on a lower portion of the sidewall to facilitate gripping of the closure cap 18, as illustrated in FIG. 4. The ribs 80 disposed on the lower sidewall of the base 20 provide a gripping surface such that if someone desires to remove the entire closure cap 18 from the container body 12, the user is able to more easily grasp the closure cap 18 to disengage the internal threads of the base from the external threads of the neck. Further, the ribs 80 also may be included on closure caps 18 even if the associated bottle does not include a liner sealing the fluid within the container. In other configurations, the ribs 80 may be removed from the closure cap 18. For example, the bottle 12' illustrated in FIG. 10 may be particularly well-suited for a closure cap 18 without ribs 80 as that bottle includes a structure to securely retain the closure cap on the bottle.

In yet other configurations, such as the bottles 10 described herein with a tamper evident feature beyond a liner, the closure cap 18 is secured to the container body 12 without the incorporation of a liner therein. The linerless bottle 10 still has a tamper evident feature with the moveable panel or wall 24.

Further, the teachings herein may be combined with a variety of bottle features such as those in U.S. patent Ser. No. 17/714,041 and International Patent Application No. PCT/US2020/039387, filed Jun. 24, 2020, both of which are incorporated herein by reference in their entirety.

Figure 10:
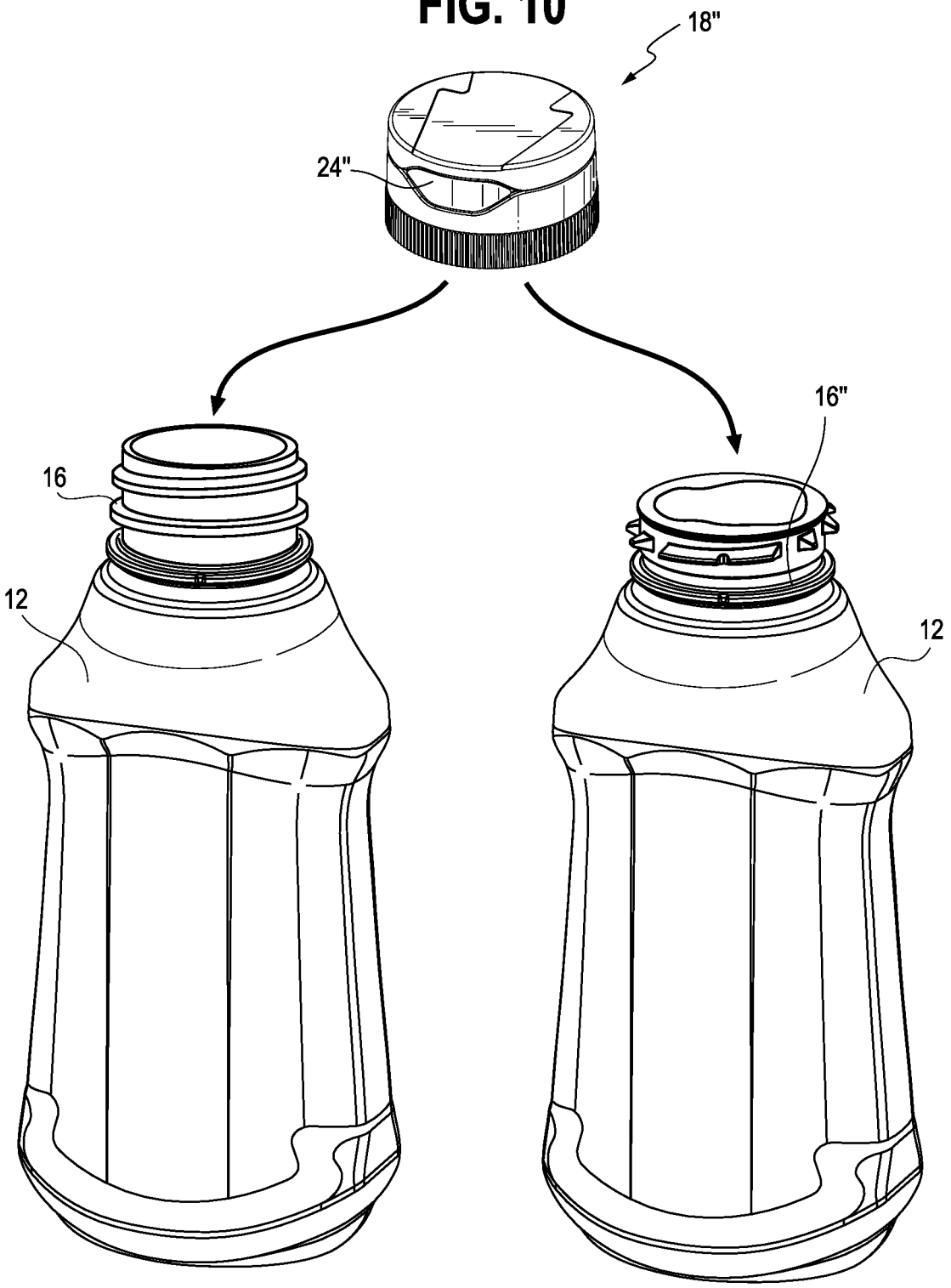
FIG. 10 is a perspective view of a closure cap that may be employed with differently configured bottles in accordance with some embodiments.

In another configuration, the closure cap 18 may be securely attached to the container body 12 or the container body 12' (as shown in FIG. 10). The present disclosure may permit the use of a container or bottle without a liner sealingly attached to the bottle neck, which avoids creating small pieces of plastic waste upon container opening. Furthermore, the inclusion of the tamper evident element on the exterior of the closure cap 18, (e.g., the moveable panel or wall 24 or 24'), allows a food package to be sold without a liner, while still providing a safety or package integrity feature therein. Further, inclusion of a closure cap retention mechanism, such as discontinuous threads with a spaced thread portion and a ratchet or other projections engaging the space to prohibit removal of the closure cap from the bottle described in the above-identified application, allows the consumer to observe potential tampering from the exterior of the closure cap 18 without concern that the closure cap 18 may have been removed from the bottle 12 by being unthreaded or otherwise tampered with prior to purchase.

More particularly, FIG. 10 illustrates a container body 12' with discontinuous threads and projections 16' that permit a closure cap 18" to be securely attached thereto such that the closure cap 18" may not be manually removed therefrom. The closure cap 18" includes the tamper evident structure or package integrity feature of the movable panel or wall 24" and also the threads and ratchet projections described above in co-pending U.S. patent Ser. No. 17/714,041 and International Patent Application No. PCT/US2020/039387, filed Jun. 24, 2020, which are incorporated herein by reference in their entirety. Furthermore, such a retention mechanism in the closure cap 18" prohibits one from unthreading the cap 18" from the container bottle 12" thereby requiring that a user or consumer depress or move the movable wall 24" from the first position to access the contents in the container body 12' once the closure cap 18" is attached thereto.

In some illustrative approaches, the closure cap 18, which may include the base 20, the flip-top lid 22, and/or the movable panel or wall 24, is comprised of a single material, such as, for example, a polypropylene or other food grade plastic or polymer, or similar recyclable material. In operation, having the closure cap 18 formed of a single material may increase the ease and likelihood of recycling the material. Further, having a package integrity feature or a tamper evident structure such as movable panel or wall 24 that does not fully detach from the remainder of the closure cap 18 permits more of the plastic closure cap 18 to be recycled.

By some approaches, the material may be chosen with a specific surface tension. For example, one or more surfaces of the closure cap 18 may be rougher or textured to provide flow resistance and help control the flow of the fluid 5 being dispensed. Some of the interior surfaces of the closure cap 18 may be textured to inhibit flow or may have a smooth surface to facilitate movement of the fluid 5 therethrough. A smooth surface may result in faster and/or less controlled fluid flow, and due to a reduction in surface tension, may also lead to leakage of the product or a separated component of the product. The finish of the material or the manner in which the element was formed also may impact the surface tension of the elements and help facilitate control of the fluid flow. For example, some portion of the closure cap 18 may be formed in such a manner as to create a rough surface that might impact the flow of the fluid 5 passing therethrough.

The benefits of the containers disclosed herein may be further leveraged if the closure caps and/or bottles may be employed with a number of differently configured containers. Indeed, the teachings outlined herein including, for example, the container body and closure cap may be employed with a variety of other closure caps and container body features.

For example, the tamper evident feature or structure illustrated via the movable panel or wall 24, 24' may be incorporated into a closure cap with an internal shaft and a disk that such that the contents or fluid 5 within the container body 12 can be dispensed or metered out. In one configuration, these teachings may be combined with a metering element such as that described in U.S. application Ser. Nos. 17/353,376; 17/353,326; 17/353,484; 17/353,446, all of which were filed Jun. 21, 2021, and in International Patent Application No. PCT/US2019/067485, filed Dec. 19, 2019, which claims priority to U.S. Patent Application Nos. 62/783,790, filed Dec. 21, 2018 and 62/903,245, filed Sep. 20, 2019, and International Patent Application No. PCT/US2020/035840, filed Jun. 3, 2020, which claims priority to U.S. Patent Application No. 62/903,245, filed Sep. 20, 2019 which are all incorporated by reference herein in their entirety.

Accordingly, if the closure cap 18 is formed with an internal shaft and metering disk, the closure cap may be formed with or without a silicon membrane or rubber valve at the dispensing opening 34. If the closure cap 18 lacks a silicon membrane, the closure cap may be more easily recyclable.

In some configurations, a method of opening a closure cap 18 such as that described herein includes providing a closure cap 18 comprising a base 20 and a flip-top lid 22 hingedly connected to the base 20, where the base 20 and the flip-top lid 22 form a recess 70 permitting a user to apply a force to the flip-top lid 22 to move the flip-top lid 22 from a closed position to an open position), pivoting a movable panel or wall 24 covering an opening to the recess 70 to uncover the opening to the recess 70, and applying a force to a portion of the flip-top lid 22 at the recess 70 to move the flip-top lid 22 about the hinged connection 19 to the base 20 to the open position. As suggested above, in some embodiments, pivoting the movable panel or wall 24 includes pivoting the movable panel or wall 24 into the recess 70 and securing the movable panel or wall 24 to a retention member 92 of the closure cap 18 to prevent the movable panel or wall 24 from returning to cover the opening to the recess 70.

Further, in some approaches, a method of manufacturing a closure cap 18 includes forming, in a mold, a flip-top closure cap including a base 20 and a flip-top lid 22. In some embodiments, the molded base 20 has a dome-shaped wall with an opening therethrough, an inner skirt with threads thereon, an outer skirt connected to the inner skirt by a planar portion and/or possible strengthening ribs, and a movable wall at the grasping portion of the flip top lid. The movable panel or wall 24 of the molded flip-top lid 22 generally extends at least partially across the finger opening or recess 70 that is grasped to open the flip-top lid 22 and move it from the close to the open position. Further, the molded closure cap 18 also has a flip-top lid 22 hingedly connected to the base 20, where the flip-top lid 18 has an interior projection 90 and is movable from a first position where the interior projection blocks the opening 34 to a second position where the interior projection does not obstruct the opening 34 of the base 20. The molded closure cap 18 also has a hinge 67 adjacent the movable panel or wall 24 and one or more anchoring or breakable members 25 on an opposite side of the movable panel or wall 24 from the hinge 67.

Accordingly, in one exemplary embodiment, a closure cap 18, such as that described herein, is formed by molding a receptacle having neck threads thereon, filling the receptacle with a thixotropic fluid, molding a closure cap 18 having a base 20 and a flip-top lid 22 hingedly connected to the base 20, and closing the filled receptacle with the closure cap 18. As suggested above, the molded base 20 includes an inner and outer skirt with base threads disposed on the inner skirt, the base threads configured to engage the neck threads of the receptacle and the base and the flip-top lid 22 having an outer wall 98 with a recess 70 therein permitting a user to grasp the flip-top lid 22 and manually move the flip-top lid 22 from a closed position to an open position. The molded closure cap 18 typically further includes a moveable panel or wall 24 that moves or rotates from a first position adjacent the outer wall 98 of the closure cap 18 to a second position upon initial opening of the closure cap 18, wherein the second position securely retains the moveable panel or wall 24 in a cavity adjacent the recess 70 to prevent the moveable panel or wall 24 from being completely detached from a remainder of the closure cap 18.

As the closure cap 18 described herein includes a tamper evident structure or feature, a liner does not need to be sealed to the container body to provide a tamper evident feature. Accordingly, the method of manufacturing a filled dispensing bottle does not need to include sealing a liner to the container body and the method of filling the receptable may include securing the closure cap 18 to the receptable without a liner attached thereto.

In one exemplary approach, the closure cap 18 is molded in a unitary configuration. More particularly, the closure cap 18 is typically made from a single, integral, unitary, one-piece structure and are comprised of the same material. In operation, after the closure cap 18 may be molded as a one-piece structure and ejected from the mold or printed as a one-piece structure.

While the bottle 10 may be used to contain a variety of fluids, in one illustrative approach, the dispensing bottle 10 includes a container body 12 with a thixotropic fluid (such as, e.g., a condiment) where the neck of the container body has threads thereon for engaging with threads of a closure cap. To provide a tamper evident indicator for the closure cap 18, the closure cap 18 may include a moveable panel or wall 24 disposed at a recess 70 between the flip-top lid 22 and the base 20, where the moveable panel or wall 24 moves or rotates from a first position adjacent the outer wall 98 of the closure cap 18 to a second position upon initial opening of the closure cap 18, wherein the second position securely retains the moveable panel or wall 24 in a cavity adjacent the recess 70 to prevent the moveable panel or wall 24 from being completely detached from a remainder of the closure cap 18. Further in one exemplary embodiment, the moveable panel or wall 24 is securely attached to the at least one of the base 20 and/or the flip-top lid 22 in the first configuration via at least one of a hinge 67 and/or one or more breakable members 25. In one approach, the moveable panel or wall 24 is secured in the first configuration via both the hinge 67 and multiple breakable members 25. In one such approach, the moveable panel or wall 24 is attached to the flip-top lid 22 via a hinged connection 67 and is maintained in position adjacent the outer wall 98 by a plurality of breakable members 25. In another such approach, the moveable panel or wall 24 is attached to the base 20 via a hinged connection 67 and is maintained in position adjacent the outer wall 98 by a plurality of breakable attachment points or members 25. In use, the breakable members 25 are configured to break upon the moveable panel or wall 24 being moved or rotated from the first position toward the second position, thereby permitting the flip-top lid 22 being moved from the closed position to the open position. As discussed above, the movable panel or wall 24 a first edge 31 adjacent the hinge 67 and a second edge 33 opposite the first edge 31 and the closure cap 18 further includes a retention mechanism 92, such as, e.g., a pin, ledge, flange, bump, or other structure to secure the second edge 33 such that the moveable panel or wall 24 is secured within the recess 70.

Figure 11:
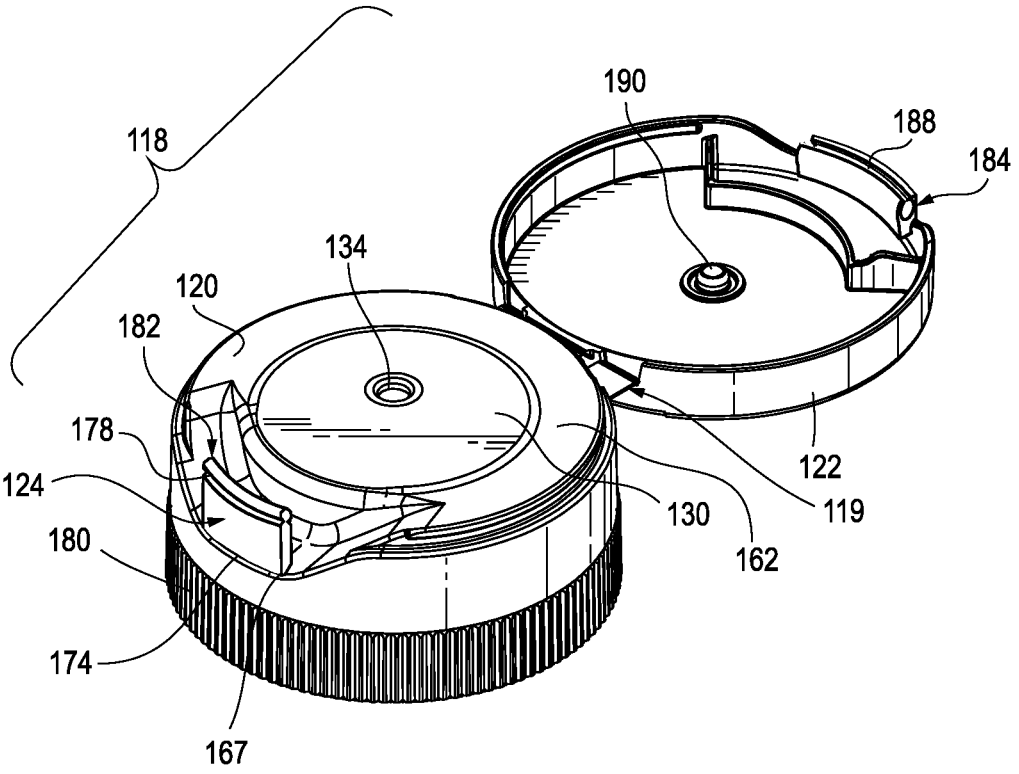
FIG. 11 is a perspective view of another embodiment of a closure cap in an initial open configuration in accordance with some embodiments.
Figure 12:
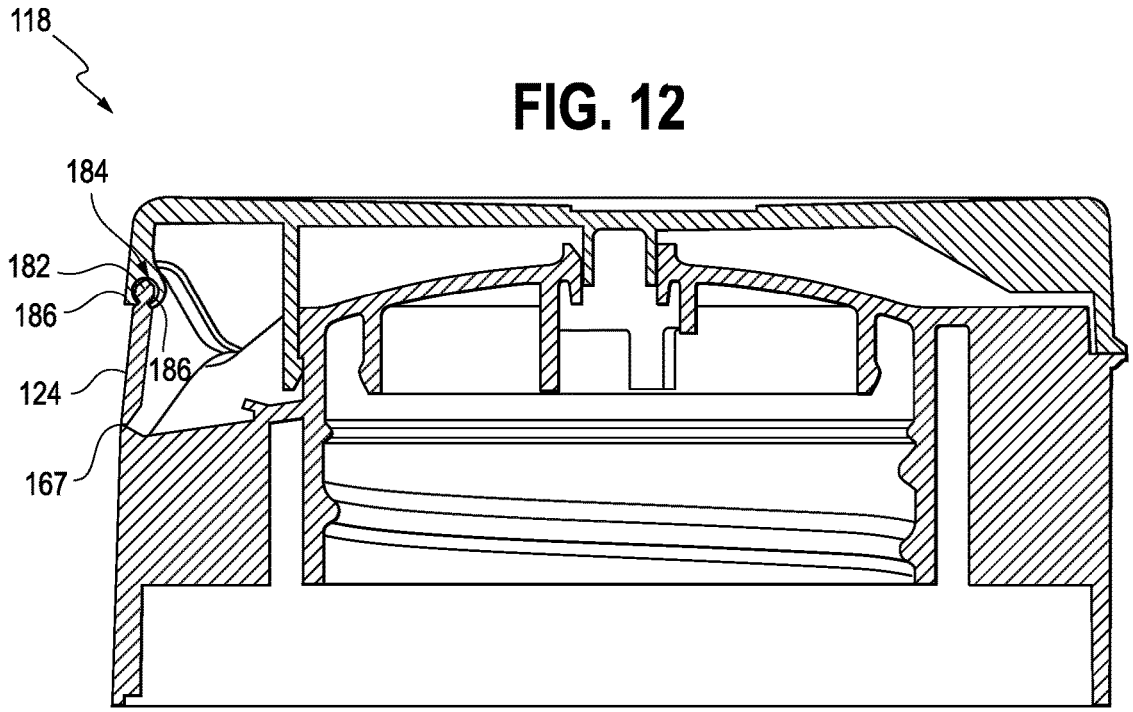
FIG. 12 is a cross sectional view of the closure cap of FIG. 11 in an initial closed configuration.
Figure 13:
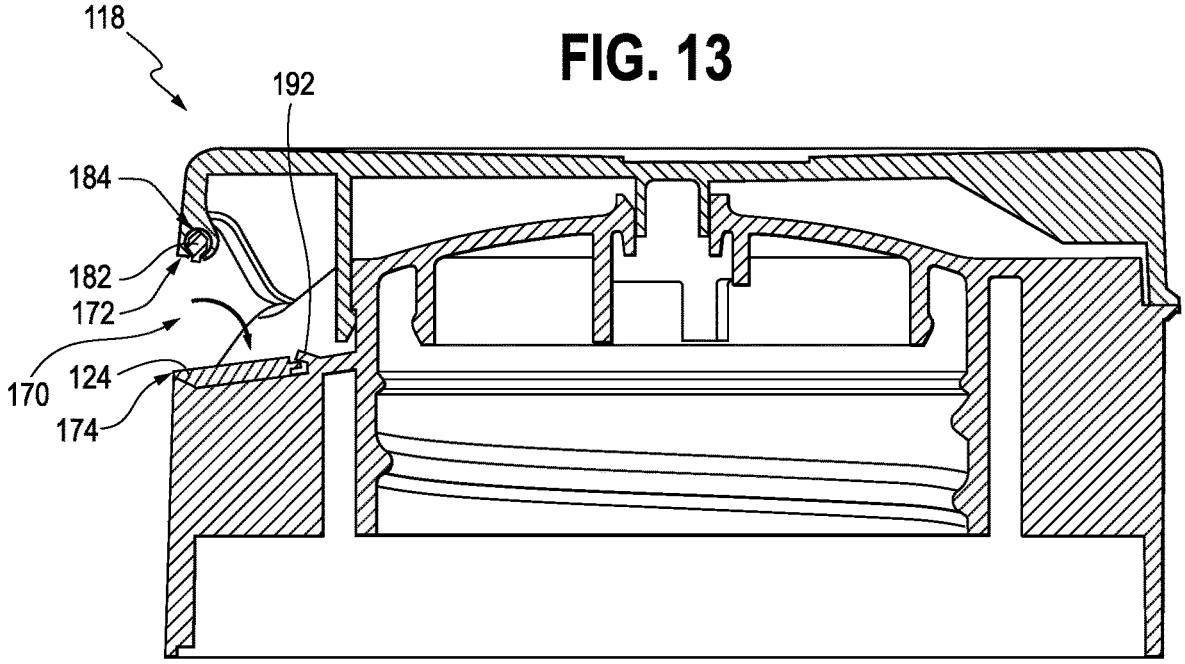
FIG. 13 is a cross sectional view of the closure cap of FIG. 11 in a subsequently closed configuration.

Turning now to FIGS. 11-13, another embodiment of a closure cap 118 is illustrated with a movable panel 124 hingedly connected to the closure cap 118 to provide a tamper evident indicator. For conciseness and clarity, the references numeral used for features of the closure cap 18 of the first embodiment that correspond to similar features of the closure cap 118 of the second embodiment will be used with a prefix "1" added to the reference numerals. For example, a feature of the closure cap referenced by the reference numeral "90" will be shown with reference numeral "190" with regard to the closure cap 118. The closure cap 118 may be incorporated into any dispensing bottle or container body in a manner similar to that described with prior embodiments.

FIG. 11 illustrates a closure cap 118 having a base 120 and a lid 122 in an initial open position. As used herein, the initial open position is generally the configuration that the closure cap is disposed in during manufacturing, after which the closure cap will be moved to the initially closed configuration. In one illustrative approach, the closure cap 118 is created in a forming mold in this initial open configuration and, after molding, is ejected from the mold in this configuration. Prior to being shipped to consumers, the flip top lid 122 is moved from the initial open position (FIG. 11) to the initial closed position (FIG. 12) such that the flip-tip lid 122 is positioned atop the base 120 such that the projection 190 blocks the opening 134. In addition, when the flip-top lid 122 is rotated about hinge 119 to the closed position (FIG. 12) a breakable member or projection 182 atop the movable panel 124 is inserted into a recess or receiving element 184 of the flip top lid 122.

Turning briefly to FIG. 13, the recess opening 170 has an upper edge 172 and a lower edge 174, similar to embodiments previously described. While the embodiment of FIGS. 11-13 includes the receiving element 184 disposed at the upper edge 172 and the hinge 167 disposed at the lower edge 174, other embodiments with a different orientation are contemplated, such as that shown in FIGS. 14-16 described below.

When the closure cap 118 is moved from the initial open configuration (FIG. 11) to the initial close configuration (FIG. 12), the projection 182 (which may include, for example, a barb, hook, snap-hook projection, and/or other structure for securely coupling the projection with the receiving element) is advanced into the receiving element 184 (which may include a channel, cup, housing, grasping arms, and/or other structure for securely retaining the projection 182 therein or therewith). In one exemplary embodiment, a leading portion of the projection 182 is aligned with the receiving element 184 as the projection 182 is pressed into the receiving element 184. In some configurations, the receiving element 184 includes a pair of flexible arms 186 that flex outwardly, away from one another, to permit the projection 184 to advance into a slot 188 formed by the receiving element 184 as the flip top lid 122 is rotated into the initial closed position. The receiving element 184, while shown here as elongated, linear element, also may have a discrete configuration, such as discrete cups.

By one illustrative approach, the barb or projection 182 is configured such that it may be easily pressed into the receiving element 184 but not backed out or removed therefrom. Indeed, a user attempting to lift the flip top lid 122 from the base 120 while the projection 182 is attached to the movable panel 124 will meet significant resistance. Indeed, to open the closure cap, a user will typically apply pressure inwardly onto the movable panel 124 to fracture it. More specifically, a portion of the movable panel 124, i.e., the projection 182, is severed from a remainder of the movable panel 124, upon application of sufficient force to the movable panel 124. In addition, a user or consumer, upon investigation thereof, may readily identify whether the projection 182 is still attached to the movable panel 124, thereby providing a visually apparent tamper evident indicator.

More particularly, in one illustrative configuration, the projection 182 includes a leading or upwardly facing surface that has sloping sides expanding outward from one another, such that the projection 182 gently flexes the arms 186 of the receiving element 184 to permit the projection 182 to advance beyond the lowermost portion of the receiving element 184 such that it is disposed within a slot 188 of the receiving element 184. In one exemplary approach, the configuration of the projection 182 also prohibits it from being backed out of or manually removed from the receiving element 184 without severing or breaking the projection 182 from a remainder of the movable panel 124 as noted above.

Indeed, to open the closure cap 118, a user typically applies an inward force to the movable panel 124, as described above. As illustrated, the movable panel 124 is generally secured to a remainder of the closure cap 118 by a hinge 167 at one end thereof and one or more the projections 182 at another end thereof. Further, in this embodiment, the movable panel 124 includes an area or line of weakness 178 disposed between a main body of the movable panel 124 and the projection 182. The line of weakness 178 is typically breakable, severable, or frangible. Accordingly, once a user or consumer has applied sufficient force to the movable panel 124 while the projection 182 is disposed in the receiving element 184, the movable panel 124 severs or breaks at the line of weakness 178. When the projection 182 breaks from a remainder of the movable panel 124, the projection 182 is retained within the receiving element 184. In this manner, the small piece of plastic forming the projection 182 is much more likely to be recyclable.

Further, by having the user apply a force that is generally orthogonal to the length of the movable panel 124 (which is captured at one end thereof by the hinge 126 and at the other end thereof by the retention element 184), the movable panel 124 moves from its initial unopened configuration (FIG. 12) and into its subsequently opened configuration (FIG. 13). In some embodiments, the movable panel 124 will move into a secured position, such as that shown in FIG. 13, where an end of the movable panel 124 formerly adjacent the projection 182 being retained in position by a structure of the closure cap, such as, e.g., a retention flange 192.

As noted above, the closure cap 118 is typically formed via molding, such as injection molding, and is formed in an open position. Specifically, an initial open position where the projection 182 is formed as an extension of the movable panel 124. Further, to form particular elements of the closure cap 118, a variety of tools may be employed, such as, for example, one or more mold slides, lifts, pins, and/or other tools to create particular features during the molding operation. In addition, post-molding processing also may be used in conjunction with or as an alternative to specialized molding tools, such post-molding tools may include, e.g., a knife or laser cutting device. In one illustrative example, the hinge 167 or line of weakness 178 may be formed, in part, via molding tools, whereas in another illustrative example, these may be formed, in part, using post-processing tools.

Figure 14:
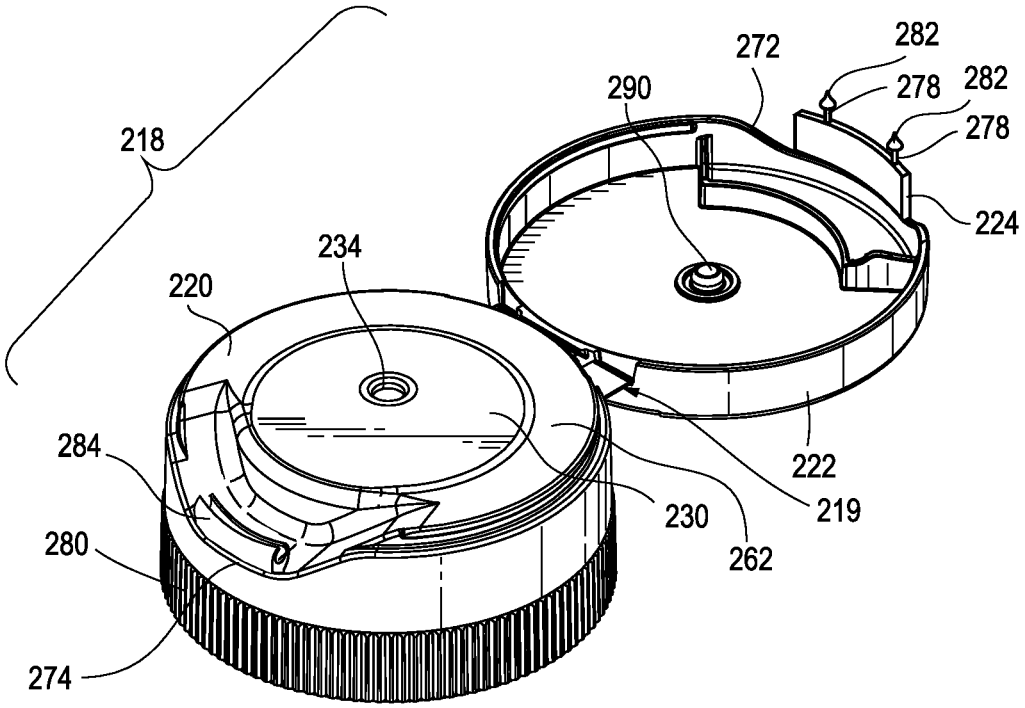
FIG. 14 is perspective view of another embodiment of a closure cap in an initial open configuration in accordance with some embodiments.
Figure 15:
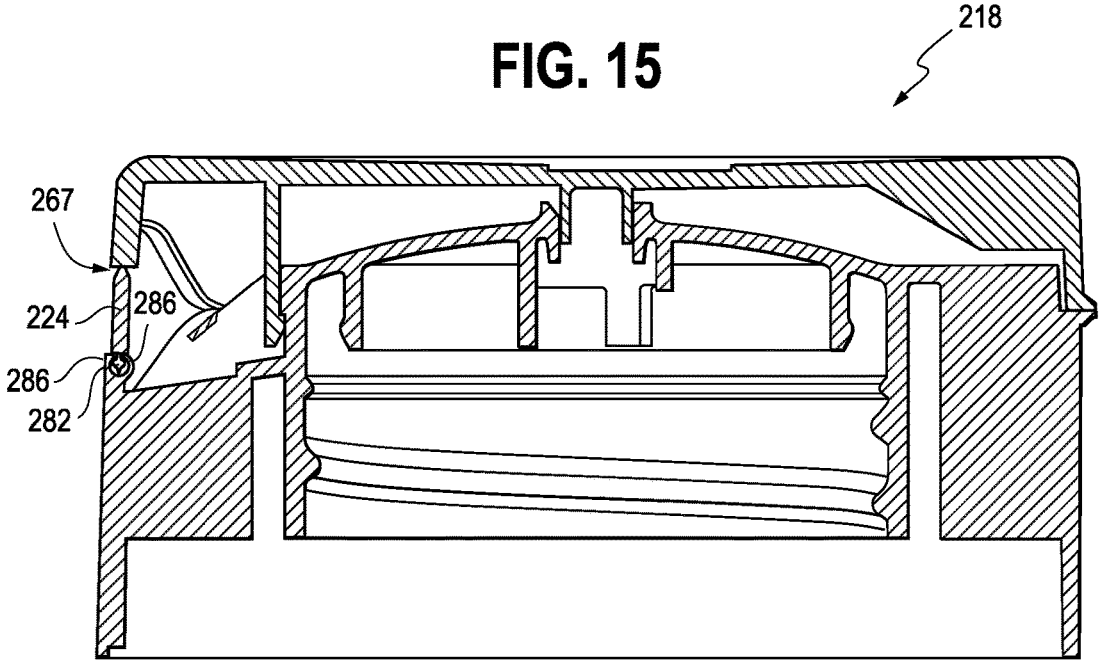
FIG. 15 is a cross sectional view of the closure cap of FIG. 14 in an initial closed configuration.
Figure 16:
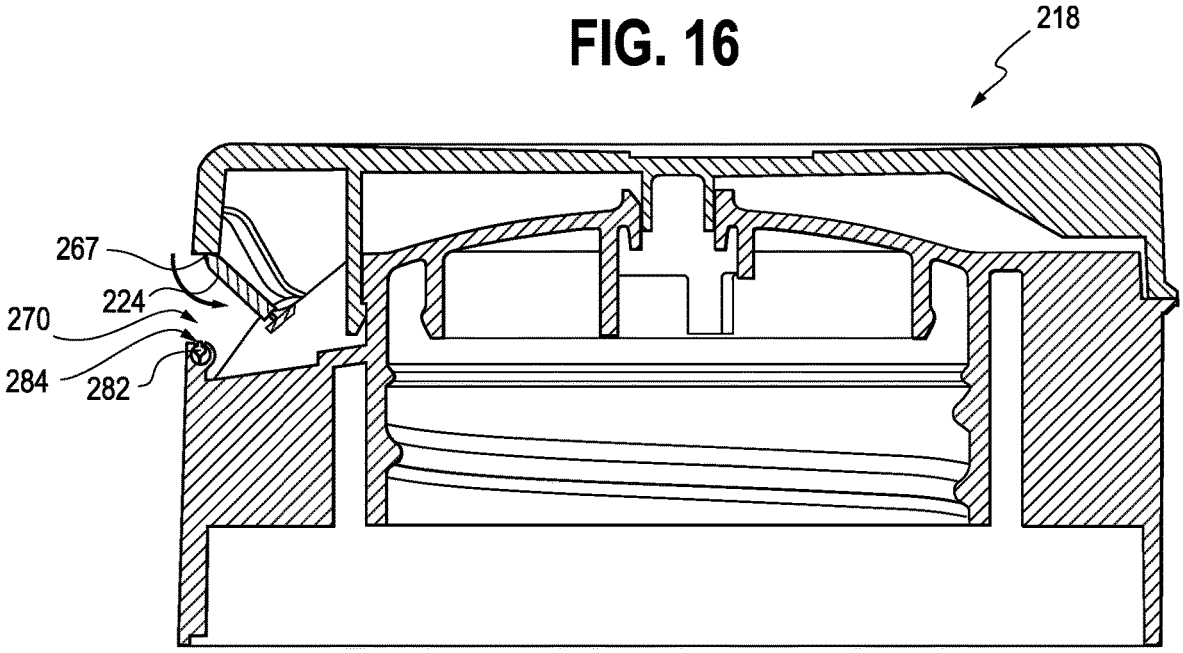
FIG. 16 is a cross sectional view of the closure cap of FIG. 14 in a subsequently closed configuration.
Figure 17A:
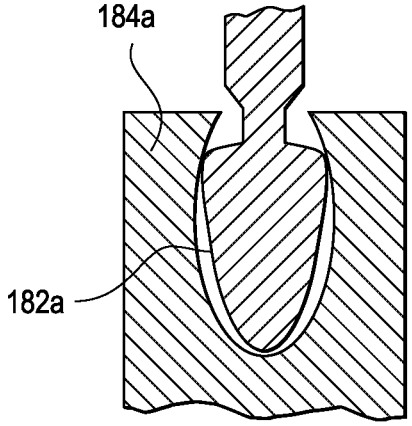
FIGS. 17A-17D are cross sectional views of a portion of the closure cap.
Figure 17B:
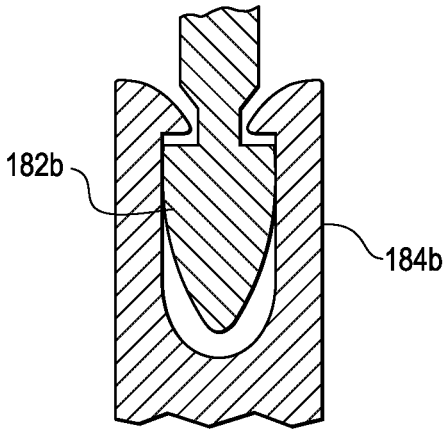
Figure 17C:
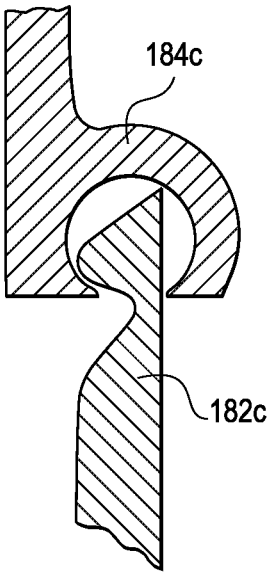
Figure 17D:
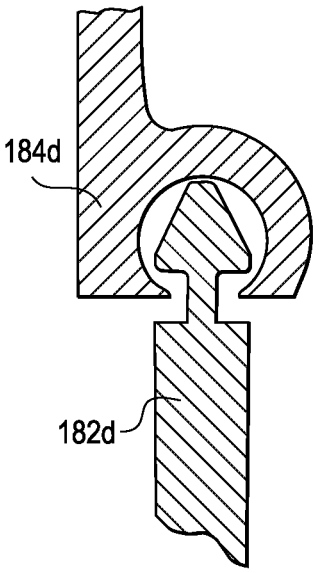

The embodiments of FIGS. 11-16 include movable panels 124, 224 that have a hinge on one side or end thereof and one or more breakable projections on an opposing side or end thereof. While FIGS. 11-13 included a hinge on the lower opening edge 174, the closure cap 218 of FIGS. 14-16 includes a hinge 267 disposed at an upper edge 272 of the recess opening 270. The tamper evident indicator provided by the movable panel 224 is similar to those previously described. While the projection 182 of FIG. 11 took the form of a linear projection, the projections 282 include discrete barbs or projections 282 that have a diamond or spade-shape. Despite the different configurations, the projections 282 operate similarly to projection 182. More particularly, the movable panel 224 includes both a pair of projections 282 and a line or area of weakness 278 between the projections 282 and the remainder of the movable panel 224. FIG. 14 illustrates the closure cap 218 in the initial open position and FIG. 15 illustrates the closure cap 218 including the movable panel 224 in the initial closed position (i.e., the movable panel 224 still has the projections 282 attached thereto and the projections 282 are disposed within the receiving element 284). To open the closure cap 218, a user presses or applies an inward force onto the movable panel 224 such that the projections 282 separate from a remainder of the movable panel 224 at the area of weakness 278. The projections 282 typically remain disposed within the retaining element 284 such that they may be recycled with a remainder of the closure cap 218.

Though FIGS. 11-16 illustrate two embodiments of the closure cap providing a tamper evident movable panel with breakable portions, other configurations might be employed. Indeed, FIGS. 17A-17D illustrate additional examples of how the projections 182*a*, 182*b*, 182*c*, 182*d* and the receiving element 184*a*, 184*b*, 184*c*, 184*d* may be configurated.

Figure 18:
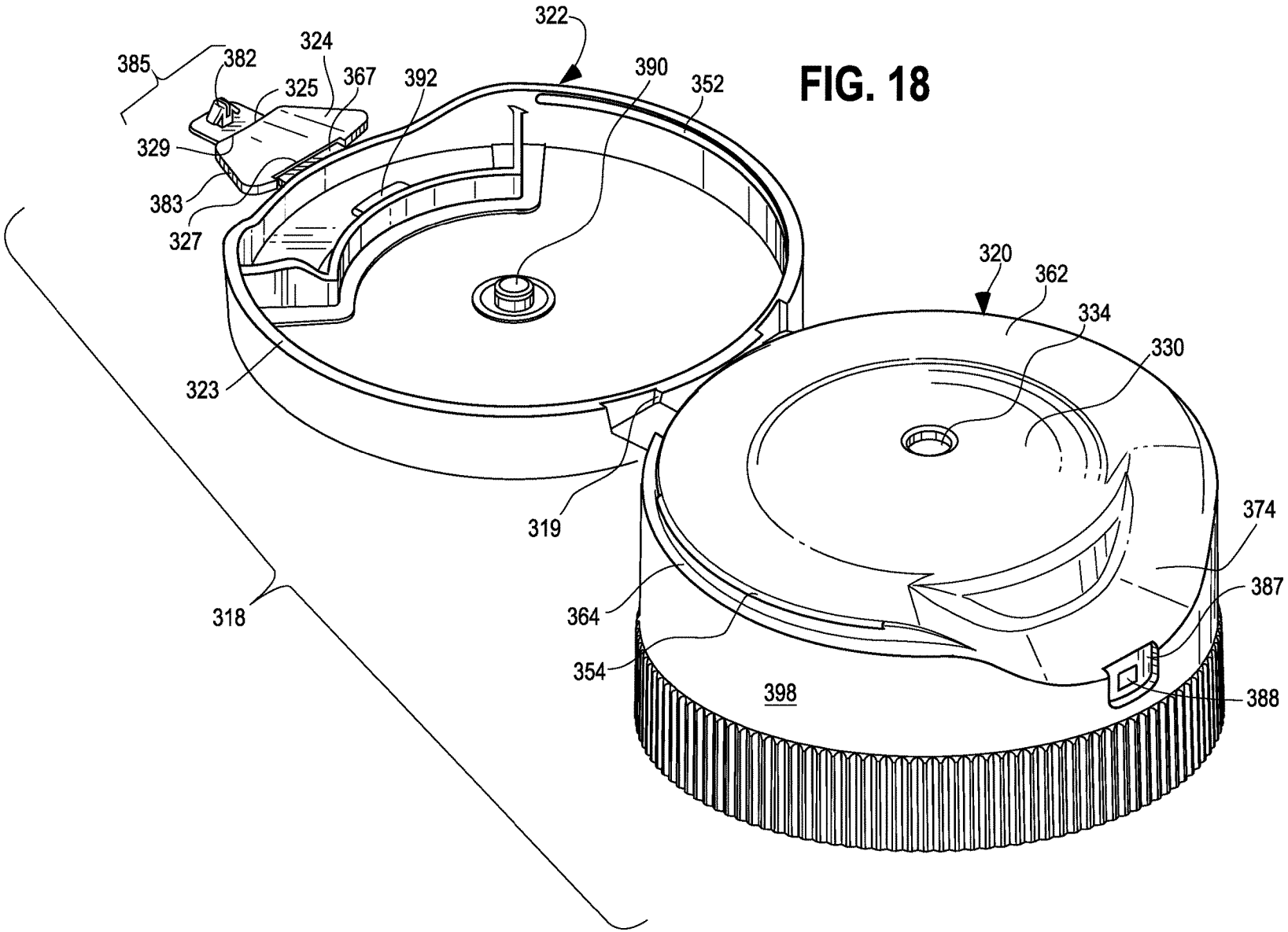
FIG. 18 is a perspective view of another embodiment of a closure cap in an initial open configuration in accordance with some embodiments.
Figure 19:
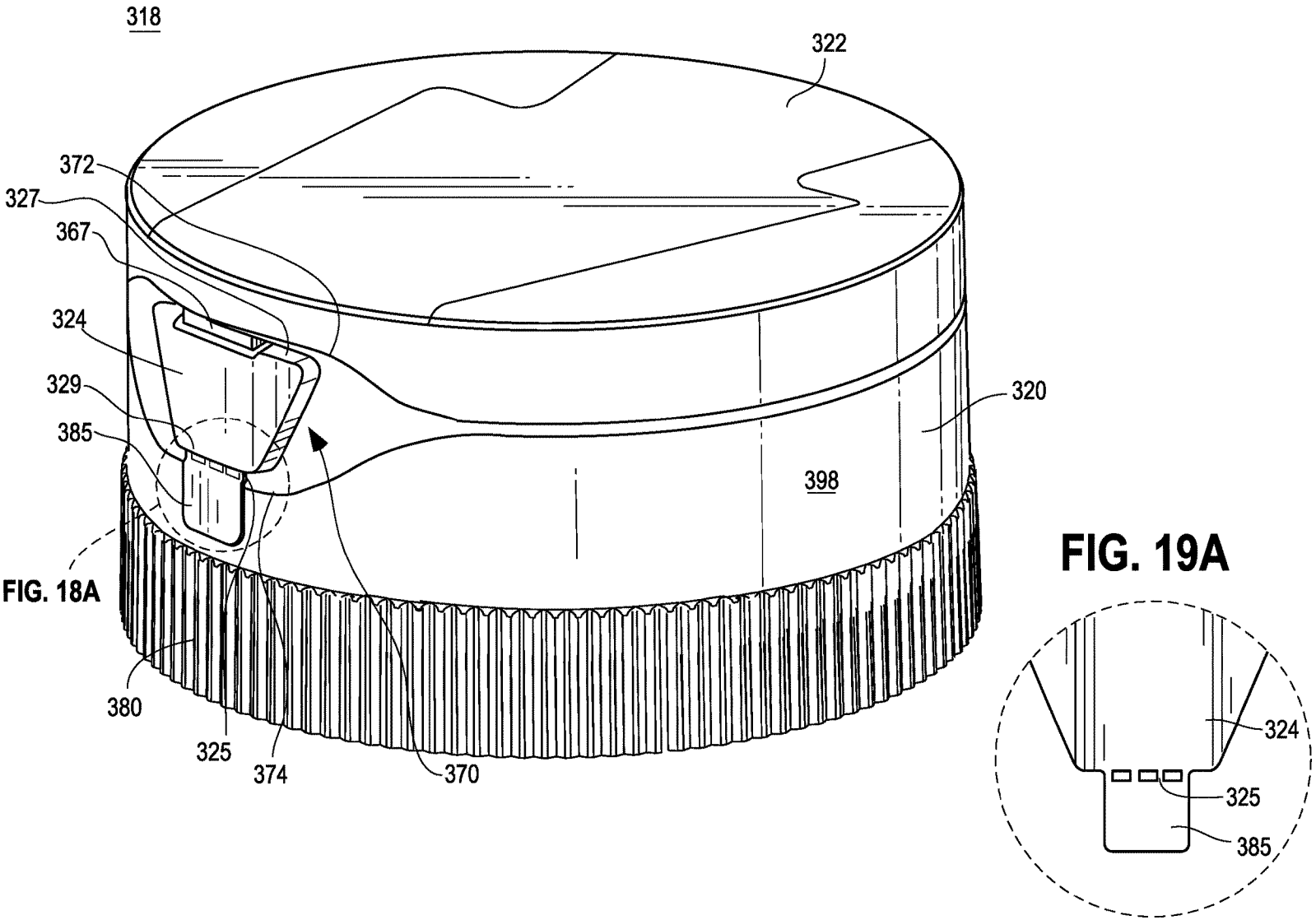
FIG. 19 is perspective view of the closure cap of FIG. 18 in an initial closed configuration.

Turning now to FIGS. 18-24, another embodiment of a closure cap 318 is illustrated. FIG. 18 is a perspective view of another embodiment of a closure cap in an initial open configuration in accordance with some embodiments. FIG. 19 is a perspective view of the closure cap of FIG. 18 in an initial closed configuration in accordance with some embodiments.

For conciseness and clarity, the reference numerals used for features of the closure cap of the embodiments described above that correspond to similar features of the closure cap 318 of the current embodiment will be used with a prefix "3" added to the reference numerals. For example, a feature of the closure cap referenced by the reference numeral "90" will be shown with the reference numeral "390" with regard to the closure cap 318. The closure cap 318 may be incorporated into any dispensing bottle or container body in a manner similar to that described with prior embodiments. Further, the closure cap 318 may be incorporated into any features of the closure cap of the previously described embodiments (for example, the closure cap 18) unless described otherwise. This rule may also apply to other embodiments described hereafter.

Referring to FIGS. 18 and 19, the closure cap 318 comprises a base 320 and a flip-top lid 322 hingedly connected to the base, a movable wall 324, an extension tab 385, and a breakable member 325. In one illustrative approach, the closure cap 318 is created in a forming mold in an initial open configuration and, after molding, is ejected from the mold in this initial open configuration (FIG. 18). Prior to being shipped to consumers, the flip top lid 322 is moved from the initial open position (FIG. 18) to the initial closed position (FIG. 19) such that the flip-tip lid 322 is positioned atop the base 320 such that the extension tab is fixedly attached to the base 320.

In some embodiments, the base 320 may include a central portion 330, through which an opening 334 extends, and a substantially planar portion 362. The substantially planar portion 362 and the lower surface 374 of the recess 370 (i.e., the recess forming surface of the base 320) may extend around the central portion 330. Circumferential sides of the base 320 include a circumferential ledge 364 such that the top surface of the base has an indented side surface that is indented from the side wall of the closure cap 318. The top surface of the base 320 may include the top surface of the central portion 330 and a surface of the substantially planar portion 362. The indented side surface may extend around the substantially planar portion 362. The base 320 may include a lower ridge 354 near the top portion of the indented side surface such that the lower ridge 354 may form a recessed portion thereunder.

The flip-top lid 322 is movable between an open position (FIG. 18) and the closed position (FIG. 19). In some embodiments, the flip-top lid 322 and the base 320 together form a recess 370 in an outer wall of the closure cap 318 when the flip-top lid 322 is in the closed position. The recess 370 may form a grasping area where a user may apply a force to move the flip-top lid 322 from the closed position to the open position. The flip-top lid 322 may include an upper ridge 352 on the inner surface of the sidewall adjacent to the lower end 323 of the flip-top lid 322. The upper ridge 352 may be configured to be disposed at the recessed portion formed under the lower ridge 354 of the base when the flip-top lid is in the close position.

Figure 22:
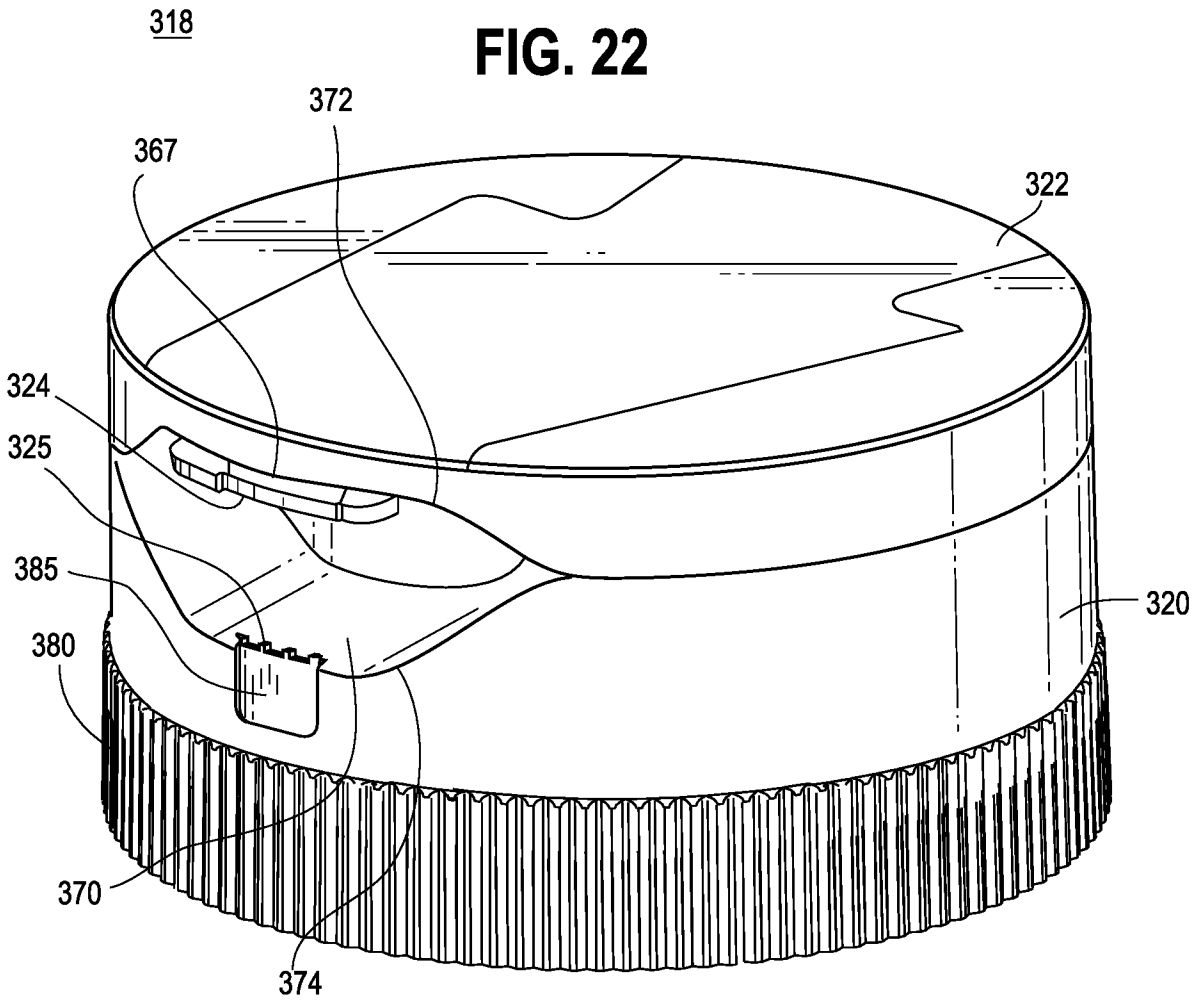
FIG. 22 is a perspective view of the closure cap of FIG. 18 wherein a movable wall of the closure cap is in a second position in accordance with some embodiments.

In some embodiments, the movable wall 324 is attached to the flip-top lid 322 via a hinge 367. The movable wall 324 is rotational from a first position (FIG. 19) to a second position (FIG. 22). In some embodiments, when the movable wall 324 is in the first position, the movable wall 324 is substantially continuous with an adjacent sidewall 398 of the closure cap 318 and when the movable wall 324 is in the second position, one edge of the movable wall 324 is disposed inward into the recess 370. In some embodiments, in the initial closure configuration, the moveable wall 324 may cover at least a part of the opening of the recess 370. In these embodiments, an upper edge 327 of the movable wall 324 generally corresponds to an upper edge 372 of the recess 370 and a lower edge 329 of the movable wall 324 generally corresponds to a lower edge 374 of the recess 370.

In some embodiments, the extension tab 385 extends from the movable wall 324. The outer surface of the extension tab is substantially continuous from or in alignment with the outer surface of the movable wall 324. After an initial closing, the extension tab 385 is fixedly attached to the base 320. For example, the upper edge 327 of the movable wall 324 is connected to the flip-top lid with the hinged connection 367 and the extension 385 extends from the lower edge 329 of the movable wall 324 and is fixedly attached to the base 320. In some embodiments, the extension tab 385 may comprise a flange 383 and a latching projection 382 extending from the flange 383. In some embodiments, the latching projection 382 may perpendicularly extend from the flange 383.

In some embodiments, the breakable member 325 is disposed between the extension tab 385 and the movable wall 324. The breakable member 325 is configured to be broken just prior to, upon, or once the movable wall 324 is rotatably moved from the first position toward the second position. The breakable member 325 may prevent a user from moving the flip-top lid 322 to the open position without moving the movable wall 324 from the first position to the second position. However, the breakable member 325 may break as the flip-top lid 322 is moving from the initial closed position toward the open position. Breaking the breakable member 325 by first moving the flip-top lid 322 from the initial closed position to the open position may require a greater force than by first breaking the breakable member 325 by moving/rotating the movable wall 324 from the first position to the second position. Indeed, though the breakable member 325 may be broken by moving the flip-top lid 22 from the initial closed position to the open position without moving the movable wall 324 when the user applies a sufficient force, it is typically easier for a user to first apply manual pressure to the movable wall 324 to separate or break the frangible of breakable member 325.

Figure 20A:
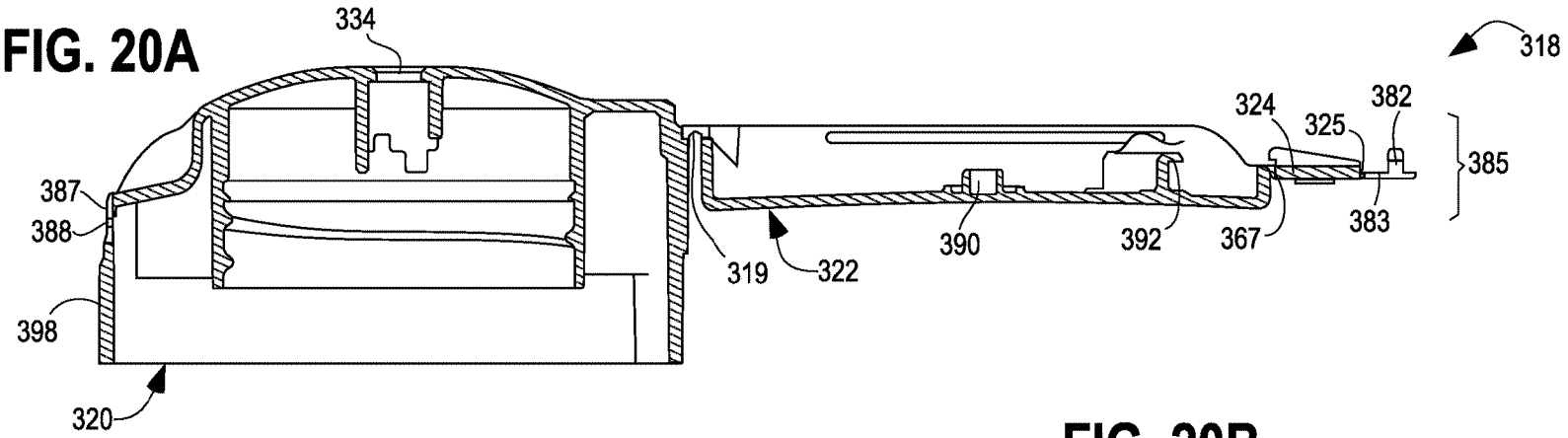
FIGS. 20A-20C are cross sectional views illustrating a manufacturing configuration, a closing configuration, and an initially closed configuration of the closure cap of FIG. 18.
Figure 20B:
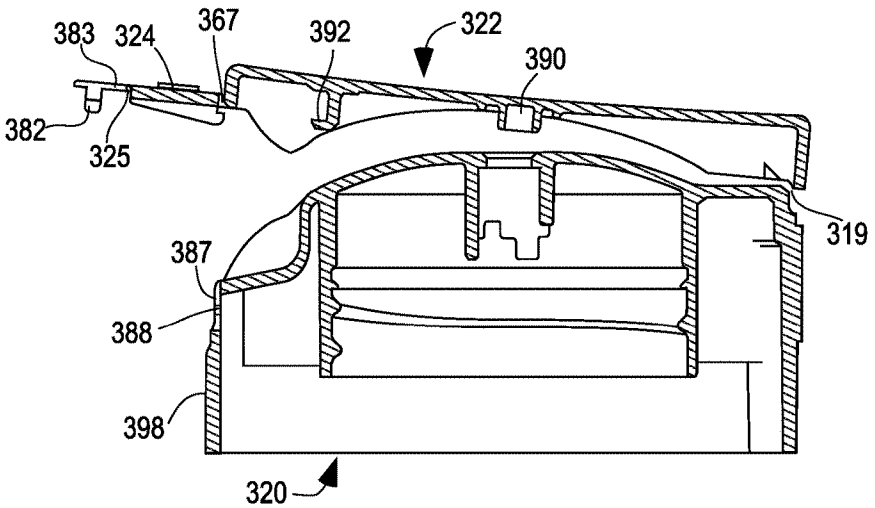
Figure 20C:
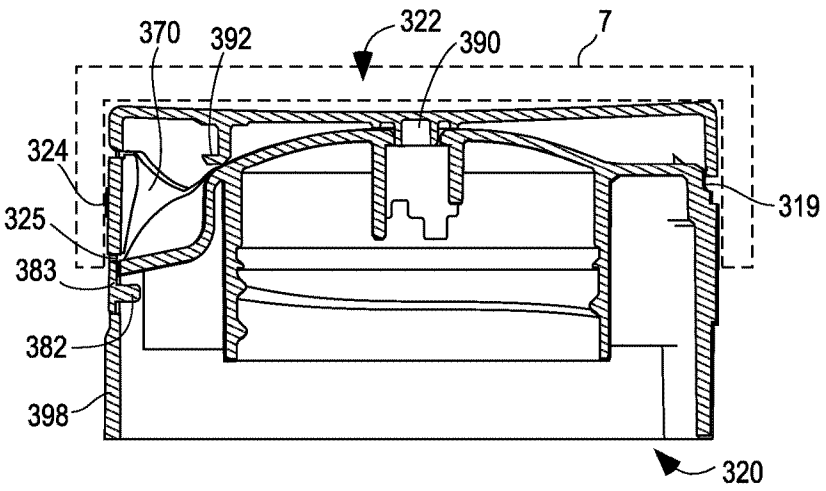

FIGS. 20A-20C are cross sectional views illustrating the closure cap 318 in various stages of manufacture including after initial formation of the closure cap 318 from the initial open configuration to the initial closed configuration in accordance with some embodiments. In some approaches, referring to FIG. 20A, the method of manufacturing a closure cap includes forming a molded closure cap having a base 320 and a flip-top lid 322. In one illustrative approach, the closure cap 318 is created in a forming mold in this initial open configuration and, after molding, is ejected from the mold in this configuration. In some embodiments, the molded base 320 has the central portion 330 having a dome-shaped wall with an opening 334 therethrough, an inner skirt with threads thereon, an outer skirt connected to the inner skirt by a planar portion and/or possible strengthening ribs. Though the central portion 330 is dome-shaped, other configurations may be used, such as, e.g., a truncated cone shape. The molded base also may have a receiving opening 388 in the sidewall of the molded base and an indented portion 387 be formed around the receiving opening.

In some embodiments, the molded closure cap 318 has a hinge 319 connecting a flip-top lid 322 and the base 320. The molded flip-top lid 318 may have an interior projection 390 on an inner surface thereof. In some embodiments, the molded closure cap 318 further includes the movable wall 324 extending from the flip-top lid. As shown in FIG. 20A, the movable wall 324 may not be in alignment with the sidewall of the flip-top lid 322 when it is in the molded configuration. Instead, when being molded, the movable wall 324 may be rotated outwardly relative to the sidewall of the flip-top lid 322. The molded closure cap 318 may further include a hinge 367 connecting the movable wall and the flip-top lid. The hinge 367 allows the movable wall 322 to be rotated relative to a remainder of the flip-top lid 322. The molded closure cap 318 may include an extension tab 385 extending from the movable wall 322. The molded extension tab 385 may comprise the flange 383 and the latching projection 382 extending from the flange 383. The molded closure cap may include one or more breakable members 325 (see, e.g., FIG. 19A) disposed between the flange 383 of the extension tab 385 and the movable wall 324. By one approach, the breakable members 325 are molded along with the remainder of the closure cap 318. In addition, the breakable members 325 may be further weakened beyond their structural design, by the application of an implement or tool, such as, for example, a laser or knife.

In one exemplary approach, the closure cap 318 is molded in a unitary configuration. More particularly, the closure cap 318 is typically made from a single, integral, unitary, one-piece structure and is comprised of the same material.

In some approaches, referring to FIGS. 20A-20C, the method of manufacturing a closure cap includes moving the flip-top lid 322 from the initial open position (FIG. 20A) to the initial closed position (through FIG. 20B to FIG. 20C). In the process of closing the flip-top lid 322, the upper ridge 352 (FIG. 18) of the flip-top lid 322 may be caught by the lower ridge 354 (FIG. 18) of the base 320, but by applying a slight force, the upper ridge 352 may snap into the recessed portion under the lower ridge 354 such that the flip-top lid 322 may completely be disposed in the closed position. When the flip-top lid is in the closed position, the upper ridge 352 may engage with the lower ridge 354 such that the flip-top lid 322 may remain in the closed position unless a force to open the flip-top lid is applied.

To facilitate the snapping of the upper ridge 352, the upper ridge and lower ridge may be made of a relatively flexible or elastic material that permits sufficient slight deformation of the elements. In some embodiments, the entire closure cap 318 may be made of a flexible or elastically deformable material, as is known in the art.

When the flop-top lid is in the closed position, the interior projection 390 typically blocks the opening 334 or inhibits movement of the bottle fluid therethrough. In some embodiments, when the flip-top lid 322 is being moved from the initial open position to the initial closed position, the movable wall may be in the initial position where the movable wall is rotated outwardly relative to the side wall of the flip-top lid as shown in FIG. 20B.

In some approaches, referring to FIGS. 20B and 20C, the method of manufacturing a closure cap may include an initially closing the closure cap. The initial closing operation may include moving the movable wall 324 from the initial position (FIG. 20B) to the first position (FIG. 20C) where the movable wall 324 is substantially continuous with or in alignment with the adjacent sidewall 398 of the closure cap 318. The initial closing may further include inserting the latching projection 382 (FIG. 21A) through the receiving opening 388 (FIG. 18) in the sidewall of the base 320 such that the flange 383 is disposed on the intended portion 387 of the sidewall of the base 320. In some embodiments, referring to FIG. 20C, an assembly cap 7 may be used in moving the movable wall from the initial position to the first position. The assembly cap 7 may have an inner side surface corresponding to the shape of the sidewall of the closure cap 318 in the initial closed configuration. In some embodiments, the movable wall 324 may be moved from the initial position to the first position by covering the closure cap 318 with the assembly cap 7. When the assembly cap 7 moves down and passes through the hinge 367 connecting the movable wall 324 and the flip-top lid 322, the assembly cap 7 may rotate the movable wall 324 from the initial position (FIG. 20B) to the first position (FIG. 20C). The closure cap 7 may move down until the latching projection 382 (or a portion thereof) is inserted through the receiving opening and the flange 383 is disposed on the indented portion 387 of the base such that the extension tab is fixedly attached to the base.

In some embodiments, the indented depth of the indented portion 387 is the same or similar to the thickness of the flange 383, such that when the extension tab 385 is engaged with the base 320, the outer surface of the flange 383 may align with the sidewall 398 of the base 320. In other embodiments, the thickness of the flange 383 may be slightly greater than the indented depth of the indented portion, such that the closure cap may have a smooth boundary between the extension tab and the outer surface of the base 320 adjacent to the extension tab 385.

Figure 21B:
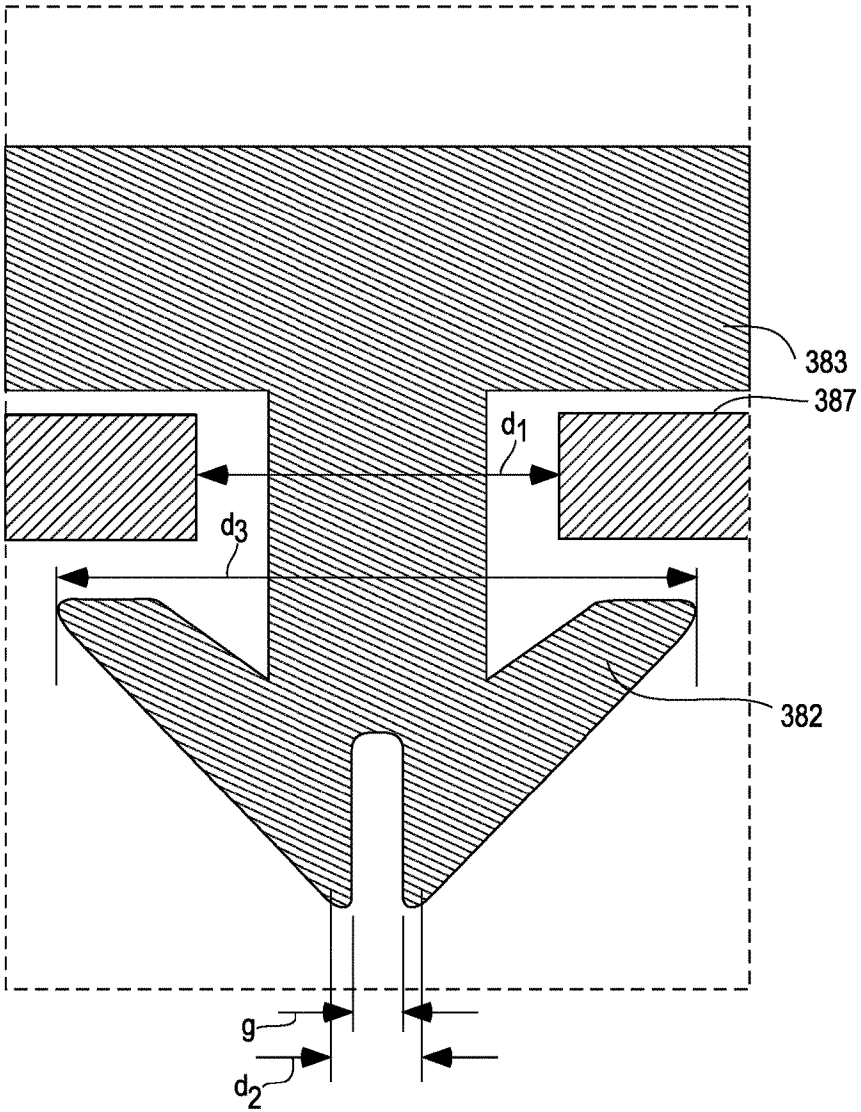
FIG. 21B is a cross sectional view of the latching projection of FIG. 21A.
Figure 21A:
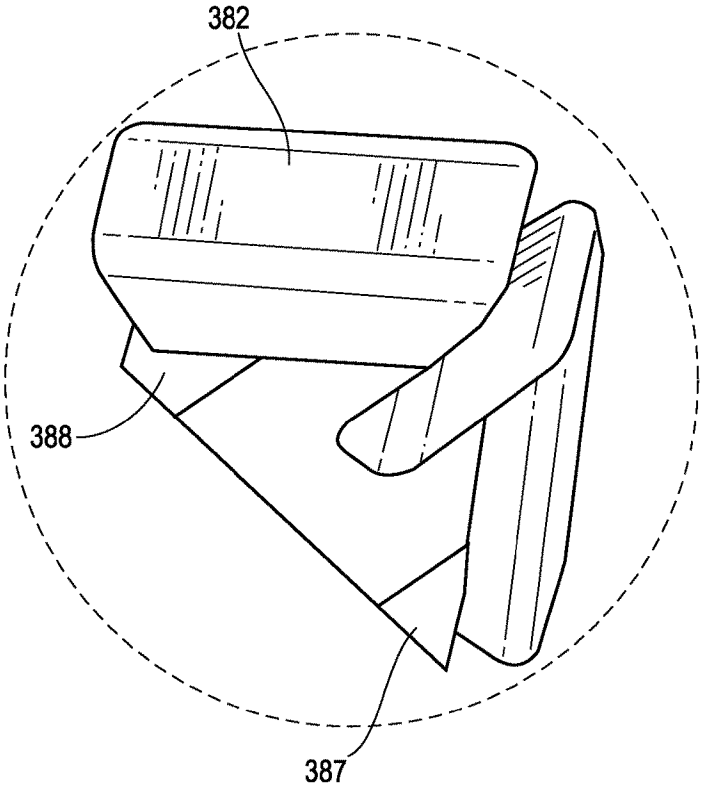
FIG. 21A is a perspective partial view of a latching projection of the closure cap of FIG. 18 in accordance with some embodiments.

FIG. 21A is a perspective view of a latching projection 382 inserted through a receiving opening in accordance with some embodiments. FIG. 21B is a cross sectional view of the latching projection of FIG. 21A in accordance with some embodiments.

The latching projection 382 may include, for example, a barb, hook, snap-hook projection, and/or other structure for securely coupling the latching projection with the receiving element such as the base 320 or the flip-top lid 322 through the receiving opening 388 thereon. For example, as illustrated in FIGS. 21A and 21B, the latching projection 382 comprises a pair of prongs or hooks, where each end of the hooks extends outwardly away from one another. By one approach, there is a gap (g) between the prongs or hooks to facilitate flexing or movement of the hooks relative to one another. The top end of the latching projection 382 may have a width (d2) that is narrower than the width (d1) of the receiving opening 388. The latching projection 382 may be flexible such that the hooks may be bent inward by narrowing the gap between them when it is inserted into the receiving opening. In some embodiments, the distance (d3) between the ends of the hooks extending outwardly away from one another is greater than the width (d1) of the receiving opening 388 such that the extension tab 385 may be fixedly attached to the base 320 by preventing the latching projection 382 from backing out or being removed therefrom. The latching projection 382 may have various shapes as described above or below.

As illustrated in FIG. 19 and FIG. 20C, in the initial closed configuration, the moveable wall 324 may be connected to the flip-top lid 322 via the hinge 367 and connected to the base 320 via the breakable member 325 and the extension tab 385. In the initial closed configuration, the upper edge 327 of the movable wall is adjacent to the upper edge 372 of the recess 370 and the lower edge 329 of the movable wall is adjacent to the lower edge 374 of the recess. In the initial closed configuration, in some embodiments, the breakable member 325 may be disposed above the lower edge 374 of the recess such that the breakable member 325 may cover a portion of the opening of the recess 370. In other embodiments, the breakable member may be disposed at or below the lower edge 374 of the recess 370.

Figure 23:
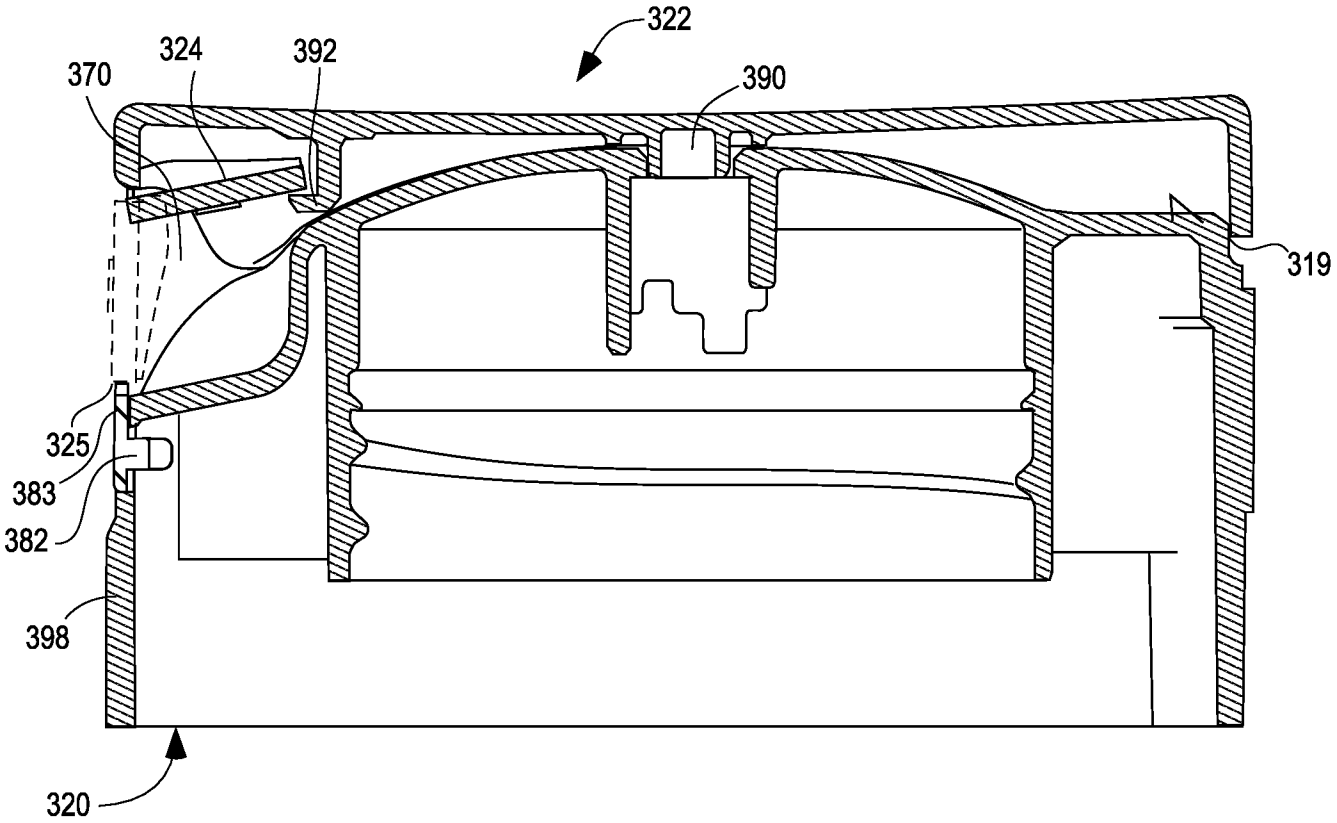
FIG. 23 is a cross sectional view of the closure cap of FIG. 22.

FIG. 22 is a perspective view of the closure cap 318 wherein the movable wall is in a second position in accordance with some embodiments. FIG. 23 is a cross sectional view of the closure cap of FIG. 22 in accordance with some embodiments. After the initial closing, the movable wall 324 may be moved from the first position where the movable wall is substantially aligned with a sidewall 398 to the second position where the one edge of the movable wall 324 is pushed inward from the sidewall 398 of the closure cap. For example, the movable wall 324 is disposed in the second position after the moveable wall 324 has been pivoted or rotated inward relative to the upper surface 472 of the mouth-shaped opening 370. When the movable wall 324 is in the second position, the user or consumer may apply or exert a force on the movable wall 324 in the second position to move the flip-top lid 322 upward from the closed configuration to the open configuration.

As mentioned, as the movable wall 324 is moved from a first position to a second position, the breakable members 325 typically break upon the application of sufficient pressure on the movable wall 324 or in some configurations, the breakable members 325 themselves. In use, the pressure applied by a user, or some other object, to the movable wall 324 may rotate or hinge the movable wall 324 relative to the remainder of the lid from the first position towards the second position. When movable wall 324 is moving from the first position to the second position, in some configurations, the extension tab 385 remains relatively securely attached to the base 320 via the latching projection 382. (In this manner, no small pieces of the lid (such as small plastic bits) are separated from a remainder of the lid such that the entire lid remains intact and can be recycles together.) Further, the movement of the movable wall may separate, sever, or break the breakable members 325 but retain the connection between the portions of the breakable members and a remainder of the lid. For example, the breakable members 325 may break or separate into at least one of a first piece and a second piece such that the first piece and second piece may remain secured to portions of the closure cap 318.

By some approaches, then the moveable wall 324 is in the second position, the moveable wall 324 is secured or retained relative to the closure cap 318. In one illustrative embodiment, the movable wall 324 is secured or retained via a hinge 367 at a first end 327 of the movable wall 324 that permits the movable wall 324 to rotate relative to a remainder of the lid but does not completely detach the movable wall 324 therefrom. In some alternative embodiments, the movable wall 324 may be secured to the closure cap via a flexible material at the first end of the movable wall which allows the movable wall 324 to pivot or by a capture mechanism that prevents the movable wall from completely separating therefrom. For example, the upper end 327 of the movable wall 324 may connect to the flip-top lid 322 via the hinge 367.

Referring FIGS. 22-23, the hinge 367 permits the movable wall 324 to hinge or rotate inward into the recess 370. When the movable wall 324 is moved from the first position to the second position, a user may visually and/or tactilely observe the movement and/or the position of the movable wall 324. In this manner, the moveable wall 324 may operate as a visual and/or tactile tamper evident closure or structure indicator. Furthermore, in some configurations, a user may be able to additionally visually, audibly, and/or tactilely observe the breaking of the breakable members 325, allowing for an additional or separate tamper evident indicator for consumers. FIG. 22 illustrates that the hinge may extend over a portion of the upper edge 327 of the movable wall 324. FIG. 22 illustrates that the central portion of the upper edge 327 of the movable wall 324 has the hinge 367 adjacent thereto, but the peripheral portions of the supper edge 327 of the movable wall 324 may not be connected to the flip-top lid 322 via the hinge 367.

In some embodiments, the flip-top lid may include a retention flange 392 (FIG. 23) extending from the inset wall of the flip-top lid 322 into the recess 370 to inhibit the movable wall 324 from moving relative to a remainder of the closure cap 318 and returning at least partially to the first position. By one approach, the movable wall 324 is configured to be pivoted or hinged into the recess 370 until the lower end 329 of the movable wall 324 passes over the retention flange 392. In these embodiments, in the second position, the movable wall 324 is securely stored such that the retention flange 392 inhibits the movable wall 324 from returning to the first position or otherwise moving relative to the remainder of the closure cap 318. As shown in FIG. 23 the retention flange 392 may catch or otherwise securely retain a portion of the movable wall 324. This may be accomplished through the use of friction between the moveable panel or wall 324 and the retention structure 392, or through a latching mechanism.

Figure 24:
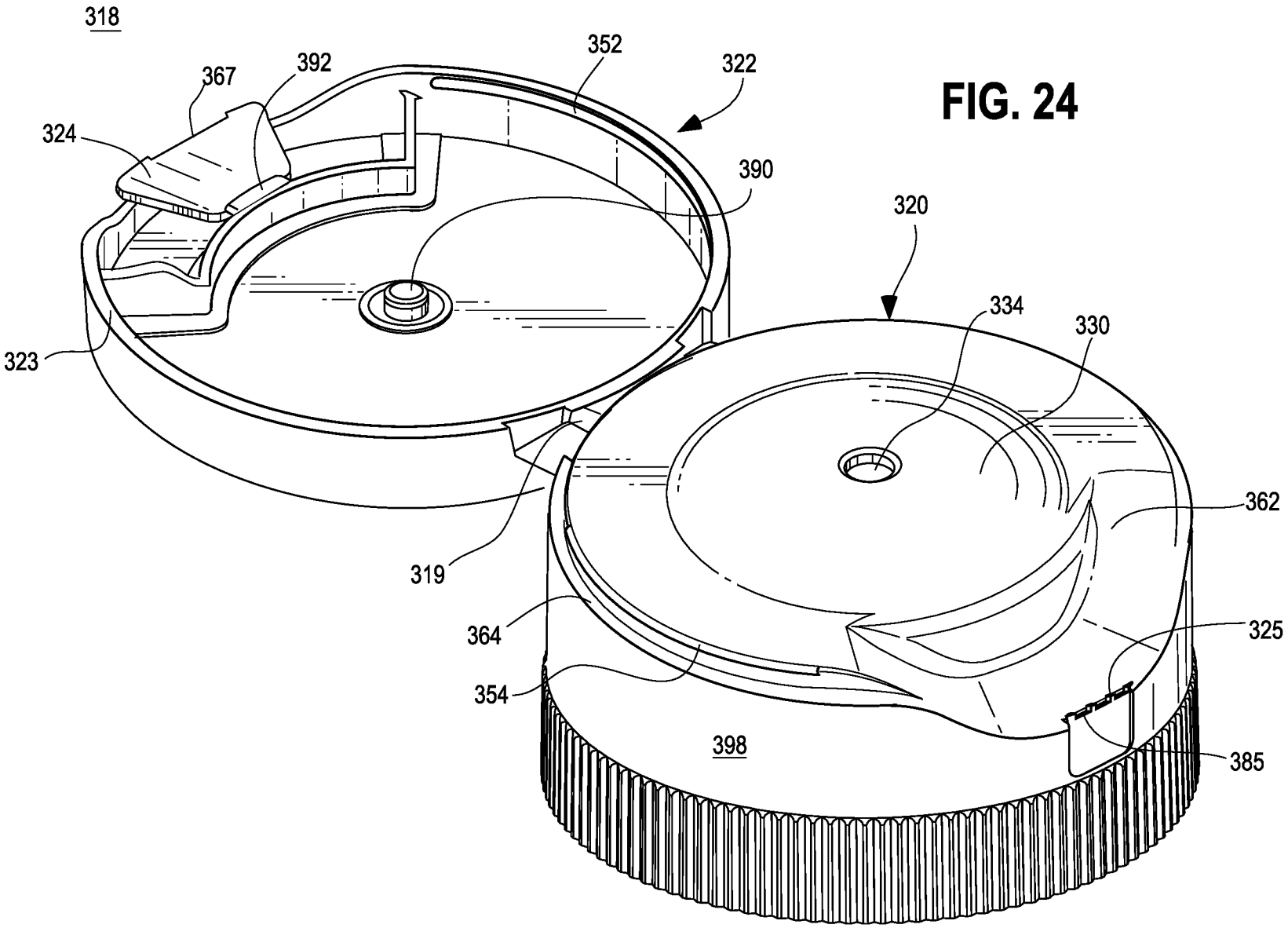
FIG. 24 is a perspective view of the closure cap of FIG. 18 in a subsequently open configuration in accordance with some embodiments.

FIG. 24 is a perspective view of the closure cap of FIG. 18 in a subsequently open configuration (i.e., after an initial opening) in accordance with some embodiments. In use, after the initial closing and subsequent opening, the flip-top lid 322 may be easily moved from the closed position (FIG. 22) to the open position (FIG. 24).

Once the movable wall 324 has been pressed inward (as discussed herein), the user or consumer may apply a force to the flip-top lid 322 in a direction substantially away from the base 320. The movement of the flip-top lid 322 away from the base 320 may rotate or pivot the flip-top lid 322 about a hinge 319. By one approach, an upward force may be applied by engaging an upper surface of the mouth-shaped opening or recess 370. By another approach, a user may pull upward on the upper surface of the recess 370 pulling the upper surface of the recess 370 away from the base 320. The flip-top lid 322 may pivot about the hinge 319 which may be substantially opposite the mouth-shaped opening or recess 370.

When the flip-top lid 322 is in the open configuration (FIG. 24), a projection 390 of the flip-top lid 322 is moved from obstructing or blocking the opening 334 in the base 320 to a position away from the opening 334, such that the opening 334 is unobstructed, and the fluid 5 in the bottle 10 may exit therethrough when the associate bottle is placed in the dispensing configuration.

Referring to FIG. 24, in some embodiments, when the flip-top lid is in the open position after the initial opening, the moveable wall may be securely retained within the closure cap 318 via the hinged connection 367 and the retention flange 392. As shown in FIG. 24, the retention flange 392 of the flip-top lid 322 may help prevent from the movable wall 324 from moving from the second position to the first position even when the flip-top lid is moved to the open position.

Referring to FIG. 24, when the flip-top lid is in the open position after the initial opening, the extension tab 385 may be securely retained with or secured to the base 320 of the closure cap 318 via the engagement of the latching projection with the receiving opening in the side surface of the base.

According to this disclosure, it is possible to provide a closure cap having a tamper evident feature/structure which minimizes or eliminates small pieces that might be detached or separated from the closure cap. Accordingly, the present disclosure may provide a closure cap having a tamper evident feature that facilitates recycling even the small pieces of the material in the closure cap.

In some embodiments, a closure cap includes a base, a flip-top lid hingedly connected to the base, the flip-top lid being movable between an open position and a closed position, the flip-top lid and the base together forming a recess in an outer wall of the closure cap when the flip-top lid is in the closed position, the recess forming a grasping area where a user applies a force to move the flip-top lid from the closed position to the open position. In addition, the closure cap may include a movable wall being attached to one of the base and the flip-top lid. By some approaches, the movable wall may be rotational from a first position where the movable wall is substantially continuous with an adjacent sidewall of the closure cap to a second position where one edge of the movable wall disposed inward into the recess. The closure cap may further include an extension tab extending from the movable wall and fixedly attached to one of the base or the flip-top lid. The closure cap may further include a breakable member disposed between the extension tab and the movable wall. By some approaches, the breakable member is configured to break upon the movable wall being rotatably moved from the first position toward the second position.

In some embodiments, a method of opening a closure cap includes forming, molding, or providing a closure cap including a base and a flip-top lid hingedly connected to the base, the base and the flip-top lid forming a recess permitting a force to be applied to the flip-top lid to move the flip-top lid from a closed position to an open position. The method of opening the closure cap may include pivoting a movable wall covering an opening to the recess to uncover the opening to the recess, and applying a force to a portion of the flip-top lid at the recess to move the flip-top lid about the hinged connection to the base to the open position.

In some embodiments, a dispensing bottle includes a container body with a thixotropic fluid therein, the container body having a neck with threads thereon, and a closure cap coupled to the container body. In one approach, the closure cap includes a base, a flip-top lid hingedly connected to the base, the flip-top lid being movable between an open position and a closed position, the flip-top lid and the base together forming a recess in an outer wall of the closure cap when the flip-top lid is in the closed position, the recess forming a grasping area where a user applies a force to move the flip-top lid from the closed position to the open position. The closure cap may include a movable wall being attached to one of the base and the flip-top lid, the movable wall being rotational from a first position where the movable wall is substantially continuous with an adjacent sidewall of the closure cap to a second position where one edge of the movable wall disposed inward into the recess. The closure cap may include an extension tab extending from the movable wall and fixedly attached to one of the base or the flip-top lid. By some configuration, the closure cap may include a breakable member disposed between the extension tab and the movable wall, wherein the breakable member is configured to break upon the movable wall being rotatably moved from the first position toward the second position.

In some embodiments, a method of manufacturing a filled dispensing bottle includes molding a receptacle having neck threads thereon, filling the receptacle with a thixotropic fluid, providing a closure cap. The closure cap may include a base, a flip-top lid hingedly connected to the base, the flip-top lid being movable between an open position and a closed position, the flip-top lid and the base together forming a recess in an outer wall of the closure cap when the flip-top lid is in the closed position, the recess forming a grasping area where a user applies a force to move the flip-top lid from the closed position to the open position, a movable wall being attached to one of the base and the flip-top lid, the movable wall being rotational from a first position where the movable wall is substantially continuous with an adjacent sidewall of the closure cap to a second position where one edge of the movable wall disposed inward into the recess, an extension tab extending from the movable wall and fixedly attached to one of the base or the flip-top lid, and a breakable member disposed between the extension tab and the movable wall, wherein the breakable member is configured to break upon the movable wall being rotatably moved from the first position toward the second position, and closing the filled receptacle with the closure cap.

Figure 25:
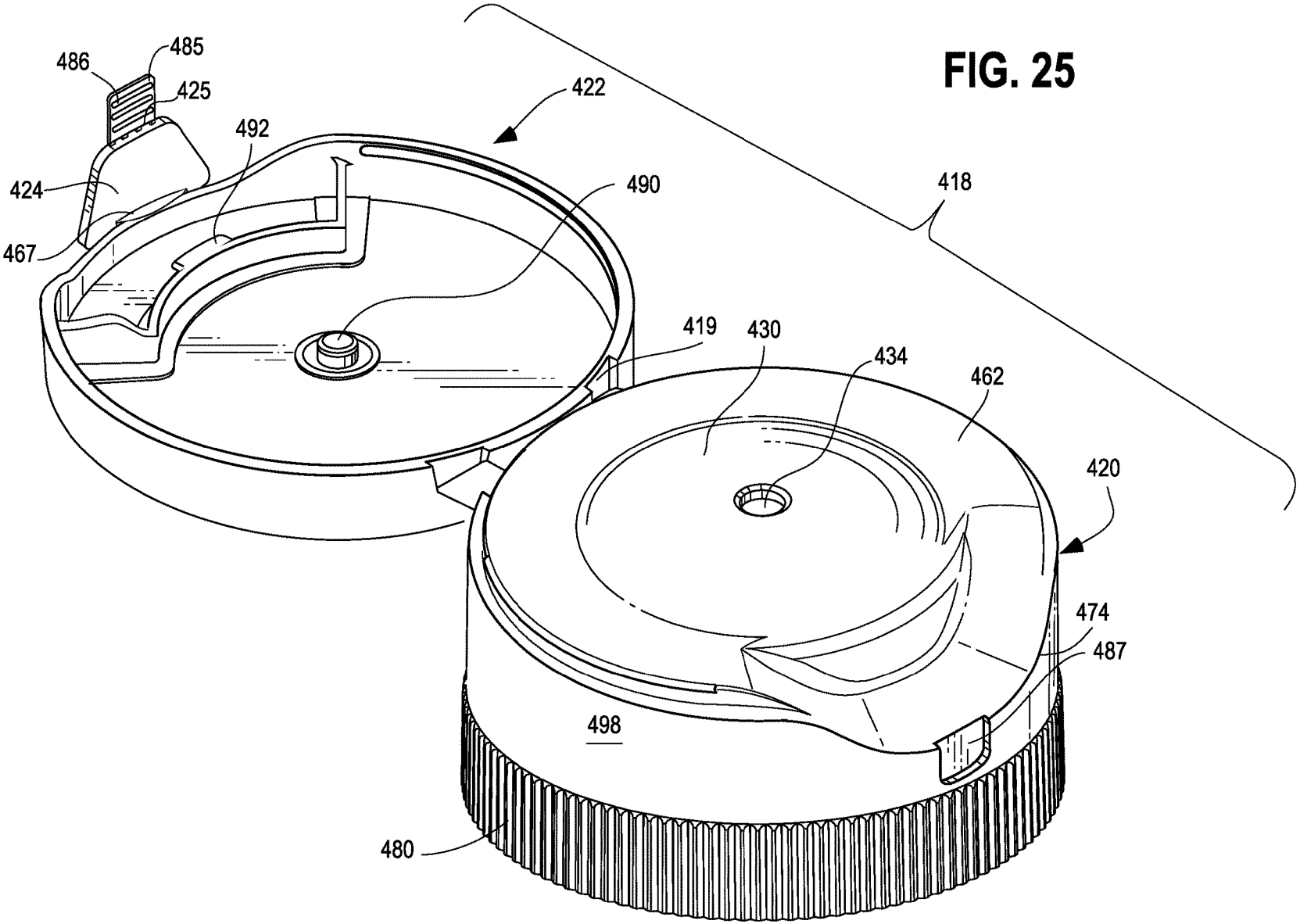
FIG. 25 is a perspective view of another embodiment of a closure cap in an initial open configuration in accordance with some embodiments.

FIGS. 25-28 illustrate another embodiment of a closure cap 418. FIG. 25 is a perspective view of the closure cap 418 in an initial open configuration in accordance with some embodiments.

While the closure cap 318 in the previous embodiment includes the latching projection 382 to fixedly attach the extension tab 385 to the base 320, the closure cap 418 of FIGS. 25-28 include a welded connection to fixedly attach the extension tab 485 to the base 420.

Referring to FIG. 25, the base 420 has a similar structure to the base 320 in the previous embodiment except that the base 420 typically does not include the receiving opening. The base 420 may still have the intended portion on the sidewall 498 of the base 420 to dispose at least a portion of the extension tab 485. The flip-top lid 422, the movable wall 424, the hinge 467, and the breakable member 425 are similar to those of closure cap 318 previously described. While the extension tab 385 in the previous embodiment includes the latching projection 382 extending from the flange 383 of the extension tab 385, the extension tab 485 of the current embodiment according to FIG. 25 may include a welding ridge 486. The welding ridge 486 may be disposed on the inner surface of the extension tab 485. The inner surface of the extension tab is the surface to be attached to the indented portion of the base after the initial closing of the closure cap. The welding ridge 486 may consist of any materials which may be melted at high temperatures and hardened at low temperatures such that can make a connection between two points. In some embodiments, the entire extension tab 485 may be made of the same material as the welding ridge 486. In this embodiment, in the initial open configuration, the movable wall 424 may be substantially continuous from with an adjacent sidewall of the flip-top lid 422.

Figure 26A:
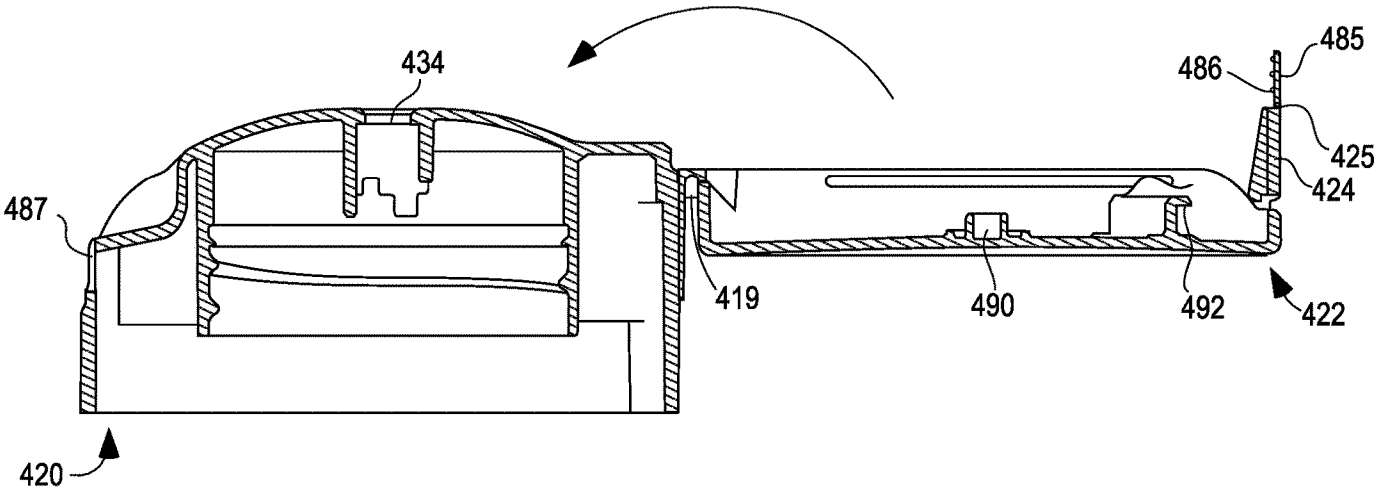
FIGS. 26A-26B are cross sectional views illustrating a manufacturing configuration, a closing configuration, and an initially closed configuration of the closure cap of FIG. 25 in accordance with some embodiments.
Figure 26B:
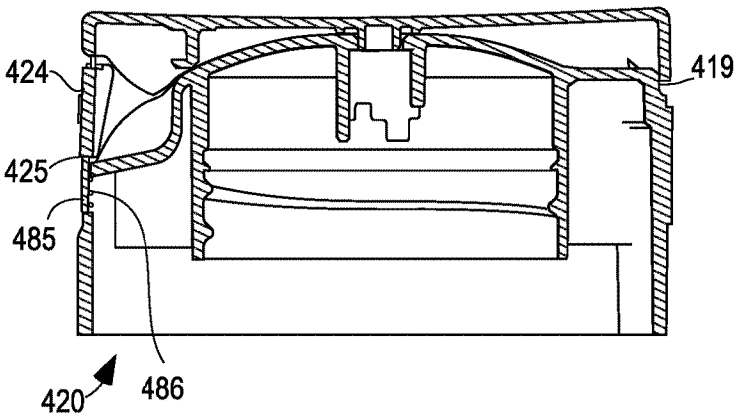

FIGS. 26A and 26B are cross sectional views illustrating a manufacturing flow of the closure cap 418 from the initial open configuration to the initial closed configuration in accordance with some embodiments. Referring to FIG. 26A, the method of manufacturing a closure cap 418 includes forming a molded closure cap in the initial open configuration as shown in FIG. 25. For example, the closure cap 418 is created in a forming mold in this initial open configuration and, after molding, is ejected from the forming mold in this configuration. As mentioned, in the initial open configuration, referring to FIG. 26A, the movable wall 424 is substantially continuous with and in alignment with an adjacent sidewall of the flip-top lid 422. The molded extension tab 485 may include the welding ridge 486 on the inner surface of the extension tab 485. In some embodiments, the molded extension tab may include more than one welding ridge 486.

Referring to FIGS. 26A and 26B, the method of manufacturing a closure cap 418 may include moving the flip-top lid 422 from the initial open position (FIG. 26A) to the initial closed position (FIG. 26B). When the flip-top lid is moved to the closed position, the movable wall 424 may cover at least a portion of the opening of the recess 470 and the extension tab 485 may be disposed on the indented portion 487. In FIG. 26 B, the extension tab is disposed adjacent the base 420. To form the fixed connection between the extension tab and the base, the welding ridge 486 may be welded. The welding process may be conducted by applying enough heat to the welding ridge 486 such that the welding ridge 486 may be melted. After removing the applied heat, the melted welding ridge hardens and then forms a welded connection 486' which fixedly attaches the extension tab 485 to the base 420.

For example, to heat the welding ridge 486, a hot tool such as a hot stamp or heat stamp may be applied to the portion of the extension tab 485 where the welding ridge 486 is disposed.

In some embodiments, the ultrasonic welding process may be used. The ultrasonic welding process may apply ultrasonic waves to the welding ridge 486 to form the welded connection 486'. The ultrasonic welding process may occur indirect heat to the targeted welded portion by converting electrical signals to ultrasonic waves.

In the initial closed configuration, the perspective view of the closure cap 418 may be the same as the perspective view of the closure cap 318 in FIG. 18 previously described.

Figure 27:
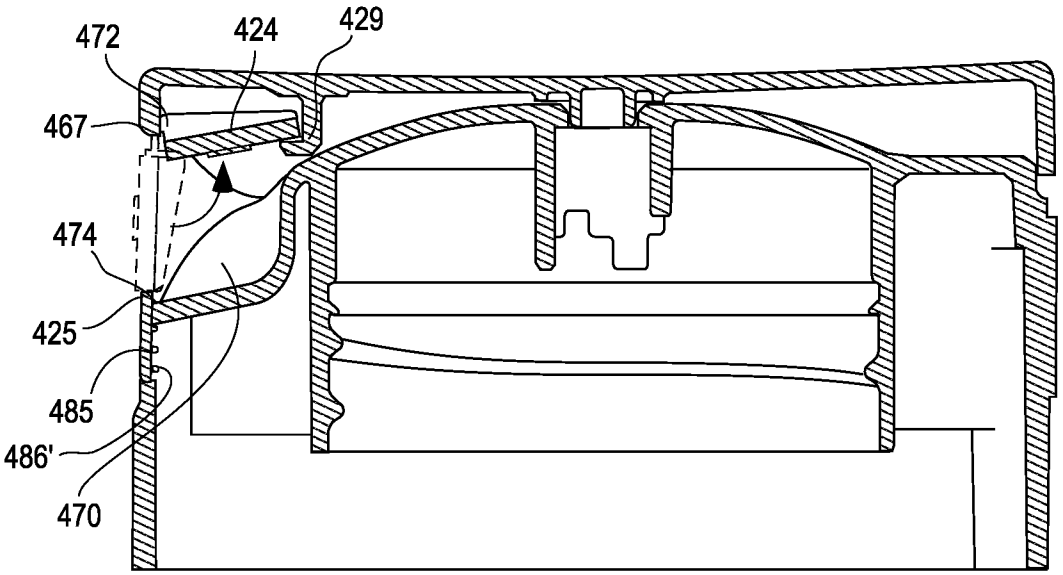
FIG. 27 is a cross sectional view of the closure cap of FIG. 25 wherein a movable wall is in a second position in accordance with some embodiments.

FIG. 27 is a cross sectional view of the closure cap 418 wherein the movable wall 424 is in a second position in accordance with some embodiments. After the initial closing, the movable wall 424 may be moved from the first position (FIG. 26B) where the movable wall is substantially aligned with a sidewall of closure cap to the second position (FIG. 27) where the lower edge of the movable wall is pushed inward from the sidewall of the closure cap. When the movable wall 424 is moving from the first position to the second position, the extension tab 485 typically remains securely attached to the base 420 via the welded connection 486'. The movement of the movable wall 424 from the first position to the second position may separate, sever, or break the breakable members 425.

Figure 28:
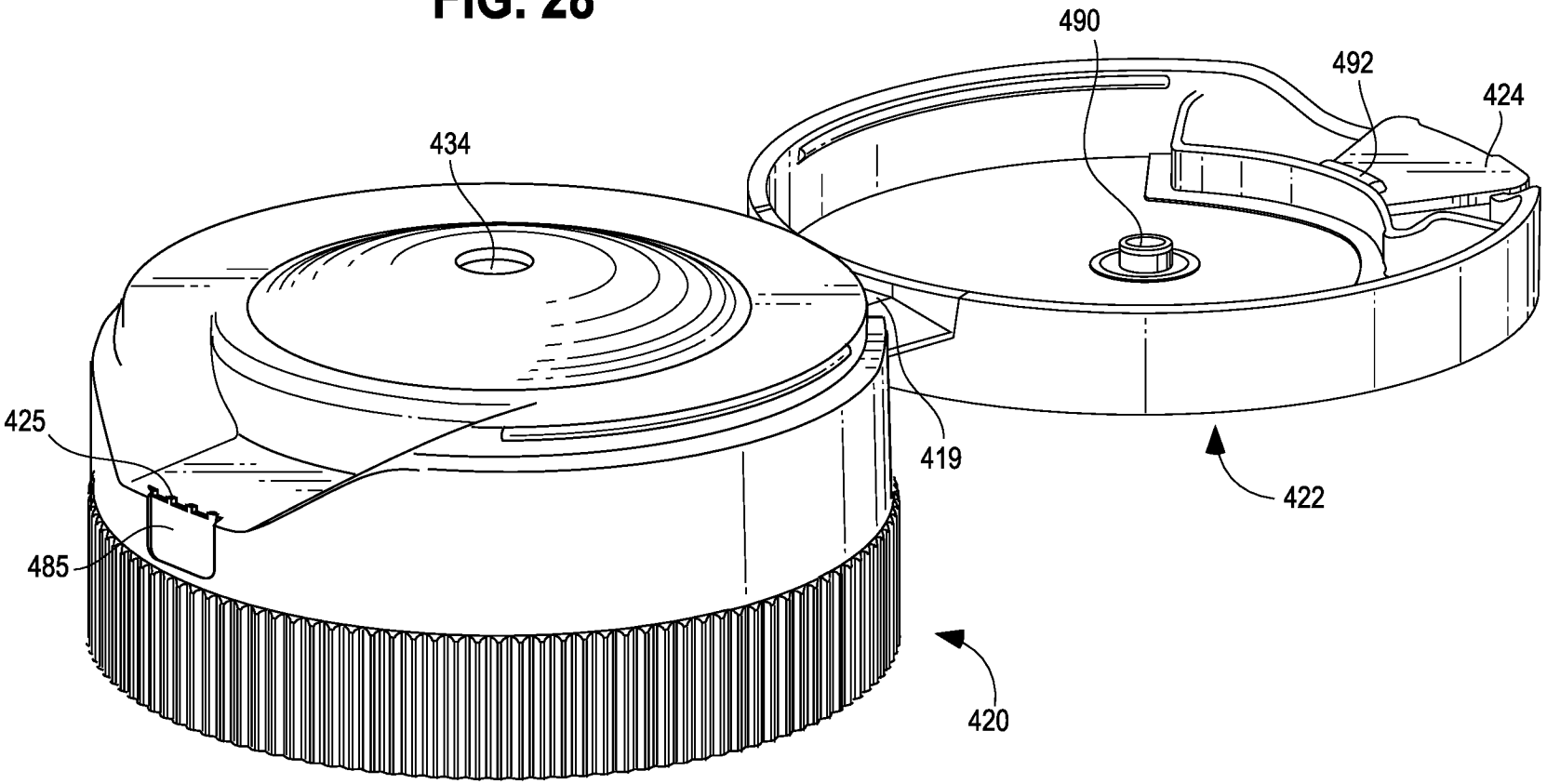
FIG. 28 is a perspective view of the closure cap of FIG. 25 in a subsequently open configuration in accordance with some embodiments.

FIG. 28 is a perspective view of the closure cap 418 in a subsequently open configuration (i.e., after an initial opening) in accordance with some embodiments. In use, after the initial closing and subsequent opening, the flip-top lid 422 may be moved from the closed position to the open position after the movable wall 424 has been moved from the first position to the second position as shown in FIG. 28. In the subsequently open configuration, the extension tab typically remains fixedly attached to the base and the movable wall may be securely retained with the second position via a hinged connection 467 and a retention flange 492.

Figures 29, 29A:
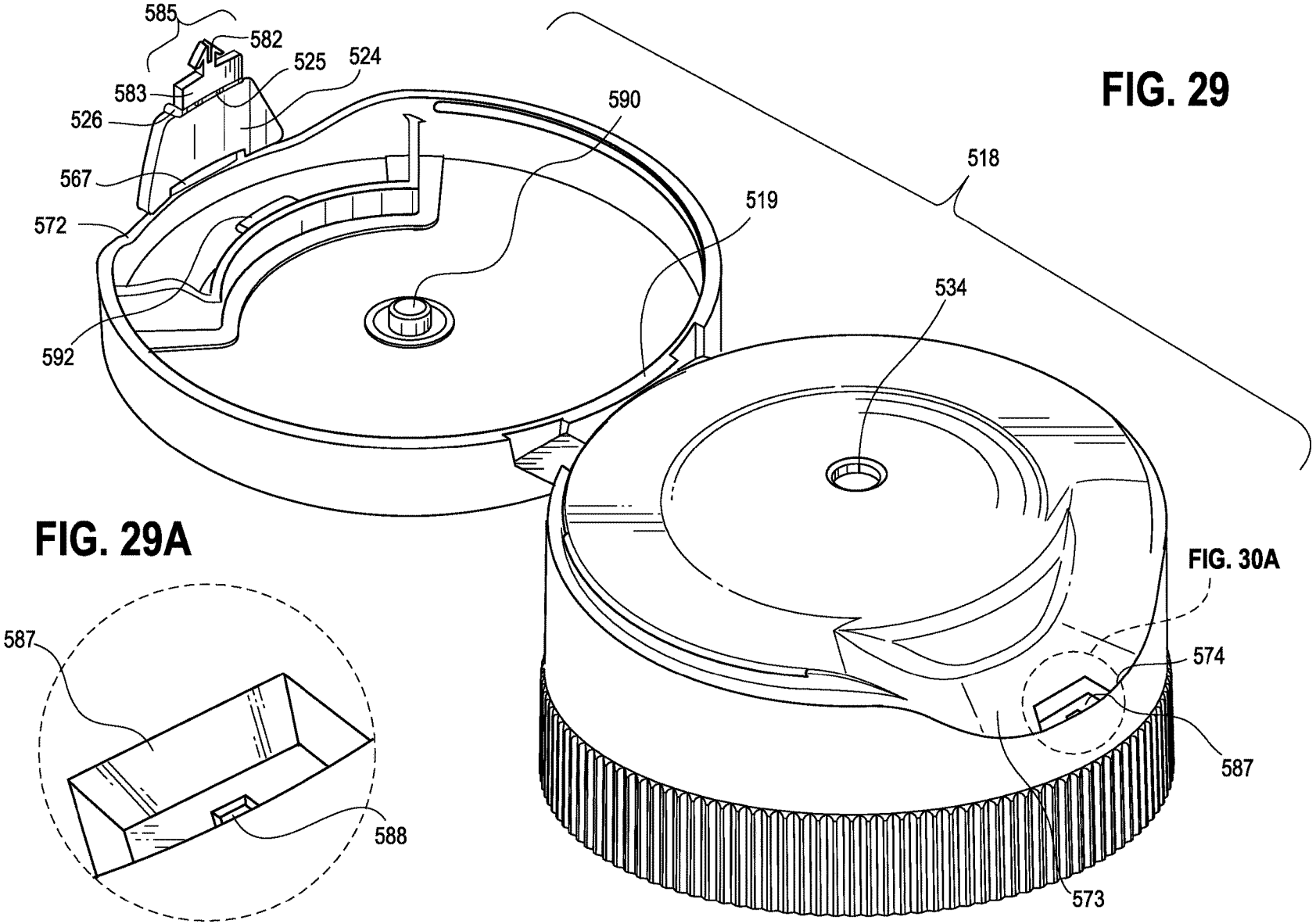
FIG. 29 is a perspective view of another embodiment of a closure cap in an initial open configuration in accordance with some embodiments.
FIG. 29A is a partial detail view of portion 30A of FIG. 29.

FIGS. 29-35 illustrates another embodiment of the closure cap 518 in accordance with some embodiments. FIG. 29 is a perspective view of a closure cap 518 in an initial open configuration in accordance with some embodiments. Referring to FIG. 29, in some embodiments, a base 520 may have an indented portion 587 on the recess forming surface 573. The base 520 may further have a receiving opening 588 on the bottom surface of the indented portion 587. The indented portion may be adjacent to the sidewall of the base in the recess forming surface. In some embodiments, the indented portion may be close to the opening of the recess. Indeed, in one illustrative approach, the indented portion is disposed on the recess forming surface of the base near the middle of the lower edge 574 of the recess. In some embodiments, the width and/or length of the receiving opening 588 is smaller than the width and/or length of the indented portion 587.

In some embodiments, in the initial open configuration, an extension tab 585 extends from a movable wall 524 and connects to the movable wall 524 via a breakable member 525. By some approaches, the extension tab 585 is disposed at a slightly retracted position from the movable wall 524. The extension tab 585 may include a flange 583 extending from the movable wall 524 and a latching projection 582 extending from the flange 583. In some embodiments, the thickness of the flange 583 may be slightly thinner than the thickness of the movable wall.

In some embodiments, referring to FIG. 29, the latching projection 582 may extend from the flange 583 in a substantially similar direction in which the flange 583 extends from the movable wall. For example, the latching projection 582 may be substantially parallel to the extension tab. In some embodiments, the thickness of the latching projection 582 may be thinner than the thickness of the flange 583. By some approaches, the latching projection 582 comprises and elongated portion and the leading portion. The leading portion may comprise a pair of hooks, where each end of the hooks extends outwardly away from one another.

Figure 30A:
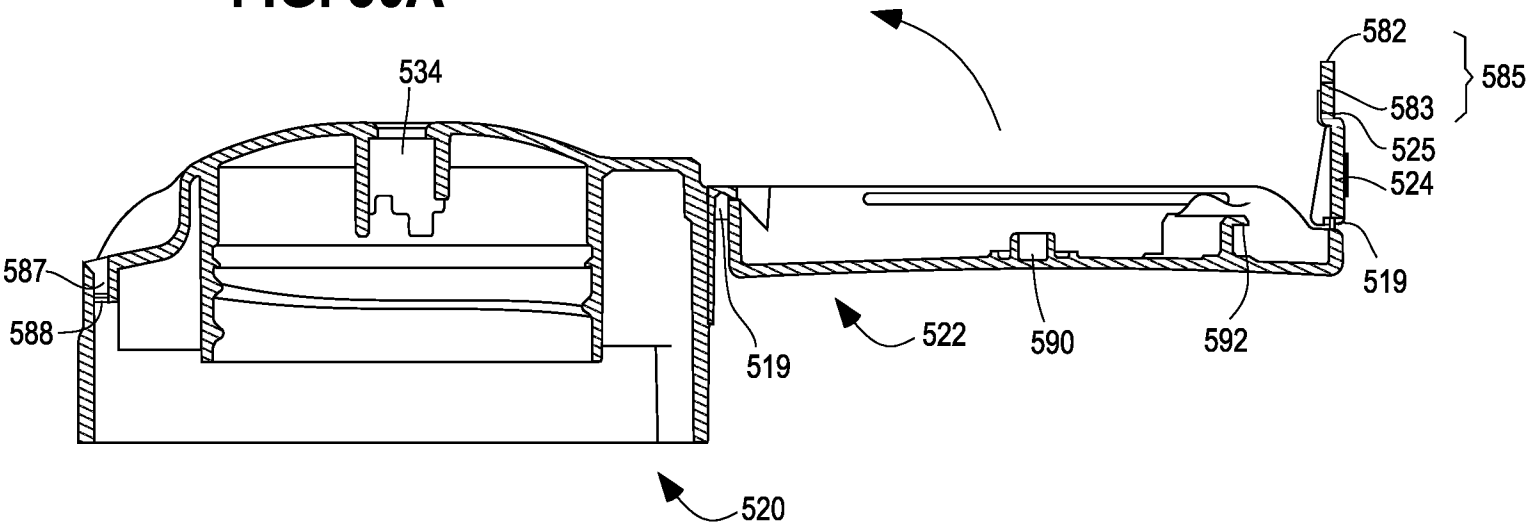
FIGS. 30A-30B are cross sectional views illustrating a manufacturing configuration and an initially closed configuration of the closure cap of the FIG. 29 in accordance with some embodiments.
Figure 30B:
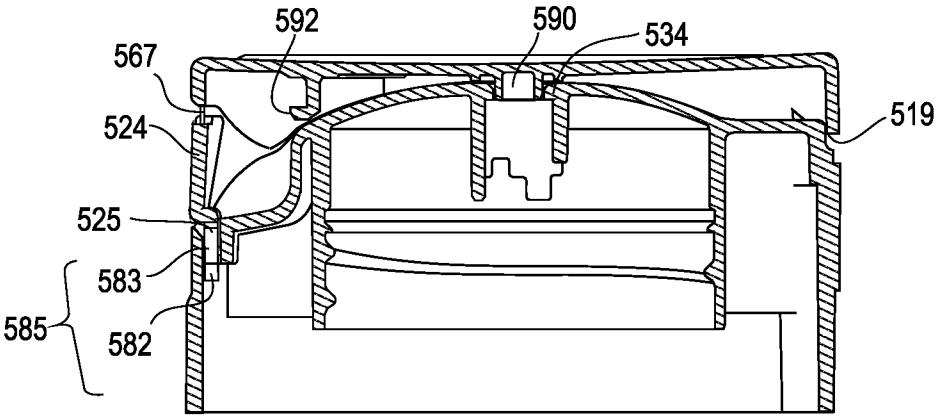

FIGS. 30A and 30B are cross sectional views of the closure cap 518 illustrating a manufacturing flow of the closure cap 518 from the initial open configuration to the initial closed configuration in accordance with some embodiments. Referring FIG. 30A, the method of manufacturing the closure cap 518 may include forming a molded closure cap in the initial open configuration as shown in FIG. 29. Referring to FIGS. 30A and 30B, the method of manufacturing the closure cap 518 may include moving the flip-top lid 522 from the initial open position (FIG. 30A) to the initial closed position (FIG. 30B). When the flip-top lid is moved from the open position to the closed position, the extension tab and the breakable member move along with the movement of the flip-top lid. When the flip-top lid has been moved to the closed position, the flange 583 of the extension tab 585 may be disposed on the intended portion 587. The indented portion 587 is deployed in the location where the indented portion 587 may receive the flange 583 of the extension tab 585 when the flip-top lid 522 has been moved to the closed position.

When the flip-top lid is moved to the closed position, the latching projection 582 of the extension tab 585 may be inserted through the receiving opening 588 in the indented portion 587. The receiving opening may be deployed in a location where the latching projection may be inserted into the base 520 by passing through the receiving opening 588. When the flip-top lid is moved to the closed position, the latching projection snaps into the base through the receiving opening such that the extension tab may be fixedly attached to the base.

Figure 31:
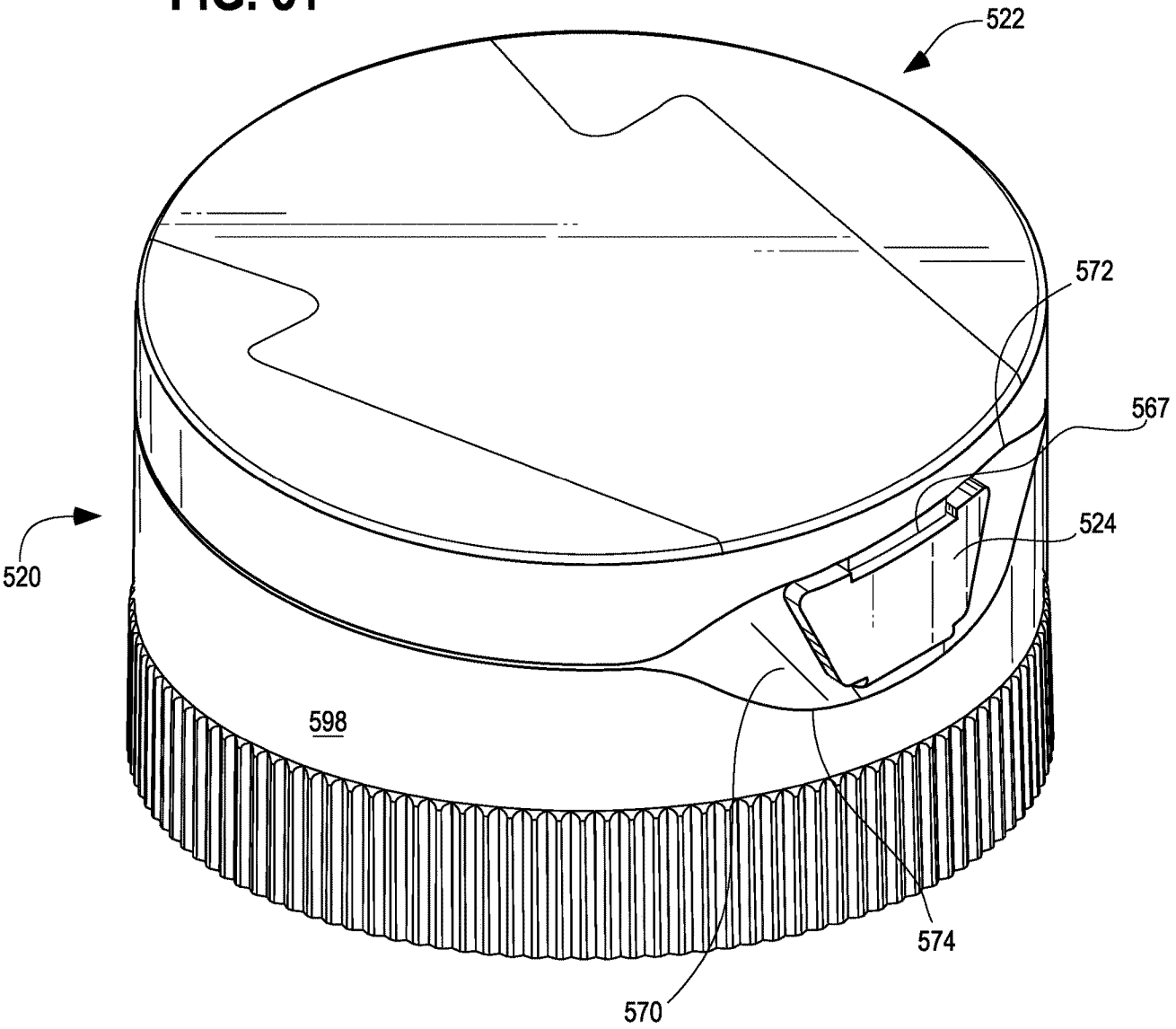
FIG. 31 is a perspective view of the closure cap of FIG. 29 in an initial closed configuration in accordance with some embodiments.

FIG. 31 is a perspective view of a closure cap 518 in an initial closed configuration in accordance with some embodiments. When the flip-top lid 520 has been moved to the closed position, the movable wall 524 may cover at least a portion of the opening of the recess 570. In the initial closed configuration, the breakable member may be disposed near the indented portion. In some embodiments, the breakable member may be disposed above the indented portion such that the breakable member 525 may cover a portion of the opening of the recess 570 in the initial closed configuration. In some embodiments, a portion of or the entire breakable member may be disposed in the indented portion. In some embodiments, at least one of the length and the width of the indented portion is smaller than the length and width of the movable wall such that the movable wall may not be inserted into the indented portion.

Figure 32:
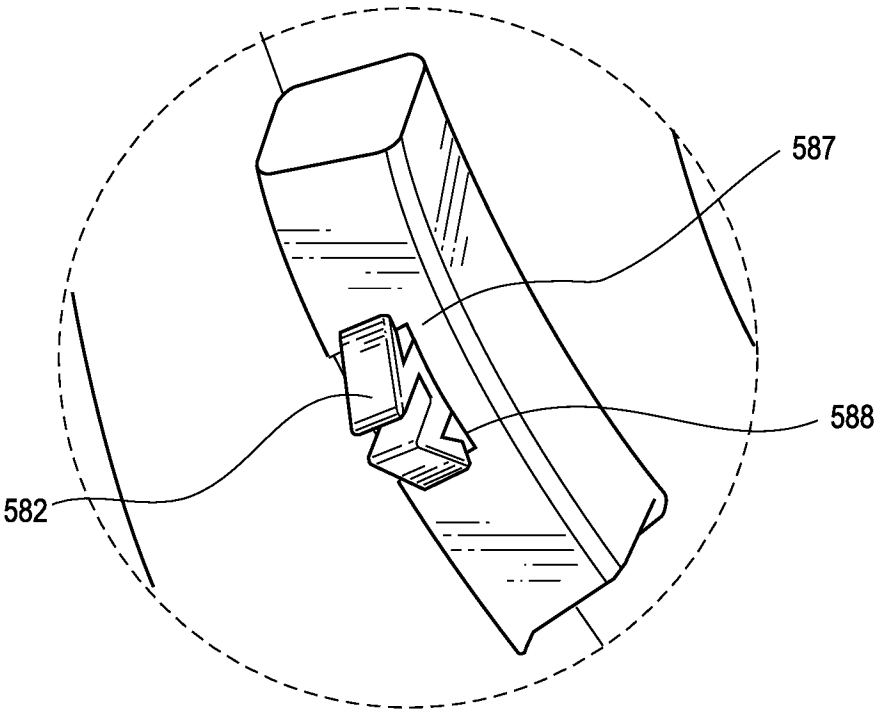
FIG. 32 is a partial perspective view of a latching projection of the closure cap of FIG. 29 in accordance with some embodiments.

FIG. 32 is a perspective view of a latching projection 582 inserted through the receiving opening 588 in accordance with some embodiments. As illustrated in FIG. 32, in some embodiments, the maximum width of the latching projection is greater than the width of the receiving opening such that the extension tab may be fixedly attached to the base by preventing the projection from being backed out or easily removed therefrom. The latching projection may have various shapes to snap into the base through the receiving opening and fix the extension tab to the base as described above or below.

Figure 33:
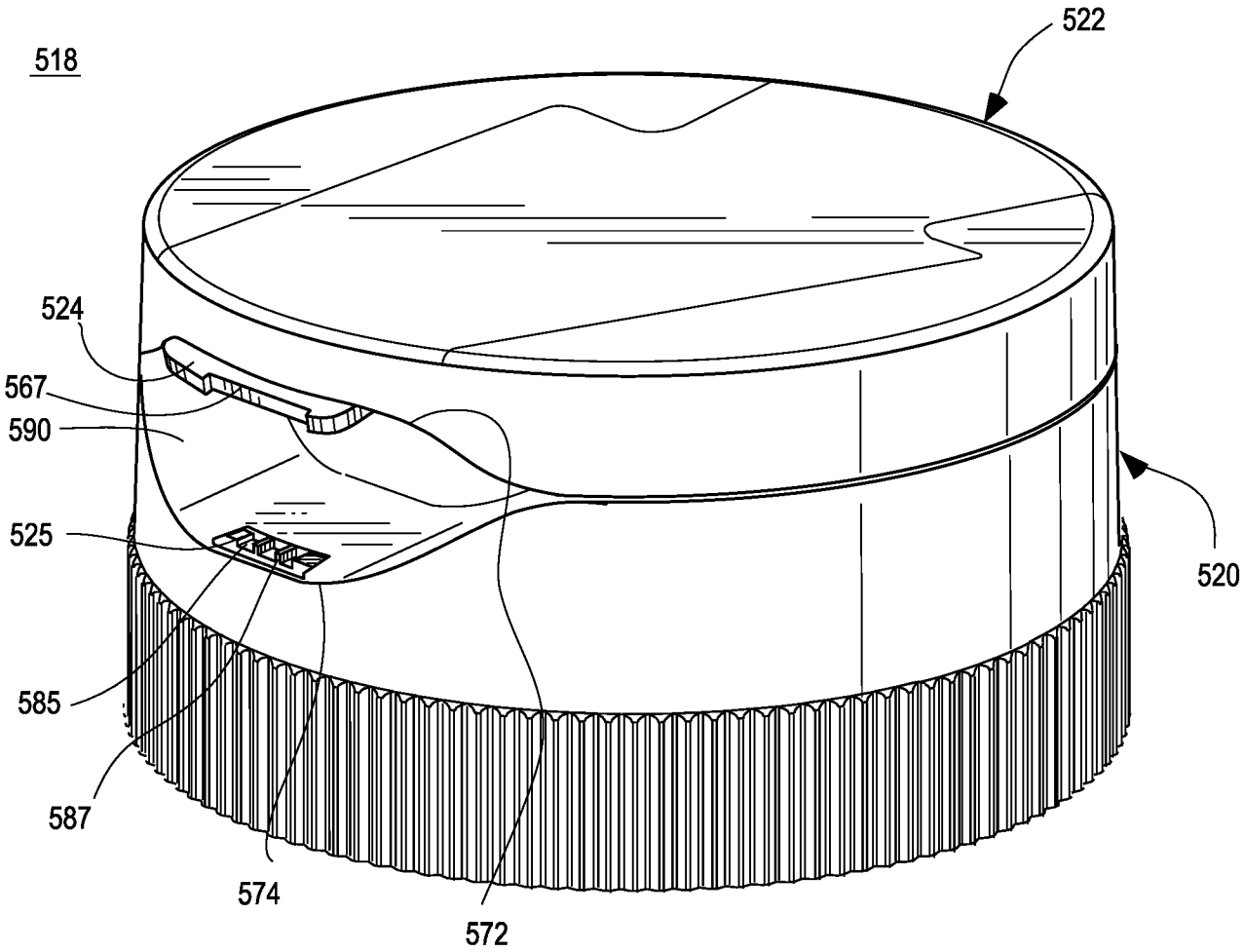
FIG. 33 is a perspective view of the closure cap of FIG. 29 wherein a movable wall is in the second position.
Figure 34:
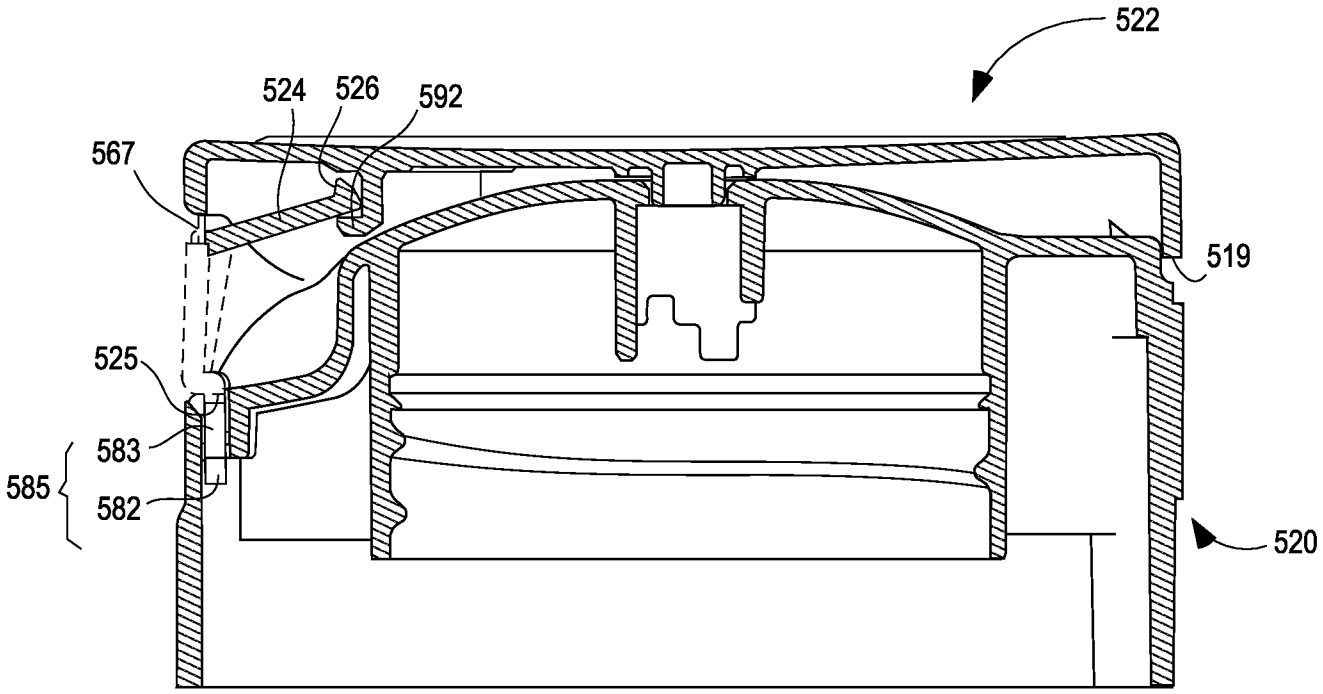
FIG. 34 is a cross sectional view of the closure cap of FIG. 33.

FIG. 33 is a perspective view of the closure cap 518 in the closed configuration wherein the movable wall is in the second position. As shown, the movable wall 524 has been separated from the extension tab 585 that remains disposed in the base 520. FIG. 34 is a cross sectional view of FIG. 33 of the same configuration. In some embodiments, the frangible or breakable member 525 is configured to break as the movable wall 524 is rotatably moved from the first position (FIG. 31) to the second position (FIG. 33). In some embodiments, after the movable wall 524 has been moved to the second position, the extension tab may be retained in the indented portion. Similar to the embodiments described above, the movable wall 524 may be securely retained in the second position by a retention flange 592 extended from the flip-top lid 522.

Figure 35:
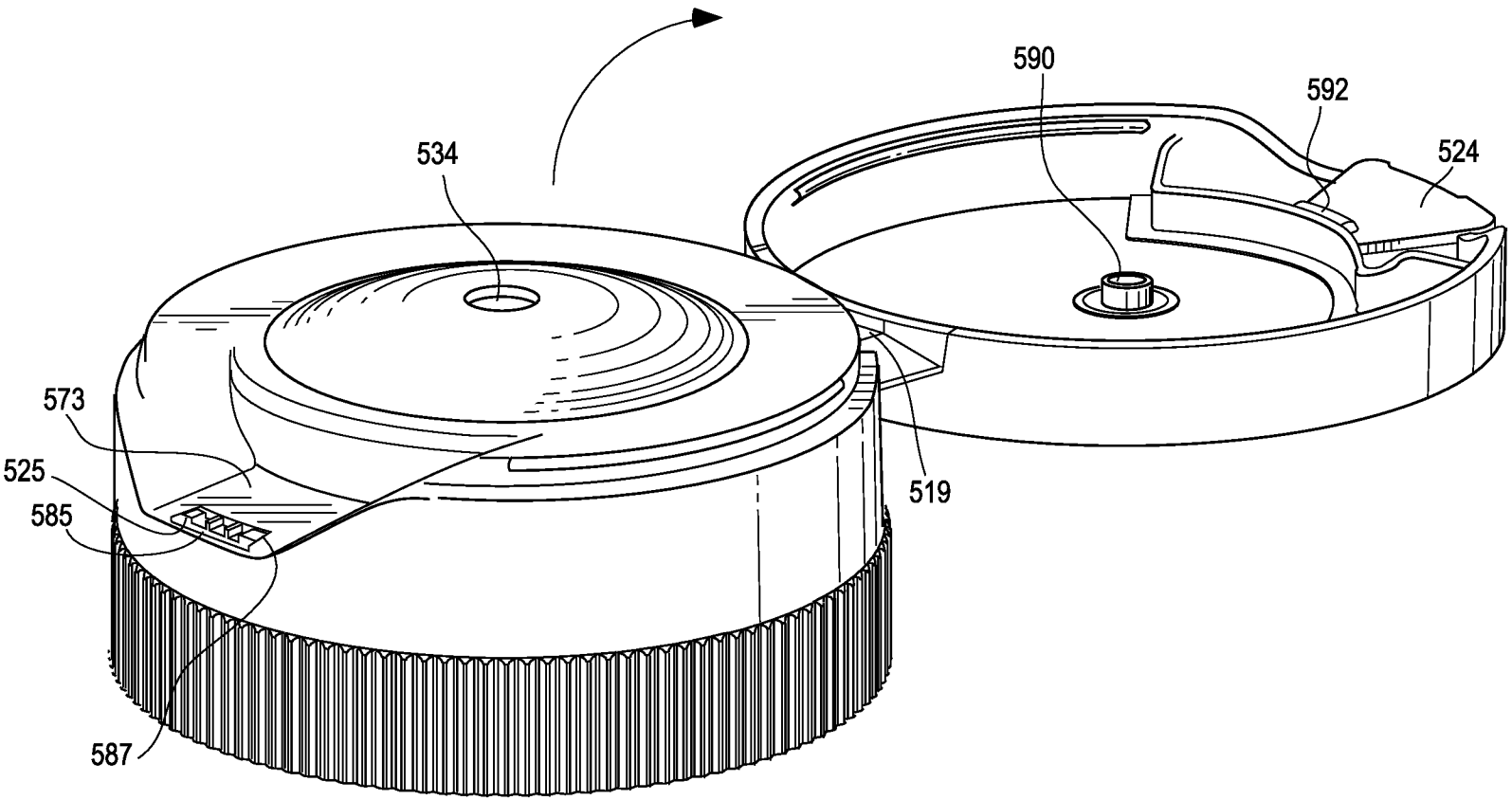
FIG. 35 is a perspective view of the closure cap of FIG. 29 in a subsequent open configuration in accordance with some embodiments.

FIG. 35 is a perspective view of the closure cap 518 in the subsequent open configuration in accordance with some embodiments, As shown in FIG. 35 after the flip-top lid is moved from the initial close configuration to the subsequent open configuration, the extension tab may be retained in the indented portion 587.

Figures 36, 36A:
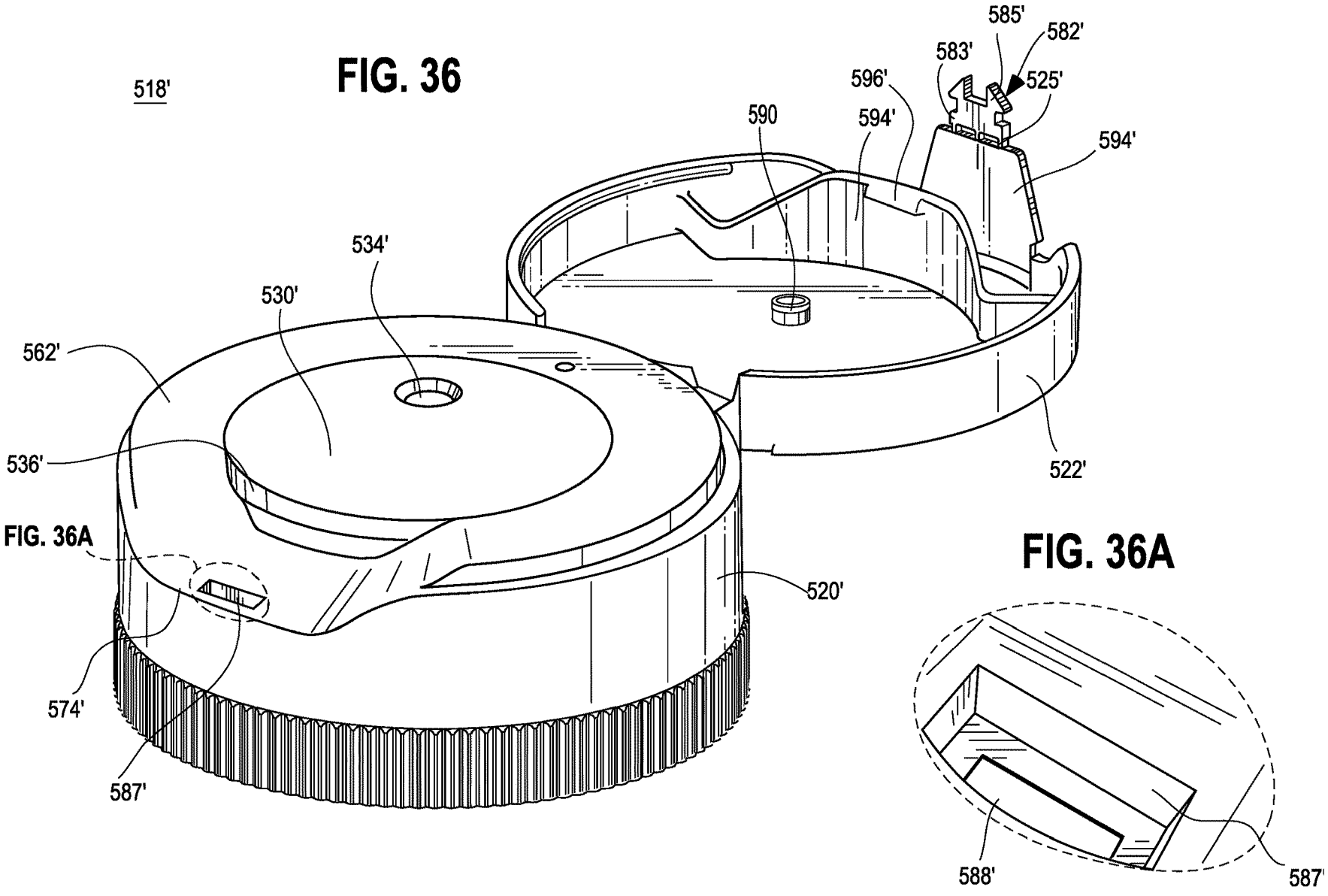
FIG. 36 is a perspective view of another embodiment of a closure cap in the initial open configuration in accordance with some embodiments.
FIG. 36A is a partial detail view of portion 26A of FIG. 36.
Figure 37:
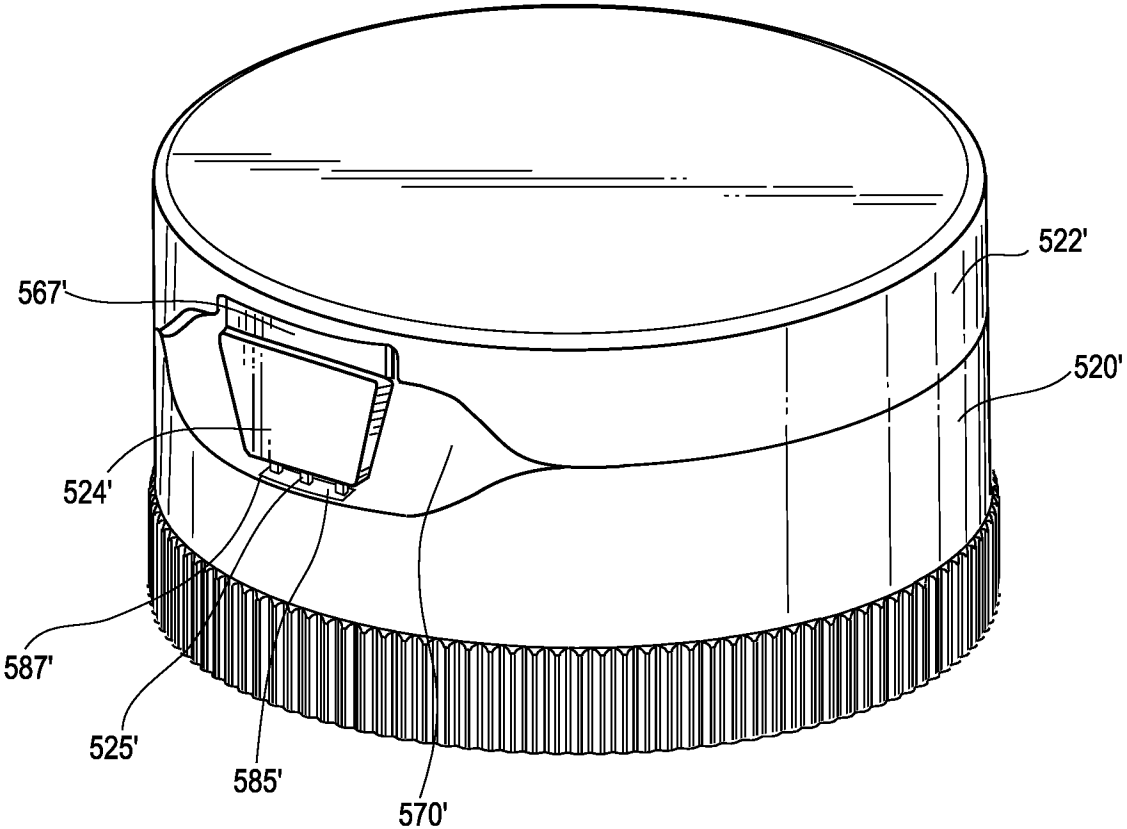
FIG. 37 is a perspective view of the closure cap of FIG. 36 in the initial closed configuration in accordance with some embodiments.
Figure 38:
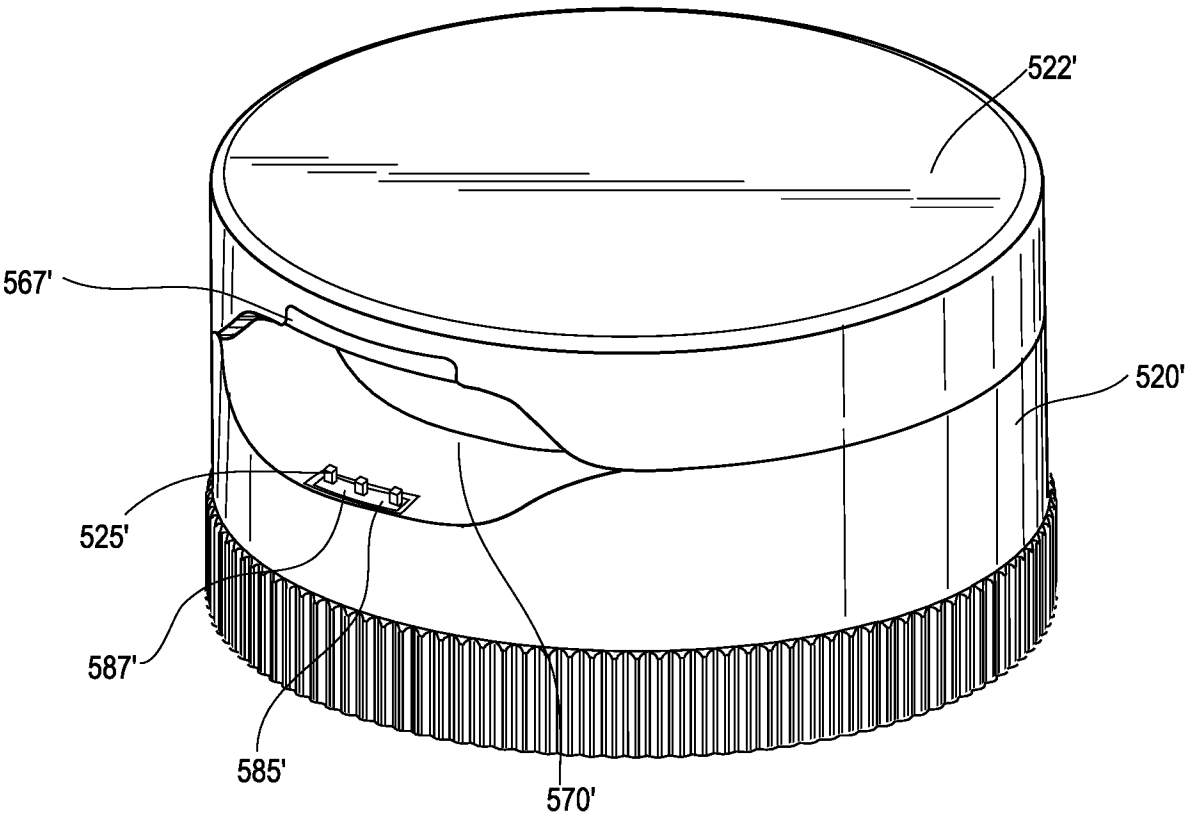
FIG. 38 is a perspective view of the closure cap of FIG. 25 36 in a closed configuration wherein a movable wall is in the second position.

FIGS. 36-38 illustrate another embodiment of the closure cap 518' in accordance with some embodiments. The embodiment illustrated in FIGS. 36-38 may be a variant of the closure cap 518 illustrated in FIGS. 29-35. FIG. 36 is a perspective view of the closure cap 518' in the initial open configuration in accordance with some embodiments. FIG. 37 is a perspective view of the closure cap 518' in the initial closed configuration in accordance with some embodiments. FIG. 38 is a perspective view of the closure cap 518' in the closed configuration wherein a movable wall (not shown) is in the second position.

The latching projection 582' in this embodiment may have a greater width than the latching projection 582 of the previous embodiment. Referring to FIG. 36, the width of the elongated portion of the latching projection 582 may be slightly narrower than the flange 583' and the maximum width of the leading portion comprising a pair of hooks may be the same or similar to the width of the flange 583'. The length of the receiving opening 588' in this embodiment (FIG. 36) is longer than the length of the receiving opening 588 in the previous embodiment (FIG. 29) corresponding to the shape of each latching projection of the embodiments. To increase the maximum width of the latching projection, the gap between the pair of hooks of the latching projection is typically increased. For example, the gap between the pair of hooks of the latching projection 582' may be wider or broader than the gap between the pair of hooks of the latching projection 582 of the previous embodiment (FIG. 29). In some embodiments, the size of the hooks itself may be bigger than the size of the hooks in the previous embodiments.

Referring to FIG. 36, in some embodiments, a base 520' may include a central portion 530' and a substantially planar portion 562'. The substantially planar portion 562' and the lower surface 574' forming the recess 570' may extend around the central portion 530'. In some embodiments, the sidewall of the central portion 530' disposed toward the recess may include a ledge 536' near the top surface of the central portion 530'. In some embodiments, a flip-top lid 522' may include an inset wall 594' and a flange 596' that extends from the inset wall 594'. When the flip-top lid is in the closed position, the flange 596' of the inset wall 594' may engage with the ledge 536' of the central portion 530' such that the flip-top lid may remain in the closed position unless a force to open the flip-top lid is applied, thereby helping secure the flip-top lid 522' in the closed position after the breakable member 525' has been separated.

The flip-top lid 522' may be moved from the open position (FIG. 36) to the closed position (FIG. 37). Similar to the previous embodiment of closure cap 518, when the flip-top lid 522' is moved from the open position to the closed position, the latching projection 582' may be inserted into the base 520' through the receiving opening 587' and when the flip-top lid 522' is in the closed position, the flange 583' of the extension tab 585' is disposed in the indented portion 585'. By this mechanism, the extension tab 585' may be fixedly attached to the base 520', even after the breakable member 525' has broken and the movable wall 524' is moved to the second position. Further, when the flip-top lid 522' is moved to the closed position, the flange 596' of the inset wall 594' may snap into under the ledge 536' such that the flange 596' of the inset wall 594' may be engaged with the ledge 536' of the central portion 530'.

Figures 39A, 39B:
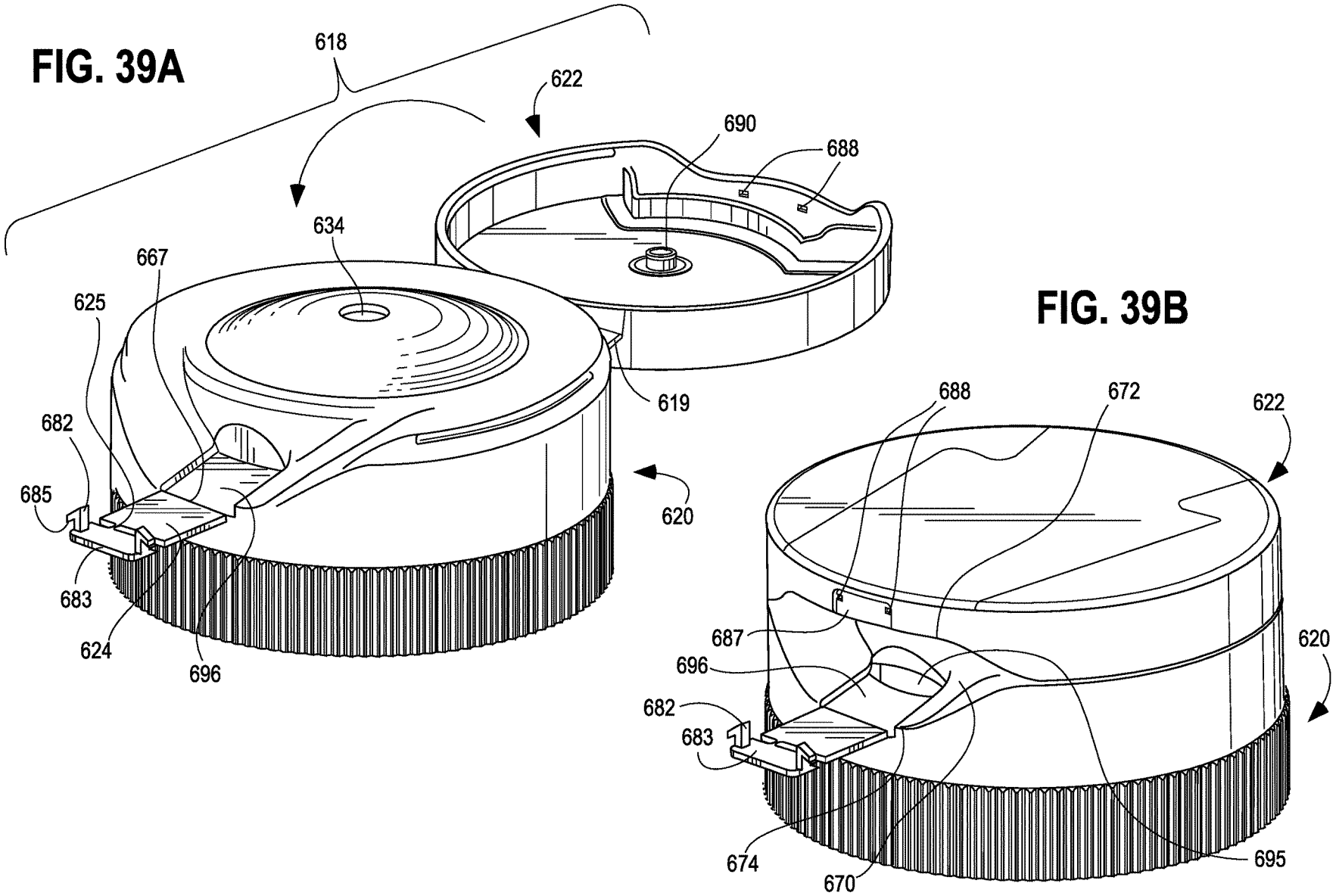
FIG. 39A is a perspective view of another embodiment of a closure cap in an initial open configuration in accordance with some embodiments.
FIG. 39B is a perspective view of the closure cap of FIG. 39A wherein a flip-top lid is in a closed position.

FIGS. 39A-41 illustrate another embodiment of the closure cap 618 in accordance with some embodiments. FIG. 39A is a perspective view of the closure cap 618 in an initial open configuration in accordance with some embodiments. FIG. 39B is a perspective view of the closure cap 618 where a flip-top lid 622 is in the closed position. Referring to FIGS. 39A and 39B, in some embodiments, the movable wall is connected to a base 620 of the closure cap 618 via a hinge 667. The hinge 667 may be disposed at a lower edge 674 of the recess 670 and a lower edge of the movable wall 624. In the initial open configuration (in which the closure cap 618 is typically manufactured), the movable wall 624 may be in an initial position where the movable wall 624 is rotated outwardly relative to the hinge 667. For example, in the initial position, the movable wall 624 may be substantially disposed outwardly perpendicular to the adjacent sidewall of the base. By one approach, the movable wall 624 has a first end and a second end which is opposite to the first end, and the first end of the movable wall 624 is connected to a remainder of the lid via the hinge 667. An extension tab 685 may extend from the second end of the movable wall. A breakable member 625 may be disposed between the extension tab and the second end of the movable wall such that the breakable member 625 may connect extension tab 685 to movable wall 624 before the breakable member 625 is broken. By one approach, the breakable member 625 includes one or more bridges of material disposed between the extension tab 685 and a remainder of the movable wall 624. The extension tab 685 may include a flange 683 and one or more latching projections 682 extending from the flange 683. In some embodiments, the extension tab 685 may include two latching projections 682 as shown in FIG. 39A. The latching projections 682 may extend substantially perpendicularly from the flange. In some embodiments, two latching projections 685 are disposed apart from each other. For example, in some embodiments, one latching projection is disposed near one side of the flange 683 and the other latching projection is disposed near the other side of the flange 683.

Referring to FIG. 39B, an indented portion 687 is disposed on the sidewall of the flip-top lid 622. The flip-top lid 622 may further include receiving openings 688 and the receiving openings are disposed on the indented side wall 687 of the flip-top lid 622. The flip-top lid 622 may move from the open position (FIG. 39A) to the closed position (FIG. 39B).

Figure 40:
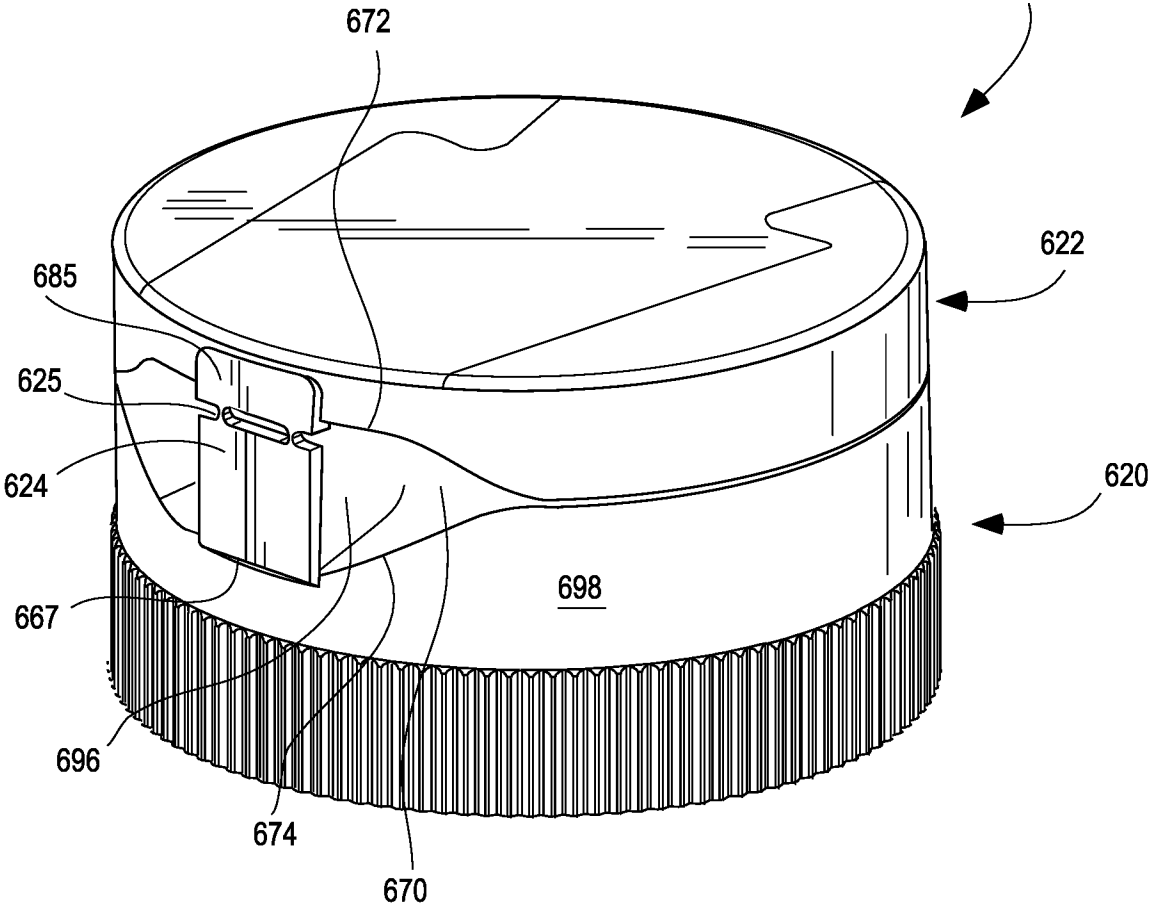
FIG. 40 is a perspective view of the closure cap of FIG. 39A in an initial closed configuration in accordance with some embodiments.

FIG. 40 is a perspective view of the closure cap 618 in the initial closed configuration. After moving the flip-top lid from the initial open position to the closed position, the movable wall 624 may be moved from the initial position (39B) to the first position (FIG. 40), which is the position the consumer would be first observing the closure cap. When the movable wall 624 is moved from the initial position to the first position, the latching projection may be inserted through the receiving opening 688 such that the flange 683 may be disposed on or at the indented portion of the sidewall of the flip-top lid and the extension tab may be securely coupled to the flip-top lid. In some embodiments, in the initial closed configuration, the breakable member(s) 625 may be disposed under the upper edge 672 of the recess 670 and may partially cover the opening of the recess 670.

Figure 41:
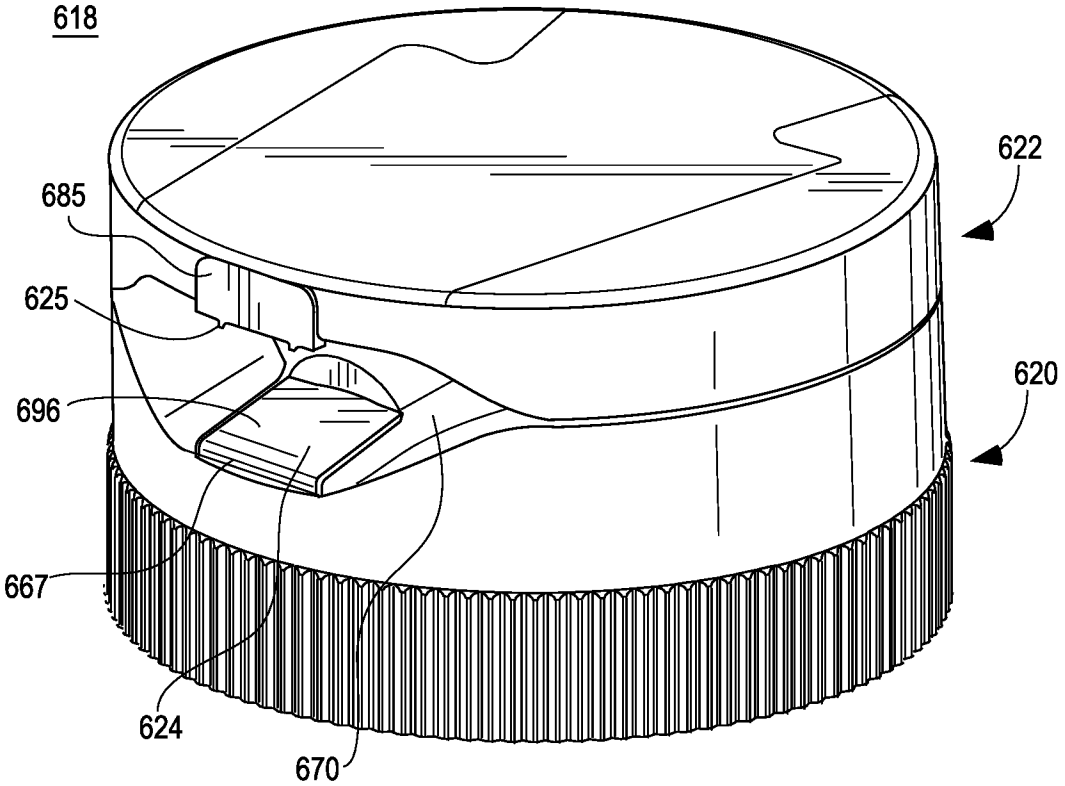
FIG. 41 is a perspective view of the closure cap of FIG. 39A wherein a movable wall is moved to a second position.

FIG. 41 is a perspective view of the closure cap 618 in the closed configuration where the movable wall 624 is moved to a second position. In some embodiments, before opening the flip-top lid by moving the flip-top lid from the initial closed position to the open position, the movable wall may be partly rotated toward or into the recess from the first position (FIG. 40) to the second position (FIG. 41) relative to the hinge 667. The recess forming surface of the base (i.e., the lower surface of the recess) may include recessed portion 696 for receiving the movable wall 624. When the movable wall is in the second position, the movable wall 624 may be disposed on the recessed portion 696. Once the movable wall 624 has been rotated inward, a user or consumer may more easily access the recess 670 and apply a force to the flip-top lid 622 in a direction substantially away from the base 620 to rotate the flip-top lid 622 to the open configuration.

Figure 42:
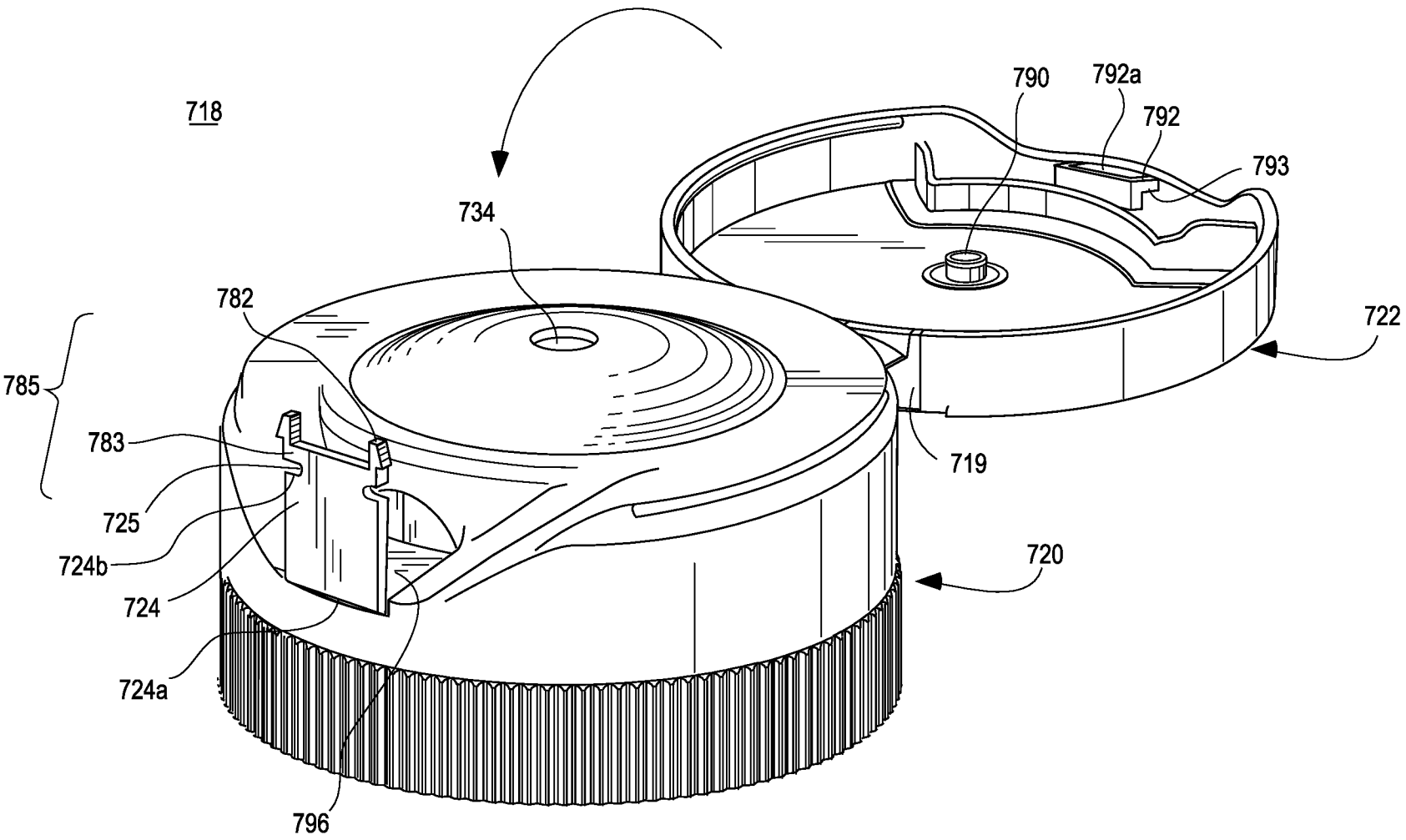
FIG. 42 is a perspective view of another embodiment of a closure cap in an initial open configuration in accordance with some embodiments.
Figure 43:
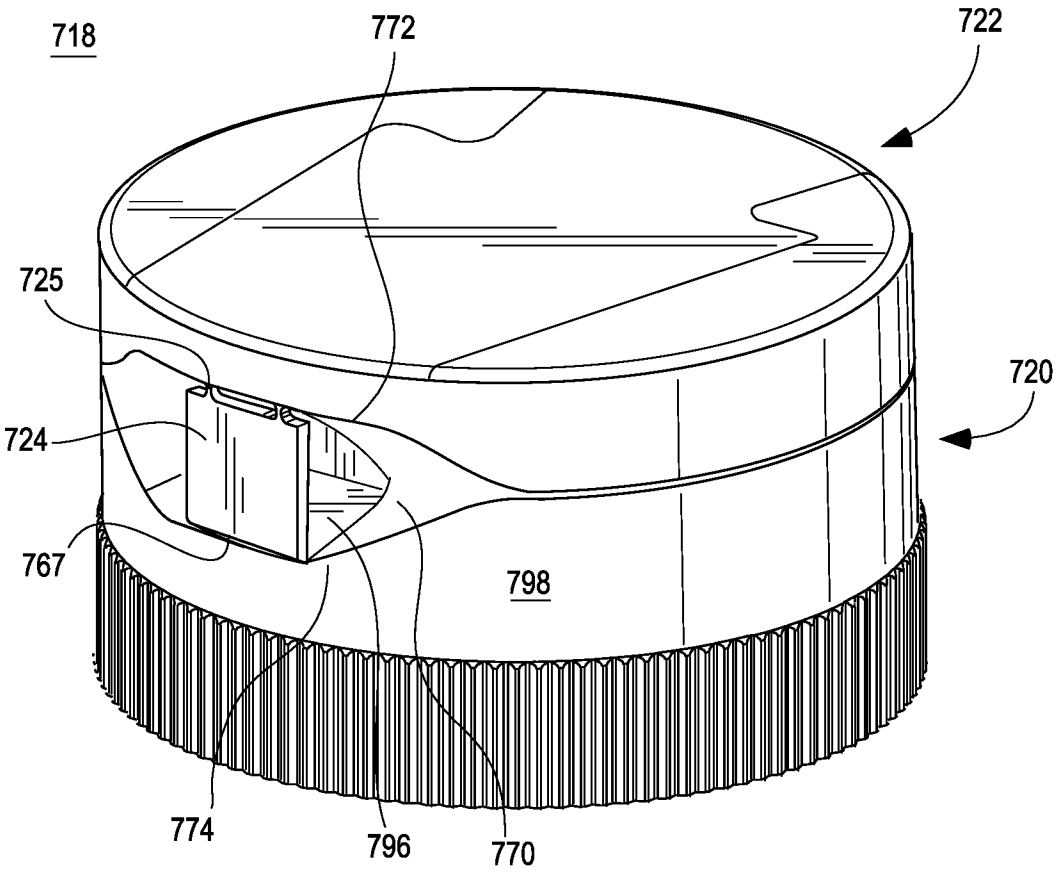
FIG. 43 is a perspective view of the closure cap of FIG. 42 wherein a flip-top lid is in a closed position in accordance with some embodiments.

FIGS. 42-45 illustrate another embodiment of the closure cap 718 in accordance with some embodiments. FIG. 42 is a perspective view of the closure cap 718 in an initial open configuration. FIG. 43 is a perspective view of the closure cap 718 where a flip-top lid 722 is in the initial closed position. The closure cap 718 may be molded in the initial open configuration as shown in FIG. 42. Referring to FIGS. 42 and 43, in some embodiments, the closure cap 718 may include a base 720, a flip-top lid 722, a movable wall 724, an extension tab 785, and a breakable member 725. In some embodiments, the movable wall extends upward from the lower edge 774 of the recess forming surface of the base 720. In the initial open configuration, the movable wall may be disposed substantially parallel to the sidewall of the base thereunder. In one example, the lower edge 724*a* of the movable wall 722 is attached to the lower edge of the recess forming surface 774 via a hinge 767. The extension tab 785 may extend from the upper edge 724*b* of the movable wall. In the initial open configuration, the extension tab 785 may be connected to the second edge 724*b* of the movable wall via the breakable member 725. By one approach, the extension tab includes the flange 783 and two latching projections 782 extending from the flange 783.

While the latching projections 682 of the closure cap 618 of FIGS. 39A-41 typically extend perpendicularly from the flange 683, the latching projection 782 of the closure cap of FIGS. 42-45 generally extend in the same direction in which the flange extends from the movable wall. Similar to the previous embodiment, the extension tab 785 may include two latching projections 782 that are disposed a distance apart from one another. As illustrated in FIG. 42, one latching projection may extend from one side of the flange 783 and the other latching projection may extend from the opposite side of the flange 783. In one illustrative configuration, the latching projections have a snap hook configuration, where the outside portion of each snap hook extends outwardly away from one another.

In some embodiments, the closure cap 718 may further include a mounting member 792 disposed on an inner surface of the sidewall of the flip-top lid 722. The mounting member 792 may extend from both the inner surface of the sidewall and the undersurface of the upper wall of the flip-top lid 722. The mounting member may be disposed on the edge formed by the inner surface of the sidewall and the undersurface of the upper wall of the flip-top lid 722. The mounting member may have a slot 792*a* to receive the latching projections when the flip-top lid is moved to the closed position. The mounting member 792 may further have side openings 793 that allow the side end of each snap hook inserted through the slot 792*a* to be out from the mounting member 792.

In some embodiments, the flip-top lid may be moved from the initial open position to the closed position such that the closure cap 718 may be in the initial closed configuration. When the flip-top lid is moved to the initial closed position, the latching projections 782 of the extension tab may be engaged with the mounting member 792 of the flip-top lid such that the extension tab 785 may be securely fixed to the flip-top lid 722. While the flange 683 of the extension tab 685 of FIG. 40 is disposed on the outer surface of the sidewall of the flip-top lid 622 such that the flange 683 is exposed to the outside when the extension tab 685 is attached to the flip-top lid 622, the flange 783 of the FIG. 43 is covered by the flip-top lid 722 when the extension tab 785 is attached to the flip-top lid 722.

Figure 44:
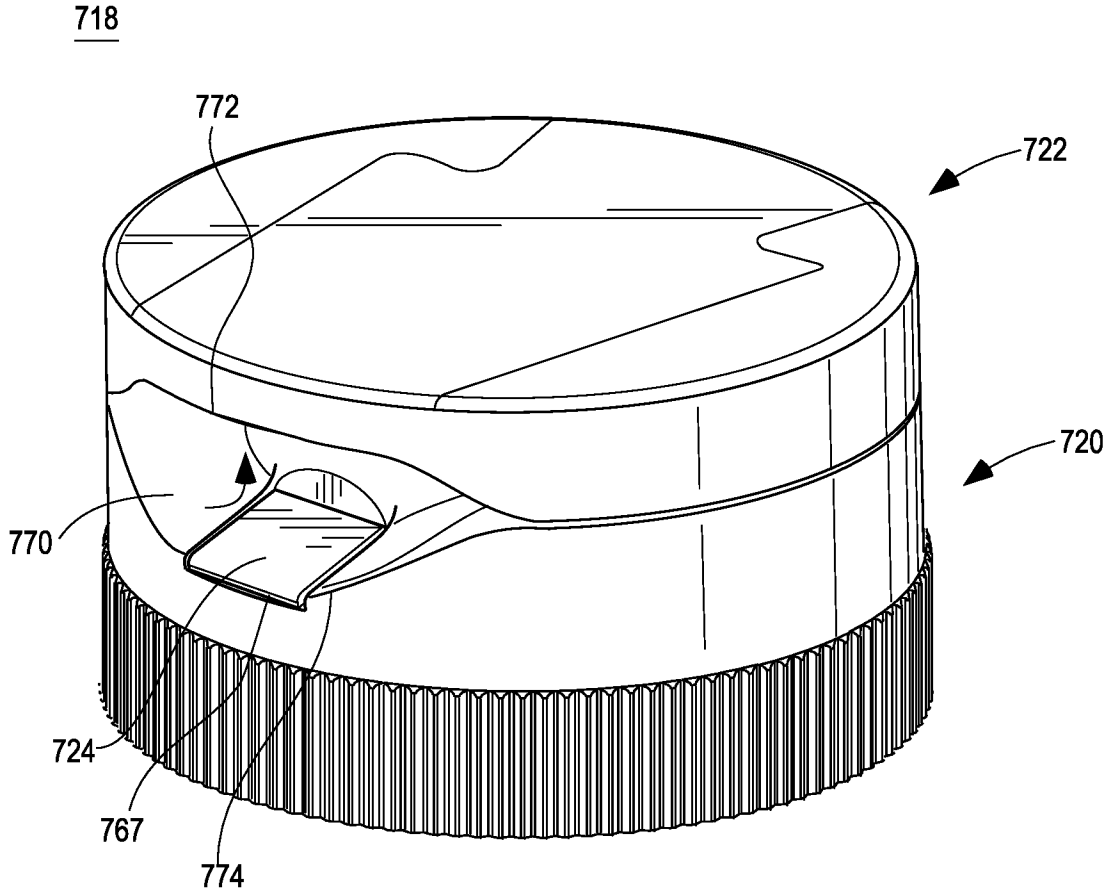
FIG. 44 is a perspective view of the closure cap of FIG. 42 wherein a movable wall is in a second position in accordance with some embodiments.

FIG. 44 is a perspective view of the closure cap 718 in the closed configuration where the movable wall 724 is moved to a second position. Similar to the other embodiments, before opening the closure cap 718 by moving the flip-top lid 722 from the initial closed position to the open position, the movable wall 724 may be rotated into the recess from the first position (FIG. 43) to the second position (FIG. 44) relative to the hinge 767. In this manner, the breakable member 725 may be broken as or once the movable wall 724 is moved from the first position to the second position such that the movable wall 724 and the extension tab 785 can be separated from one another. When the movable wall 724 is in the second position, the movable wall 724 may be disposed on or at a recessed portion 796 on the recess forming surface of the base 920. Once the movable wall 724 has been rotated inward, a user or consumer may access the recess 770 and apply a force to the flip-top lid 722 in a direction substantially away from the base 720 via the recess.

Figure 45:
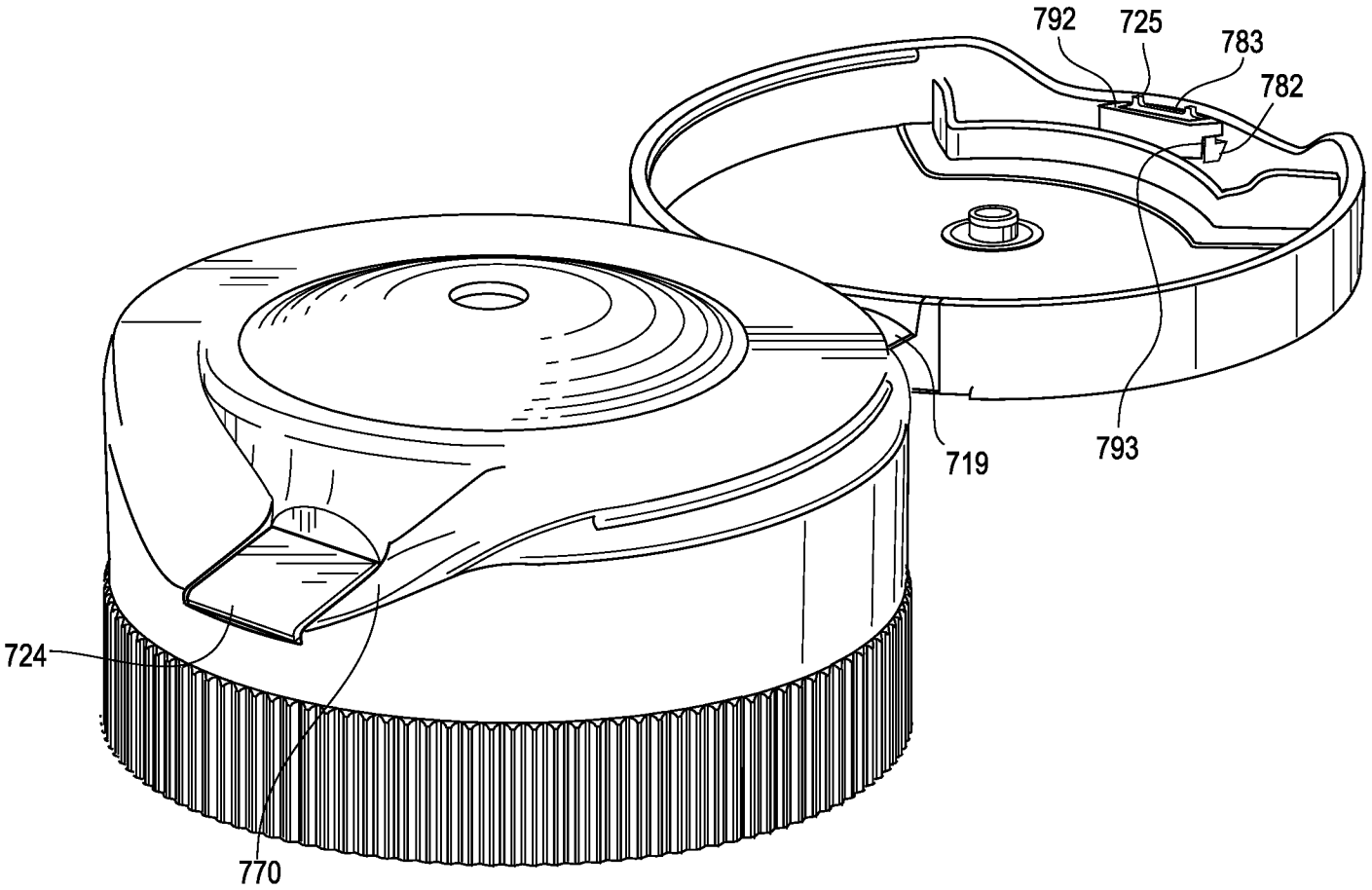
FIG. 45 is a perspective view of the closure cap of FIG. 42 in a subsequent open configuration in accordance with some embodiments.

FIG. 45 is a perspective view of the closure cap 718 in the subsequent open configuration. As shown in FIG. 45, even after moving the flip-top lid from the closed position to the open position, the extension tab 785 may remain securely fixed to the flip-top lid 722 via the engagement between the latching projections 782 and the mounting member 792, and the movable wall 724 may remain fixedly attached to the base 720 via the hinged connection 767.

Figure 46:
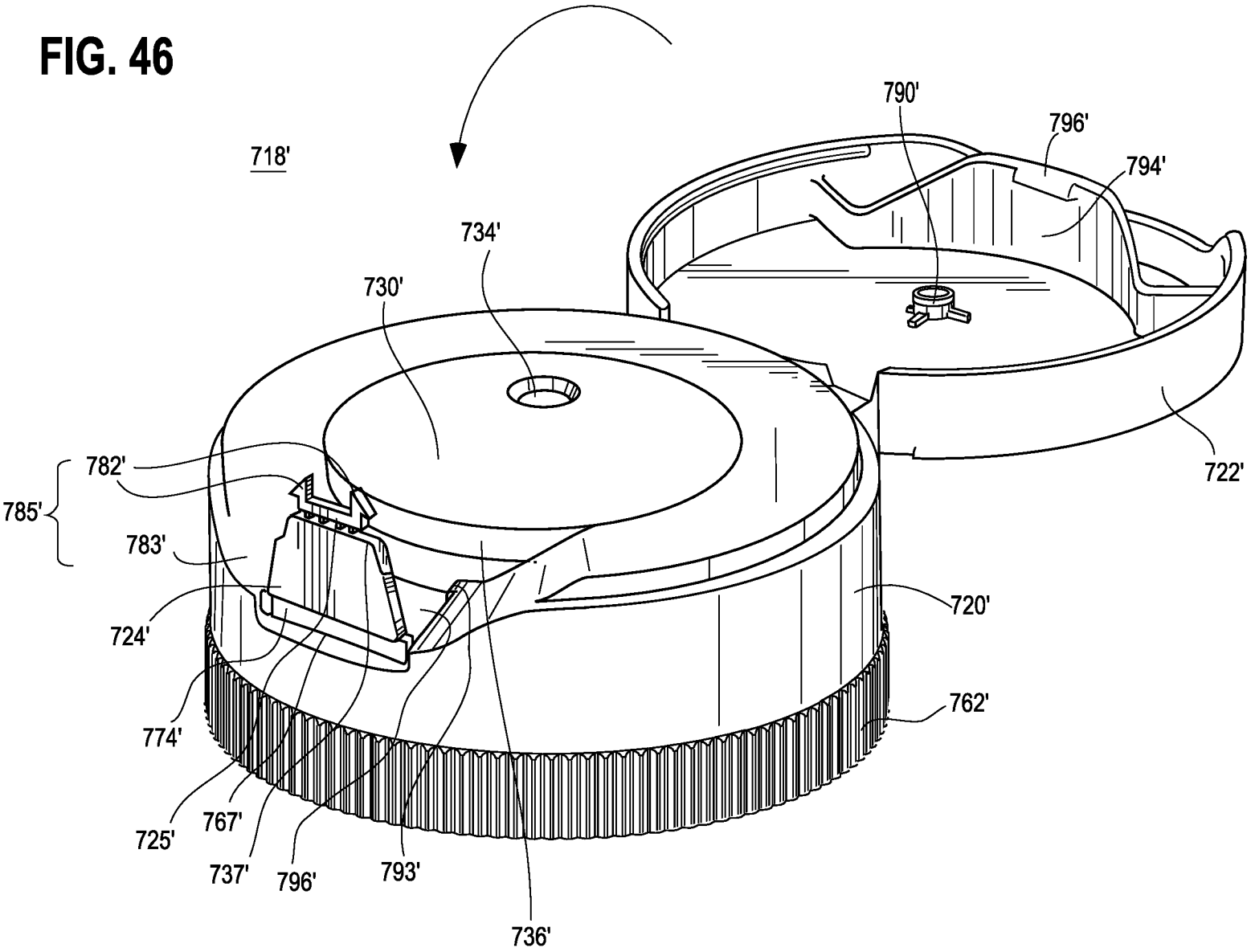
FIG. 46 is a perspective view of another embodiment of a closure cap in the initial open configuration in accordance with some embodiments.
Figure 47:
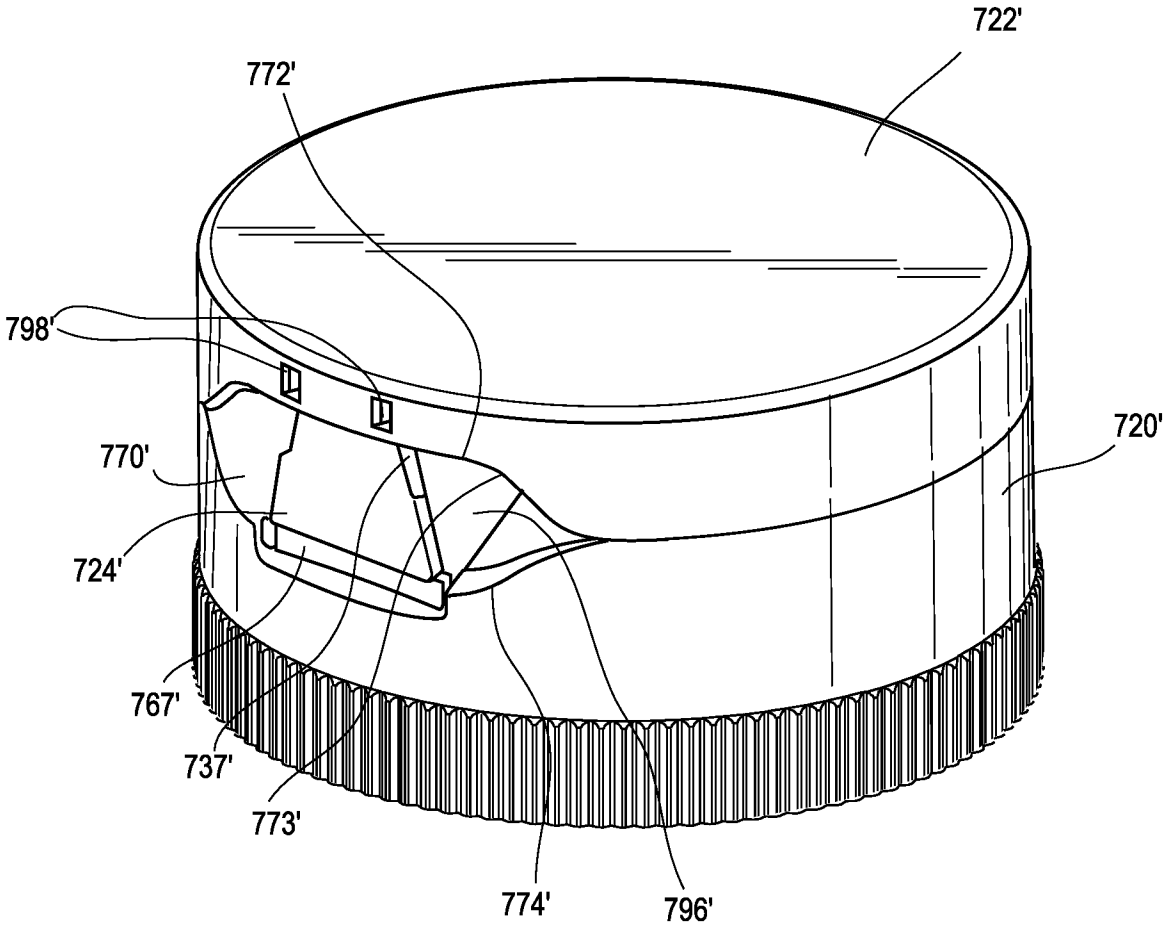
FIG. 47 is a perspective view of the closure cap of FIG. 46 in an initial closed configuration in accordance with some embodiments.
Figure 48:
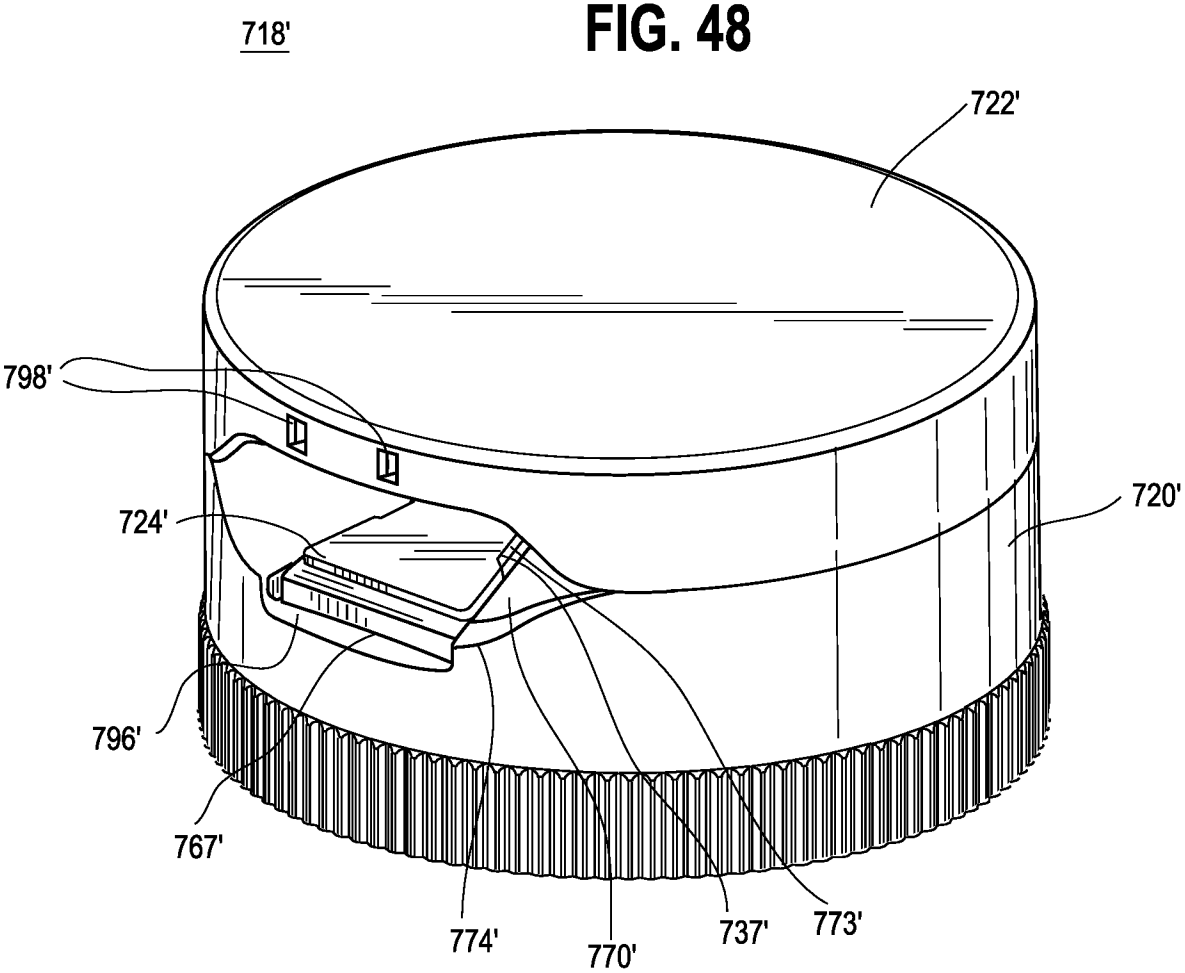
FIG. 48 is a perspective view of the closure cap of FIG. 46 wherein a movable wall is in a second position.

FIGS. 46-48 illustrate another embodiment of the closure cap 718' in accordance with some embodiments. The embodiment illustrated in FIGS. 46-48 may be a variant of the closure cap 718 illustrated in FIGS. 42-45. FIG. 46 is a perspective view of the closure cap 718' in the initial open configuration in accordance with some embodiments. FIG. 47 is a perspective view of the closure cap 718' in the initial closed configuration.

As compared to the previous embodiment in FIGS. 42-45, the movable wall 724' may slightly be retracted or spaced a distance from the lower edge 774' of the recess forming surface of the base 720'. While the movable wall 724 in FIGS. 42-45 has a substantially same width from the first end connected to the base to the second end connected to the extension tab, the width of the movable wall 724' in FIGS. 46-48 may vary, such as, e.g., the width may be reduced from the first end connected to a base 720' to the second end connected to the extension tab 785' such that the width of the first end of the movable wall 724' may be greater than the width of the second end of the movable wall 724'. For example, in one illustrative embodiment, the movable wall 724' has a generally trapezoid shape. In addition, the outer surface of the movable wall 724' may have an indented portion 737' on the side edge thereof. By one approach, the indented portion 737' is disposed near the second end of the movable wall 724.

The base 720' may have a recessed portion 796' (FIG. 47) on the recess forming surface. In one illustrative embodiment, the shape of the recessed portion 796' corresponds to the shape of the movable wall. The base 720' may further have a flange 773' on the side of the recessed portion 796'. As shown in FIG. 46, in some embodiments, the sidewall of the central portion 730' disposed toward the recess may include a ledge 736' near the top surface of the central portion 730'. Further, in some embodiments, a flip-top lid 722' may include an inset wall 794' and a flange 796' extends from the inset wall 794' that correspond to the ledge 736' such that the two elements may cooperate to facilitate a mechanical closure such as a snap fit between a portion of the flip-top lid and the base. The flip-top lid 722' may include a mounting member (because the mounting member is disposed behind the inset wall 794', it is not shown in FIG. 46) like the mounting member 792 in FIGS. 42-45.

When the flip-top lid 722' is moved from the initial open position (FIG. 46) to the closed position (FIG. 47), the latching projections 782' of the extension tab 785' may be inserted into and engage with the mounting member such that the extension tab 785' may be securely fixed to the flip-top lid 722'. Further, When the flip-top lid is moved from the initial open position to the closed position, the flange 796' extending from the inset wall 794' of the flip-top lid 722' may engage with the ledge 736' extending from the central portion 730' of the base 720' such that the flip-top lid 722'. The engagement between the ledge 736' and the flange 796' may prevent the flip-top lid 722' in the closed portion from moving to partially or fully the open position unless a force to open the flip-top lid 722' is applied thereto.

Referring to FIG. 47, the sidewall of the flip-top lid may include one or more openings 798' adjacent or near the recess 770'. When the extension tab is fixed to the flip-top lid, the openings 798' typically correspond to the leading portion of each latching projection 782' such that at least a portion of the latching projections 782' may be seen from the outside of the closure cap 718' through the opening 798'. In this manner, a consumer or user may be able to view the latching projections 782' through the viewing windows or openings 798' therethrough after initial closure when the extension tab is advanced into the opening of the flip-top lid and after the movable wall 724' has moved to the second position and the breakable portions have been separated from a remainder of the movable wall 724'.

FIG. 48 is a perspective view of the closure cap 718' in the closed configuration wherein the movable wall 724' is in the second position. The movable wall 724' may be rotated from the first position (FIG. 47) to the second position (FIG. 48). When the movable wall 724' is in the second position, the movable wall is disposed on the recessed portion 796' and the indented portion 737' of the movable wall 724' may engage with the flange 773' on the side of the recessed portion 796'. The engagement between the flange 773' and the indented portion 737' may assist with retaining the movable wall 724' in the recessed portion 796'.

Figure 49:
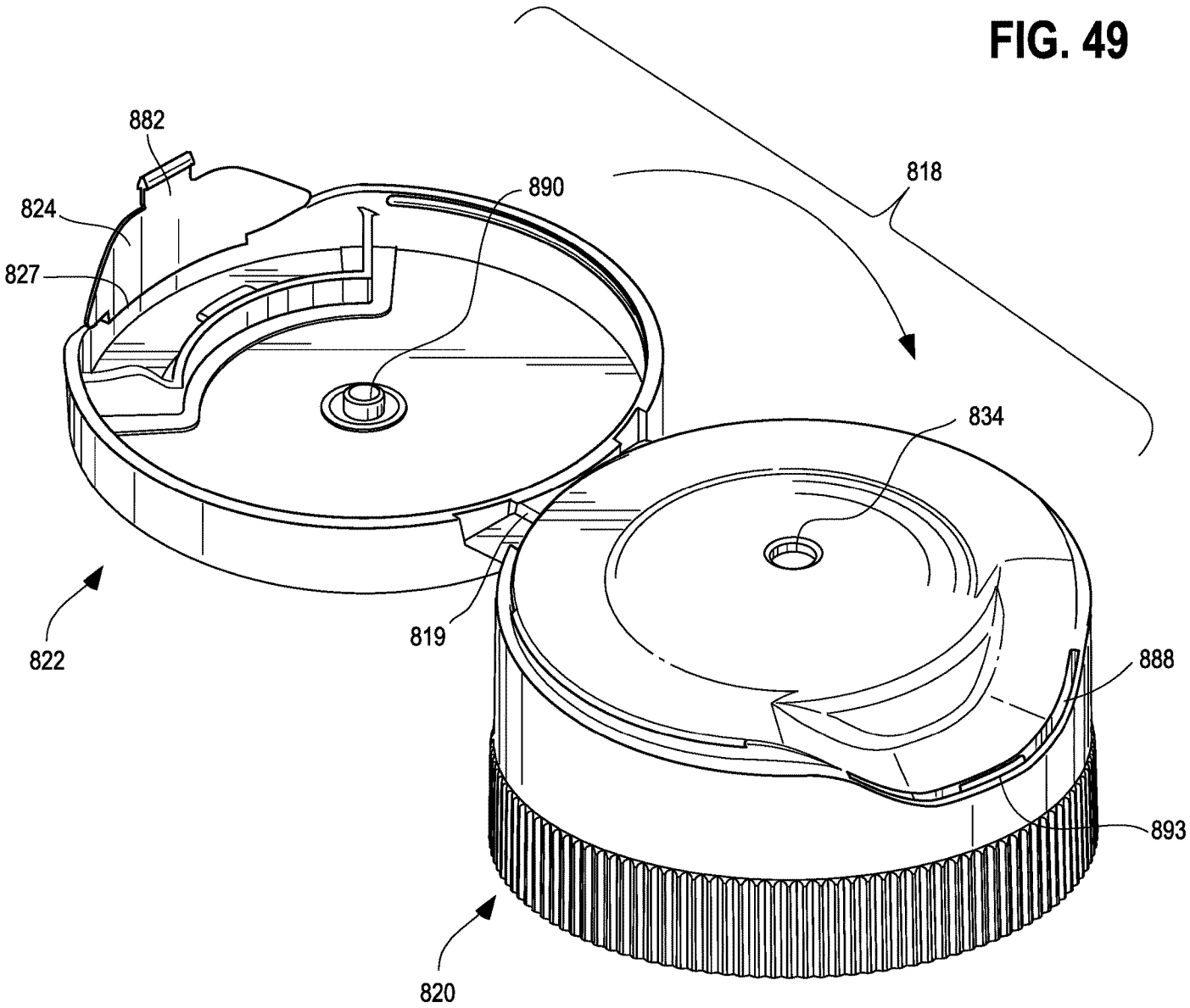
FIG. 49 is a perspective view of another embodiment of a closure cap in an initial open configuration in accordance with some embodiments.
Figure 50:
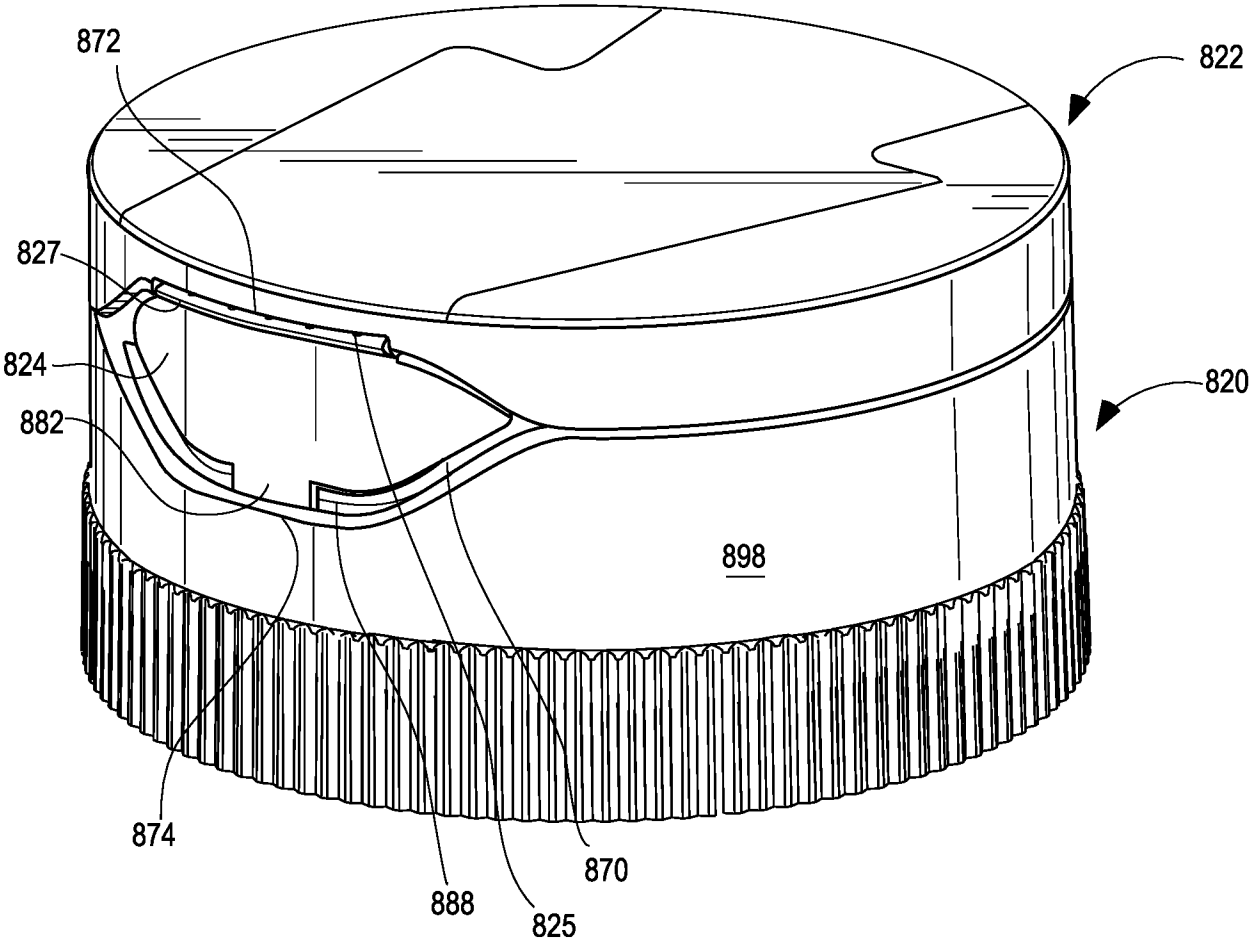
FIG. 50 is a perspective view of the closure cap of FIG. 49 in an initial closed configuration in accordance with some embodiments.

FIGS. 49-55 illustrate another embodiment of a closure cap 818 in accordance with some embodiments. FIG. 49 is a perspective view of the closure cap 818 in an initial open, manufacturing, or molding configuration. FIG. 50 is a perspective view of the closure cap in an initial closed configuration. The closure cap 818 includes a base 820, a flip-top lid 822, a movable wall 824, and a breakable member 825.

Similar to caps previously described, the flip-top lid 822 may be hingedly connected to the base 820. The flip-top lid 822 may be movable between an open position (FIG. 49) and a closed position (FIG. 50) relative to a hinge 819 connecting the base 820 and the flip-top lid 822. The flip-top lid 822 and the base 820 together form a recess 870 in the outer wall of the closure cap 818 when the flip-top lid 822 is in the closed position. The recess 870 may allow a user to apply a force to move the flip-top lid 822 from the closed position to the open position.

In some embodiments, the base 820 has an elongated guide slot 888 adjacent or on a recess-forming surface of the base 820. In some configurations, the elongated guide slot 888 may be slightly distanced from the lower edge 874 of the recess 870. The elongated guide slot 888 may have a curve corresponding to the curve of the sidewall 898 of the base 820. By one approach, the elongated guide slot 888 may include a pair of arms 893 disposed near the lower edge thereof. In one illustrative approach, the pair of arms 893 is disposed on a position corresponding to the latching projection 882. The pair of arms 893 may be flexible arms and configured to engage the corresponding structure of the flip-top lid as described below.

In the initial open configuration, the movable wall 824 is connected to the flip-top lid 822 via the breakable member 825. The movable wall 824 may be slightly retracted from the sidewall of the flip-top lid 822. The movable wall 824 may have a curve corresponding to the curvature of the elongated guide slot 888. By some approaches, the top portion 827 of the movable wall 824 may have a width larger than the width of the remaining portion of the movable wall 824. For example, the movable wall 824 may have a flange 827 at the top portion thereof. In some approaches, the width of the top portion 827 of the movable wall 824 may be larger than the slot width of the elongated guide slot 888.

Figure 53:
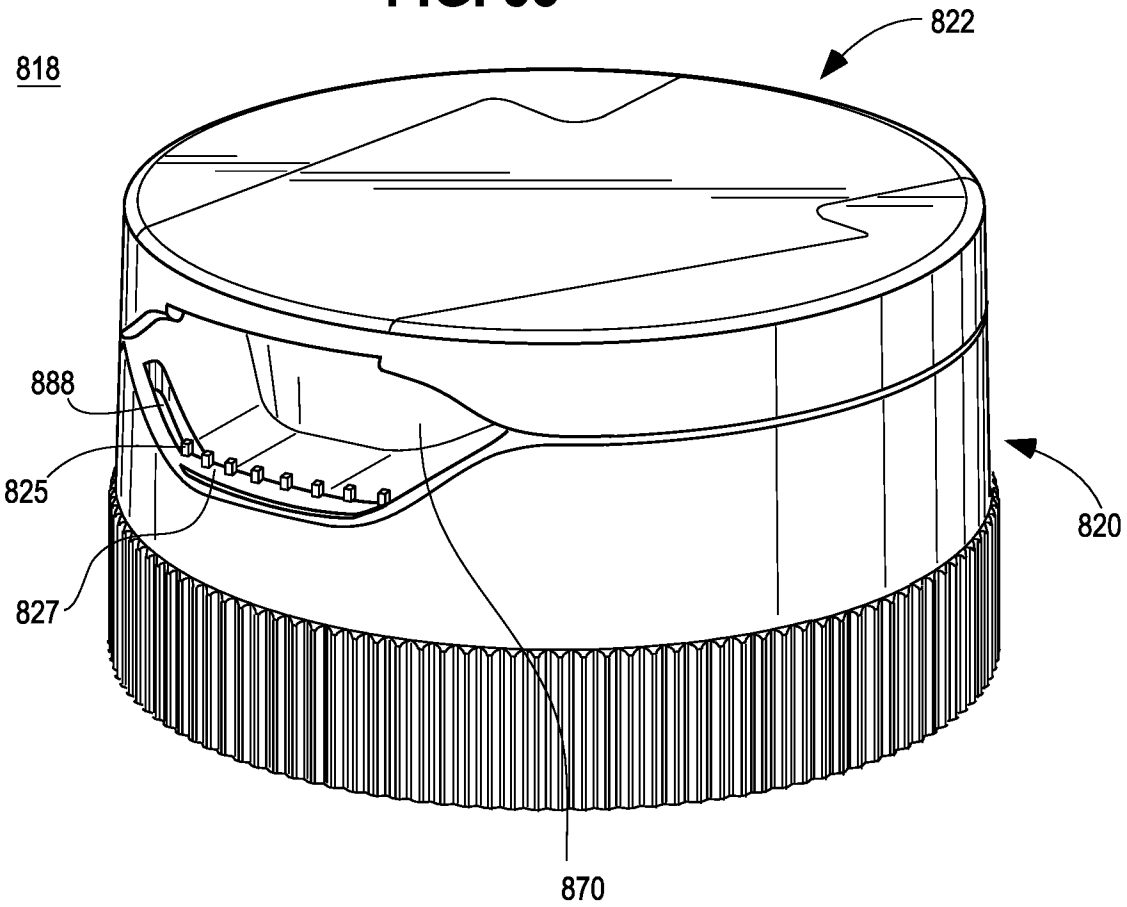
FIG. 53 is a perspective view of the closure cap of FIG. 49 wherein a movable wall is in a second position in accordance with some embodiments.

As mentioned above, the movable wall 824 may be movable from the first position (FIG. 50) to the second position (FIG. 53). In the initial closed configuration, the movable wall 824 may be configured to cover at least a significant portion of the recess opening as shown in FIG. 50, such as, e.g., covering at least 90% of the recess opening, and in some configurations, covering at least 95% of the recess opening (though other covering ranges may be employed with the tamper evident features described herein).

In some embodiments, the breakable member 825 may extend from the top portion 827 of the movable wall 824 in the initial closed configuration, before the initial opening of the flip-top lid. For example, breakable member 825 may be disposed between the top portion 827 of the movable wall 824 and an upper edge 872 of the recess 870. The breakable member 825 may be configured to connect the movable wall 824 and the flip-top lid 822 in the initial open configuration. The breakable member 825 may be configured to break as or upon the movable wall 824 moving from the first position toward other positions after the initial closure or upon the flip-top lid 822 is moved from the closed position toward the open position after the initial closure. The movable wall 824 also may include a latching projection 882 extending from the movable wall 824. The latching projection 882 may extend from the lower edge of the movable wall 824. In some embodiments, the latching projection 882 may be an elongated projection having a generally arrow-shaped cross section. For example, the latching projection 882 may have an elongated portion and a barb at one end of the elongated portion. The elongated portion of the latching projection 882 may be a generally curved wall that may have a curvature corresponding to a portion of the movable wall from which the latching projection 882 extends. In one illustrative approach, the barb may be elongated along the edge of the elongated portion of the latching projection 882.

Figure 51A:
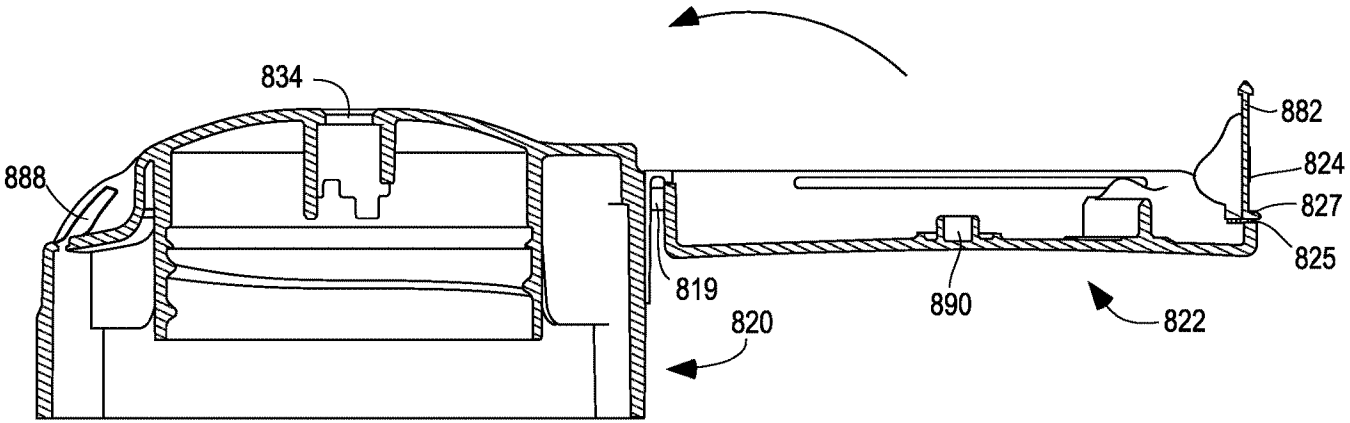
FIGS. 51A and 51B are cross sectional views illustrating a manufacturing configuration and an initially closed configuration of the closure cap of FIG. 49 in accordance with some embodiments.
Figure 51B:
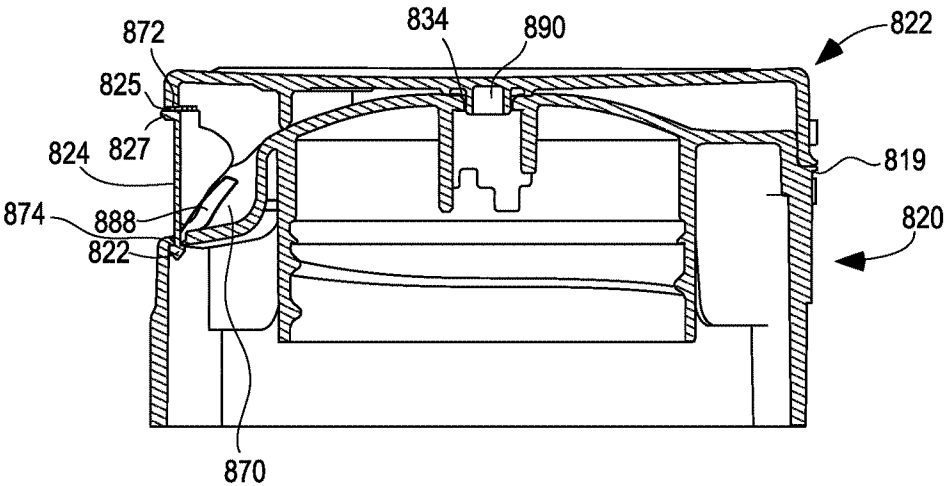

FIGS. 51A and 51B are cross sectional views of the closure cap 818 illustrating a manufacturing flow of the closure cap 818. FIG. 51A illustrates the configuration in which the closure cap 818 is manufactured. The closure cap 818 can be molded in and then ejected from a forming mold in the initial open configuration of FIG. 51A. The ejected molded closure cap 818 in the initial open configuration may have the structure illustrated in FIG. 49.

The manufacturing method may include moving the flip-top lid 822 from the initial open position to the closed position after ejection of the closure cap 818 from the forming mold. The flip-top lid 822 may rotate about the hinge 819 from the initial open position (FIG. 51A) to the closed position (FIG. 51B) such that closure cap 818 in the initial closed configuration may be formed. Because the movable wall 824 is connected to the flip-top lid 822 via the breakable member 825, when the flip-top lid 822 moves from the initial open position to the closed position, the movable wall 824, the latching projection 882, and the breakable member 825 move along with the movement of the flip-top lid 822. When the flip-top lid 822 comes close to the base such that the barb of the latching projection contacts and is placed on the pair of arms 893 of the elongated guide slot 882, the movement of the flip-top lid 822 may be stopped by the pair of arms 893 of the elongated guide slot 882 if there is no force to keep moving the flip-top lid 822 to the closed position. The force to keep moving the flip-top lid 822 may vary depending on the size and/or the flexibility of the barb and/or the pair of arms 893. When enough force to keep moving the flip-top lid 822 to the closed position is applied, the barb of the latching projection may snap into the recess thereby passing into and through the elongated guide slot 888 and the pair of arms 893 thereof such that the closure cap 818 in the initial closed configuration may be configured as shown in FIGS. 50 and 51B. In the initial closed configuration, i.e., after the initial closure of the flip-top lid 822 and prior to the subsequent opening of the flip-top lid 822, at least a portion of the latching projection 882, e.g., the barb, may be disposed inside the base 820 near the elongated guide slot 888.

Figure 52:
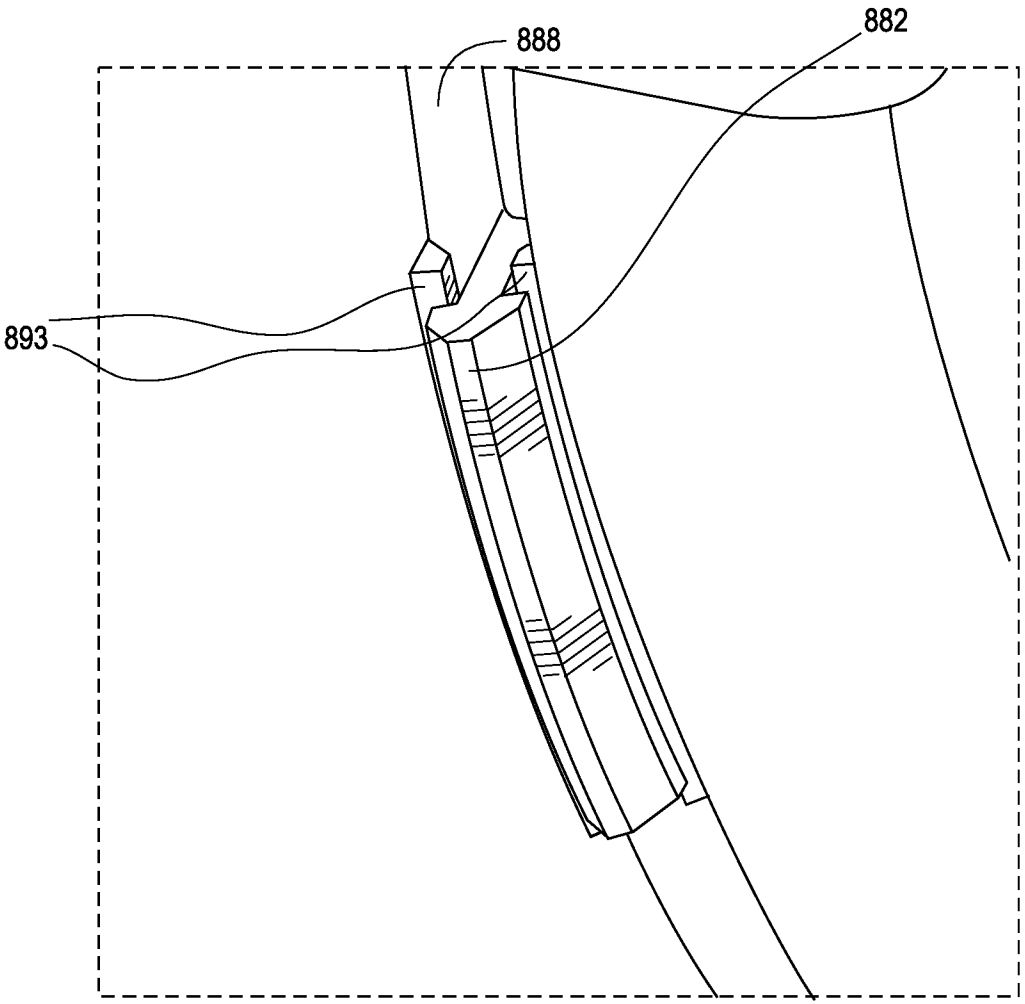
FIG. 52 is a partial perspective view illustrating an elongated guide slot and a latching projection of the closure cap of FIG. 49 in accordance with some embodiments.

FIG. 52 is a partial, perspective view illustrating the elongated guide slot 888 and the latching projection 882 disposed therein, viewed from underneath the recess forming surface of the base 820. As shown in FIG. 52, the side surfaces of the pair of arms 893 (or portions thereof) facing each other may be tapered to facilitate advancing the latching projection 882 into the elongated guide slot 188. The width of the top end of the barb may be narrower than the closest distance between the pair of arms 893 to facilitate the insertion of the latching projection through the pair of arms 893. The maximum width of the barb (at a rear end or portion thereof) may be greater than the closest distance between the pair of arms 893 to restrain or retain the barb from being backed out therefrom. Once the barb is inserted, the barb may engage with or catch the lower surface of the pair of arms 893 of the elongated guide slot 888. The engagement between the barb and the pair of arms may retain the latching projection within the elongated guide slot to prevent it from being backed out therefrom.

Figure 54:
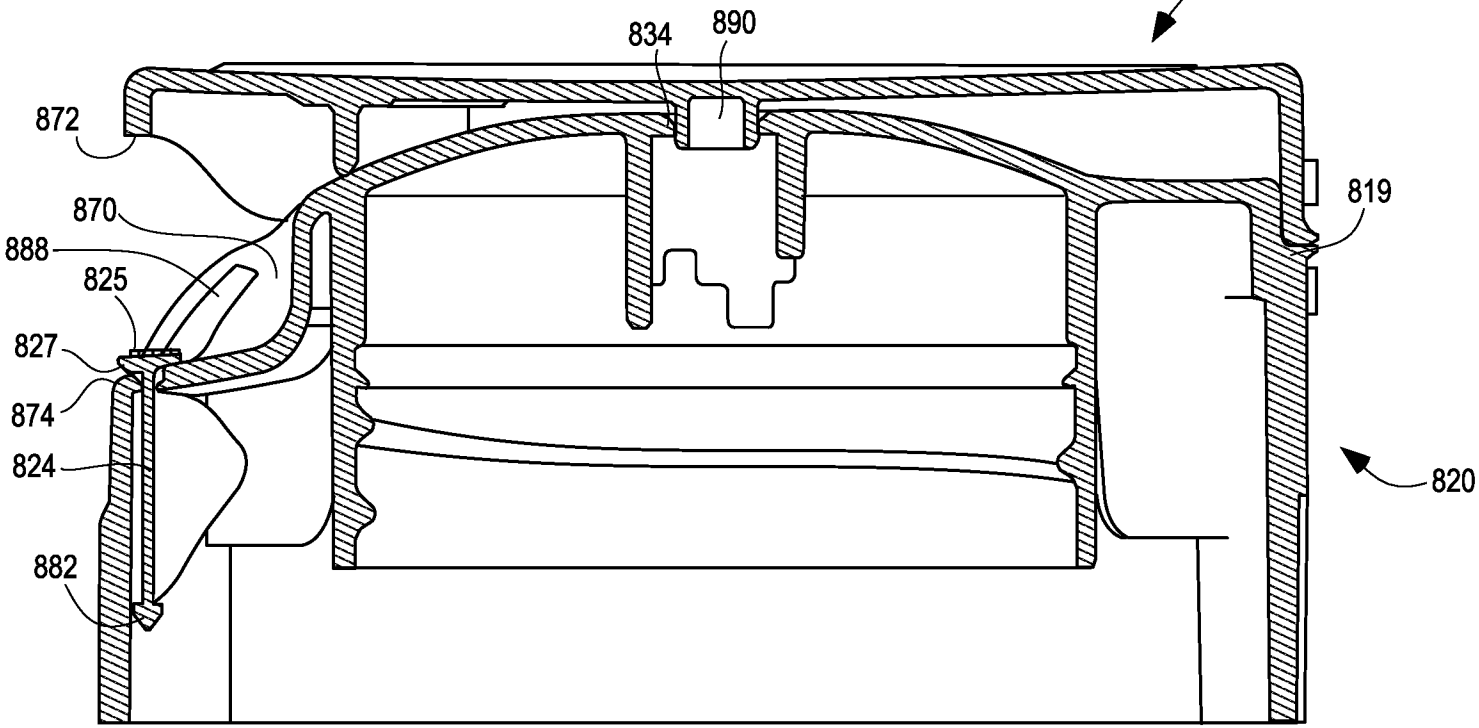
FIG. 54 is a cross sectional view of the closure cap of FIG. 53 in accordance with some embodiments.

FIG. 53 is a perspective view of the closure cap 818 illustrating the movable wall 824 is in the second position before the subsequent open configuration. FIG. 54 is a cross sectional view of the closure cap 818 in FIG. 53. In the second position, the movable wall 824 may be dropped down by sliding into the elongated guide slot 888 such that a substantial portion of the movable wall 824 is disposed below the top portion 827 thereof, such that the movable wall 824 is disposed at or within the elongated guide slot 888.

In one illustrative embodiment, the movable wall 824 is configured to move from the first position to the second position upon separation of the breakable member 825 into two parts. Before the breaking member 825 is broken, the movable wall 824 may be fixed to the flip-top lid 822 via the breakable member 825 but once the breakable member 825 is broken or separated into two parts, the movable wall 824 is free to move, such as move downward if the closure cap is configured with the flip-top lid on top of the base because of the force of the gravity. The breakable member 825 may be broken or separated into two parts by application of a force to the breakable member 825 or the movable wall. For example, when a user pushes the movable wall 824 toward the recess 870, a shear stress may be applied to the breakable member 825 such that the breakable member 825 may be broken. Further, when a user applies a force to move the flip-top lid 822 from the closed position to the open position by applying a pulling/pushing force to the flip-top lid, a tension may be applied to the breakable member 825 because the barb engaged with the pair of arms 893 of the elongated guide slot 888 prevents the latching projection 882 from being backed out and prevent the movable wall 824 from moving together with the flip-top lid 822 according to the pulling force applied to the flip-top lid 822. Once the tension becomes greater than the rupture strength of the breakable member 825, the breakable member 825 may be broken and separated. Alternatively, when a user applies a force sufficient enough to overcome the rupture strength of the breakable member (to thereby permit the movable wall 824 to slide down through the elongated guide slot 888), the breakable member 825 may be broken. The severed/broken breakable member may provide a tamper evident indicator.

As illustrated in FIGS. 53 and 54, in the second position, much of the movable wall 824 under the top portion may not be seen from the outside of the closure cap 818. In the second position, the top portion 827 of the movable wall 824 may be disposed above the elongated guide slot 888 by having a width greater than the width of the elongated guide slot 888 (though in other configurations much of the breakable portions 825 also may be disposed within the guide slot 888). Further, when the movable wall 824 is in the second position, much the opening of the recess is readily exposed. For example, in one configuration, only the top portion 827 of the movable wall 824 and the broken breakable member 825 may extend into the opening of the recess 870 when the movable member is in the second position such that a user may easily access the recess 870 and apply a force to the flip-top lid 822 in a direction substantially away from the base 820. The dropped-down movable wall may also function as a tamper evident structure indicating that the closure cap has been previously opened.

Figure 55:
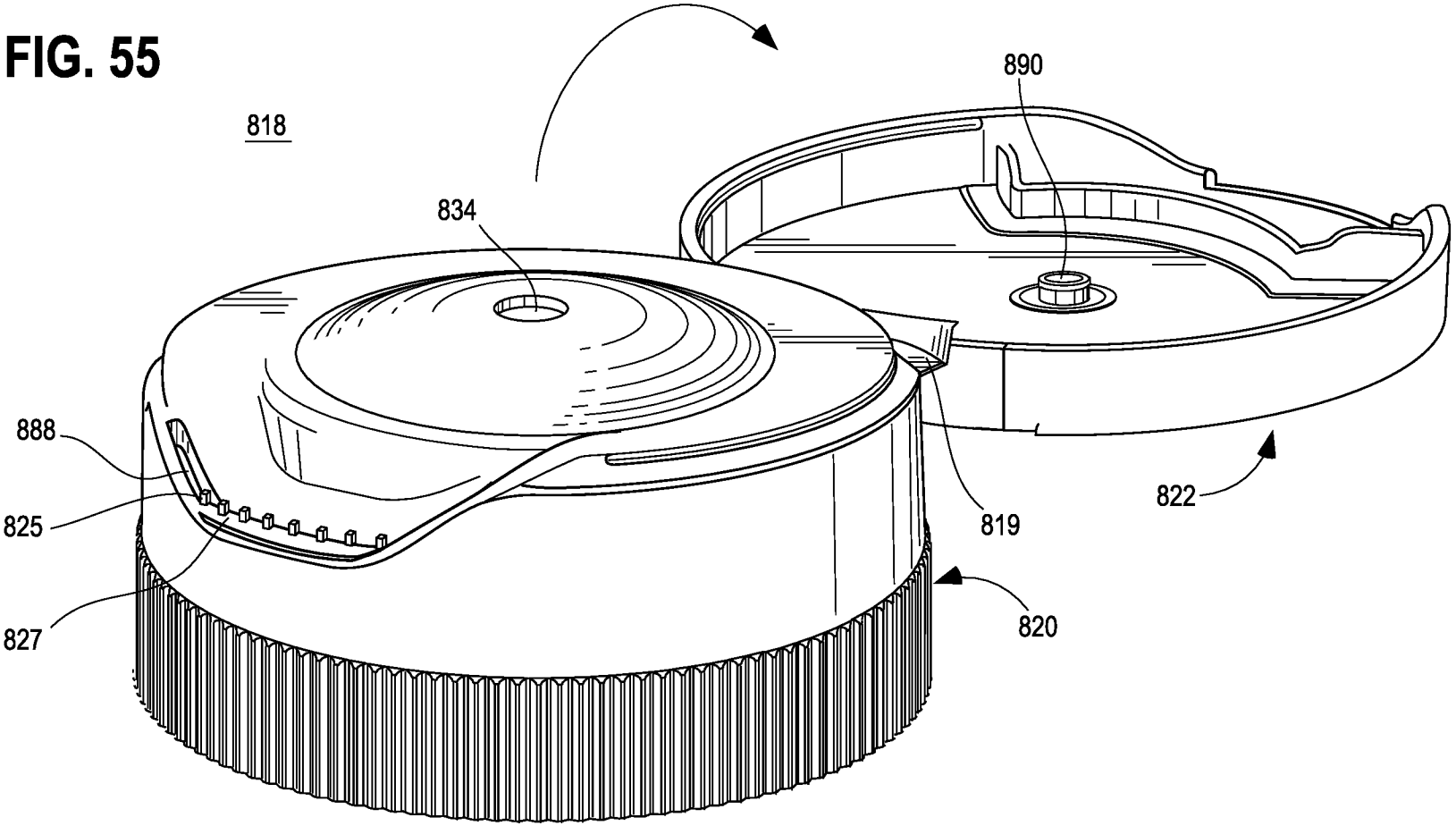
FIG. 55 is a perspective view of the closure cap of FIG. 53 in a subsequent open configuration in accordance with some embodiments.

FIG. 55 is a perspective view of the closure cap 818 in the subsequent open configuration. In some embodiments, the flip-top lid 822 may be moved from the closed position to the open position after the initial closing. Even in the subsequent open configuration, the movable wall 824 typically remains coupled to the base 820 and primarily disposed within the elongated slot 888.

In some embodiments, a closure cap includes a base having an elongated guide slot or retention element, a flip-top lid hingedly connected to the base, the flip-top lid being movable between an open position and a closed position, the flip-top lid and the base together forming a recess in an outer wall of the closure cap when the flip-top lid is in the closed position, where the recess allows a user to apply a force to move the flip-top lid from the closed position to the open position. In addition, the closure cap may include a movable wall being movable from a first position where the movable wall covers at least a portion of an opening of the recess to a second position lower than the first position. By some approaches, the movable wall is attached to the flip-top lid in the first position, and a breakable member is disposed between the movable wall and the flip-top lid. In some configurations, the elongated guide slot of the base is slightly wider than the movable wall, and wherein the movable wall moves from the first position to the second position by sliding into the elongated guide slot of the base once the breakable member separates.

In some embodiments, a method of opening a closure cap includes providing a closure cap having a base with an elongated guide slot or retention element, a flip-top lid hingedly connected to the base, the flip-top lid and the base together forming a recess in an outer wall of the closure cap, and a movable wall attached to the flip-top lid via a breakable member disposed between the movable wall and the flip-top lid, breaking the breakable member, and applying a force to a portion of the flip-top lid at the recess to move the flip-top lid about the hinged connection to the base to an open position, wherein the movable wall moves from a first position where the movable wall covers at least a portion of an opening of the recess to a second position lower than the first position by sliding into the elongated guide slot of the base upon the breakable member breaks.

In some embodiments, a dispensing bottle comprises a container body with a thixotropic fluid therein (such as ketchup), the container body having a neck with threads thereon, and a closure cap coupled to the container body, the closure cap comprising a base having an elongated guide slot, a flip-top lid hingedly connected to the base, the flip-top lid being movable between an open position and a closed position, the flip-top lid and the base together forming a recess in an outer wall of the closure cap when the flip-top lid is in the closed position, the recess allowing a user to apply a force to move the flip-top lid from the closed position to the open position, a movable wall being movable from a first position where the movable wall covers at least a portion of an opening of the recess to a second position lower than the first position, the movable wall attached to the flip-top lid in the first position, and a breakable member disposed between the movable wall and the flip-top lid, the breakable member configured to break upon enough force to break the breakable member is applied thereto, wherein the elongated guide slot is slightly wider than the movable wall, and wherein the movable wall moves from the first position to the second position by sliding into the elongated guide slot of the base upon the breakable member breaks.

In some embodiments, a method of manufacturing a filled dispensing bottle includes molding a receptacle having neck threads thereon, filling the receptacle with a thixotropic fluid, providing a closure cap comprising a base having an elongated guide slot or retention element, a flip-top lid hingedly connected to the base, the flip-top lid being movable between an open position and a closed position, the flip-top lid and the base together forming a recess in an outer wall of the closure cap when the flip-top lid is in the closed position, the recess allowing a user to apply a force to move the flip-top lid from the closed position to the open position, a movable wall being movable from a first position where the movable wall covers at least a portion of an opening of the recess to a second position lower than the first position, the movable wall attached to the flip-top lid in the first position, and a breakable member disposed between the movable wall and the flip-top lid, the breakable member configured to break upon enough force to break the breakable member is applied thereto, and closing the filled receptacle with the closure cap. By one approach, the elongated guide slot is slightly wider than the movable wall, and wherein the movable wall moves from the first position to the second position by sliding into the elongated guide slot of the base upon the breakable member breaks. In yet other embodiments, the retention element will retain portions of the movable wall that separate therefrom as the movable wall is moved from a first position to a second position.

Figure 56:
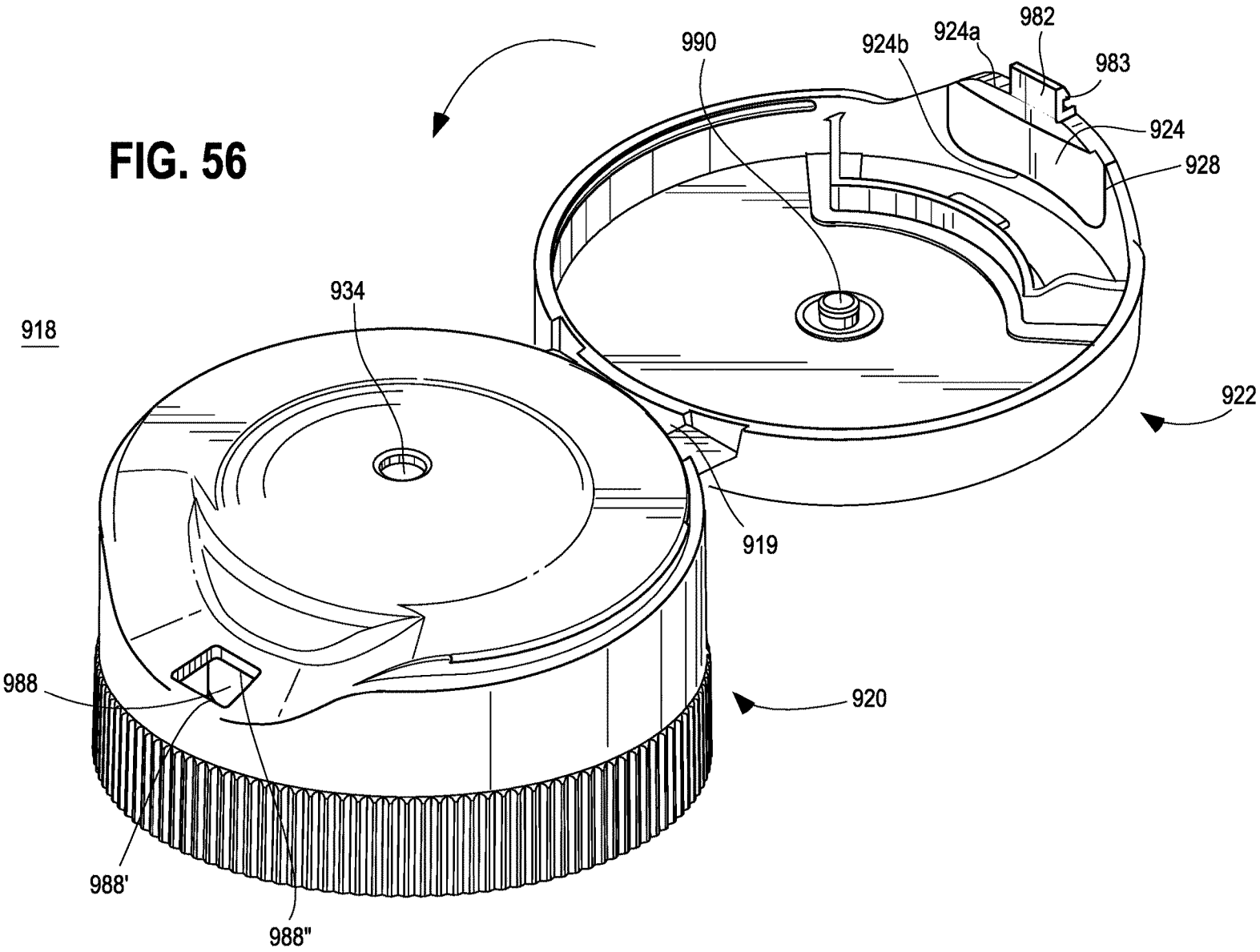
FIG. 56 is a perspective view of another embodiment of a closure cap in an initial open configuration in accordance with some embodiments.
Figure 57:
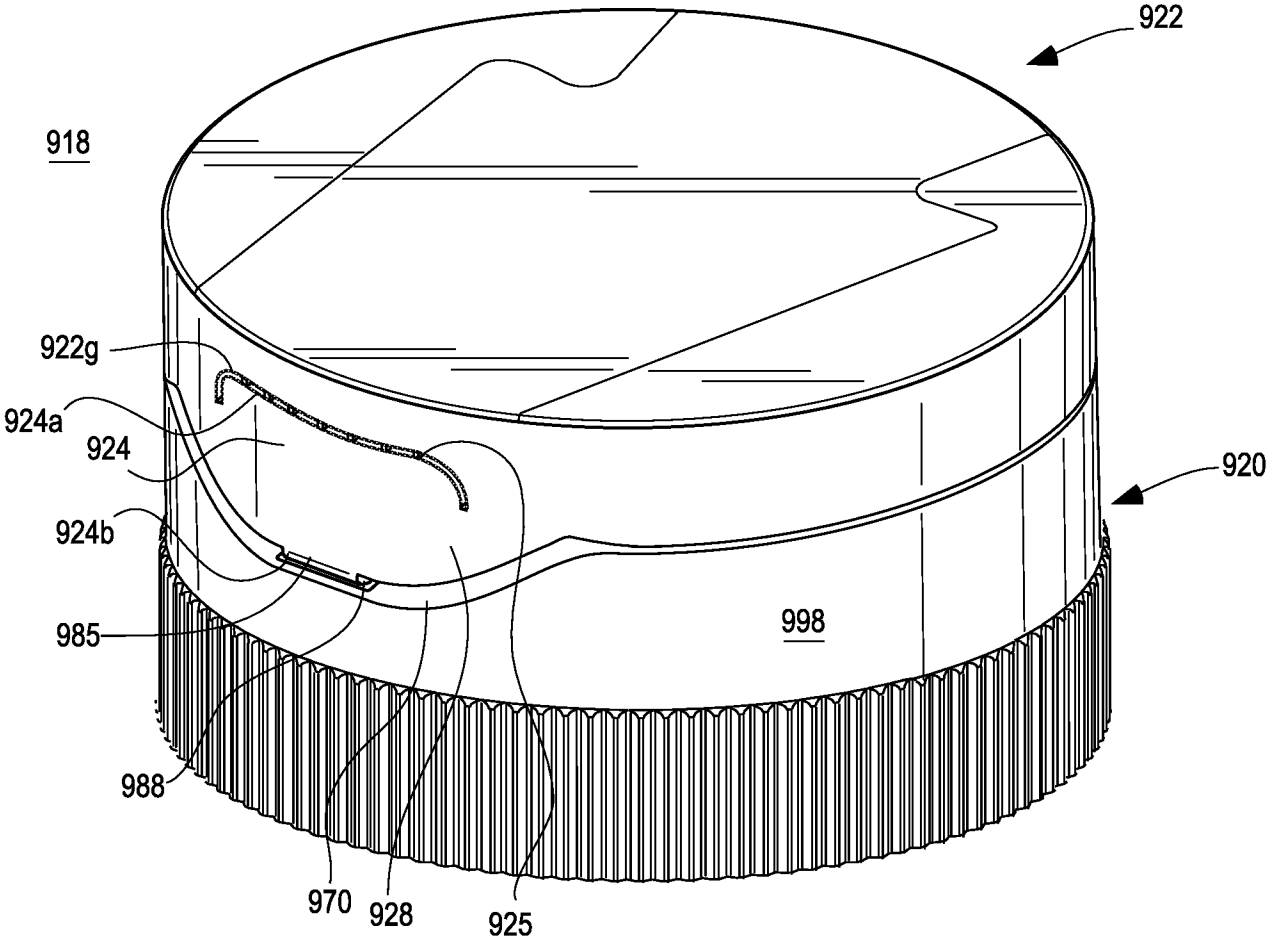
FIG. 57 is a perspective view of the closure cap of FIG. 56 in an initial closed configuration in accordance with some embodiments.

FIGS. 56-62 illustrate another embodiment of a closure cap 918 in accordance with some embodiments. FIG. 56 is a perspective view of the closure cap 918 in an initial open configuration. FIG. 57 is a perspective view of the closure cap in an initial closed configuration. The closure cap 918 may include a base 920, a flip-top lid 922, a movable wall 924, and a breakable member 925. In some embodiments, the closure cap 918 may further comprise an extension tab 985 attached to the movable wall 924.

The flip-top lid 922 may be hingedly connected to the base 920. The flip-top lid 922 may be movable between an open position (FIG. 56) and a closed position (FIG. 57) relative to a hinge 919 connecting the base 920 and the flip-top lid 922. The flip-top lid 922 and the base 920 together form a recess 970 in the outer wall of the closure cap 918 when the flip-top lid 922 is in the closed position.

The recess 970 may allow a user to apply a force to move the flip-top lid 922 from the closed position to the open position.

The movable wall 924 may be attached to one of the base 920 and the flip-top lid 922. For example, referring to FIGS. 56 and 57, the movable wall 924 may be attached to the flip-top lid 922. The movable wall 924 may be attached to the flip-top lid via a deformable or breakable member 925 and the side connection 928. The side connection 928 may be a hinged connection or a flexible material. In the initial open configuration and in the initial closed configuration, the movable wall 924 may generally form a portion of the sidewall of the flip-top lid. Further, in some embodiments, the movable wall is movable from a first position where the movable wall is outwardly curved and substantially aligns with the adjacent sidewall of the closure cap to a second position where the movable wall is inwardly curved into the recess. For example, the movable wall 924 may move from a generally convex position, relative to a user, to a generally concave position, relative to a user.

In some embodiments, the movable wall 924 may be a part of the sidewall of the flip-top lid and have a curve generally continuous with the adjacent portion of the sidewall of the flip-top lid 922 when the movable wall is in the first position. For example, the sidewall of the flip-top lid may cover the opening of the recess in the initial closed configuration, and the movable wall 924 in the first position may be the portion of the sidewall that covers the opening of the recess 970. In these embodiments, the breakable member 925 and the side connection 928 may be disposed around the upper end 924*a* and the side end of the movable wall 924.

The movable wall 924 may be flexible and/or elastically deformable. In some embodiments, the movable wall 924 and the side connection 928 may be made of the same flexible material. In some embodiments, the side connection 928 may be thinner than the movable wall 924 or the adjacent sidewall of the flip-top lid 922 such that the movable wall 924 may be distinguishable from the adjacent sidewall of the flip-top lid 922 by the side connections 928 interposed therebetween.

In some embodiments, a small gap 922*g* may exist between the upper edge 924*a* of the movable wall 924 and the adjacent edge of the flip-top lid 922. In some configurations, the closure cap 918 includes a breakable member 925 that may be disposed at the gap 922*g* while connecting the movable wall 924 and the flip-top lid 922. The breakable member may be configured to break upon the movable wall being moved from the first position toward the second position.

In some embodiments, the extension tab 985 may be attached to the lower edge 924*b* of the movable wall 924. For example, the extension tab 985 may include a flange 983 disposed below the lower edge 924*b* of the movable wall 924 and a hook-shaped extension 982 extending from the flange 983. The hook-shaped extension 982 may extend from one end of the flange toward the recess. The hook-shaped extension 982 may be bent toward the outside of the closure cap such that the end of the hook may direct to the opposite side of the recess. The extension tab 985 may be securely attached to the movable wall such that the extension tab 985 may move along with the movable wall 924 when the movable wall is moved between the first position and the second position.

In some embodiments, the base 920 may have a cutout 988 adjacent or on the recess-forming surface thereof. The cutout 988 may be elongated from a place adjacent to the inner surface of the recess that is opposite to the opening of the recess. When the flip-top lid is in the closed position, the portion of the extension tab may be disposed in the cutout 988. The portion of the extension tab disposed in the cutout 988 may move within a boundary of the cutout. For example, the portion of the extension tab disposed in the cutout 988 may be configured to move between the first end of the cutout which is adjacent to the sidewall of the base and the second end of the cutout which is opposite to the first end and close to the inner wall of the recess.

Figure 58A:
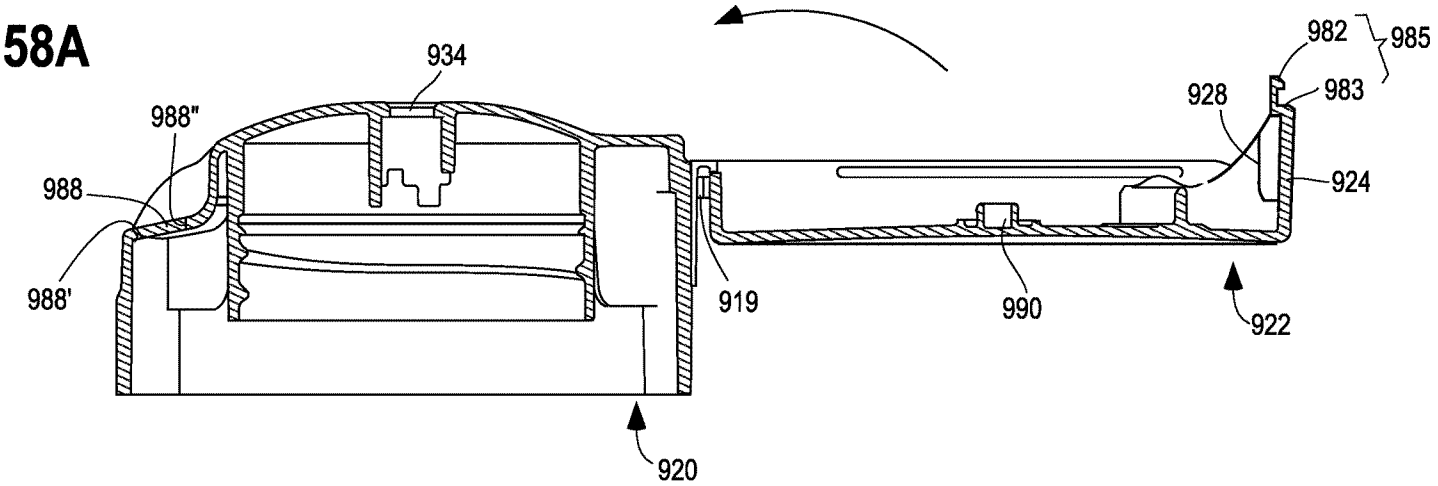
FIGS. 58A and 58B are cross sectional views illustrating a manufacturing configuration, and an initially closed configuration of the closure cap of FIG. 56 in accordance with some embodiments.
Figure 58B:
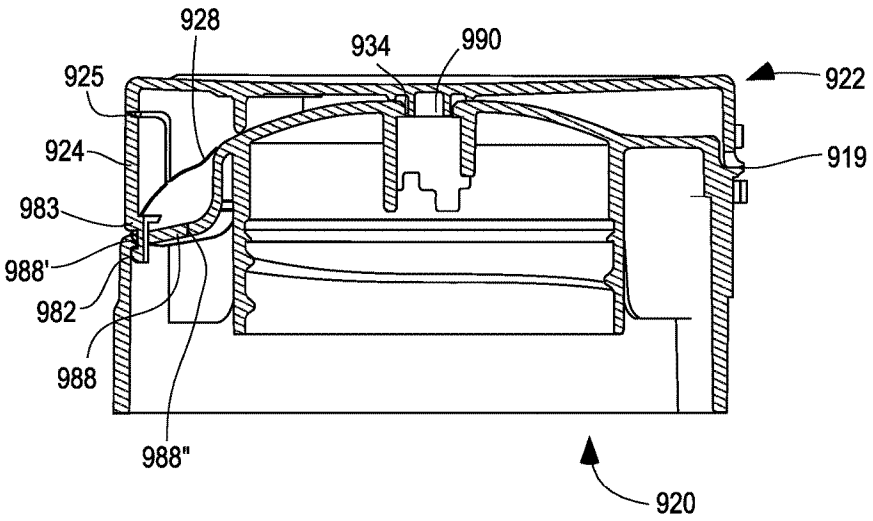

FIGS. 58A and 58B are cross sectional views of the closure cap 918 illustrating a manufacturing low of the closure cap 918. Referring to FIG. 58A, the method of manufacturing a closure cap 918 may include forming a molded closure cap. The molded closure cap 918 may be in the initial open configuration as illustrated in FIG. 56.

The manufacturing method may include moving the flip-top lid 922 from the initial open position to the closed position. The flip-top lid 922 may rotate about the hinge 919 from the initial open position (FIG. 58A) to the initial closed position (FIG. 58B) such that the closure cap 918 in the initial closed configuration may be formed in a mold. Because the movable wall 924 is connected to the flip-top lid 922 via the breakable member 925, when the flip-top lid 922 moves from the initial open position to the closed position, the movable wall 924, the extension tab 985 and the breakable member 925 may move along with the movement of the flip-top lid 922. When the flip-top lid 922 moves toward the closed position, the hook-shaped extension snaps into the base. When the flip-top lid 922 has been fully moved to the closed position, the closure cap 918 in the initial closed configuration may be formed (as shown in FIGS. 57 and 58B).

Figure 59:
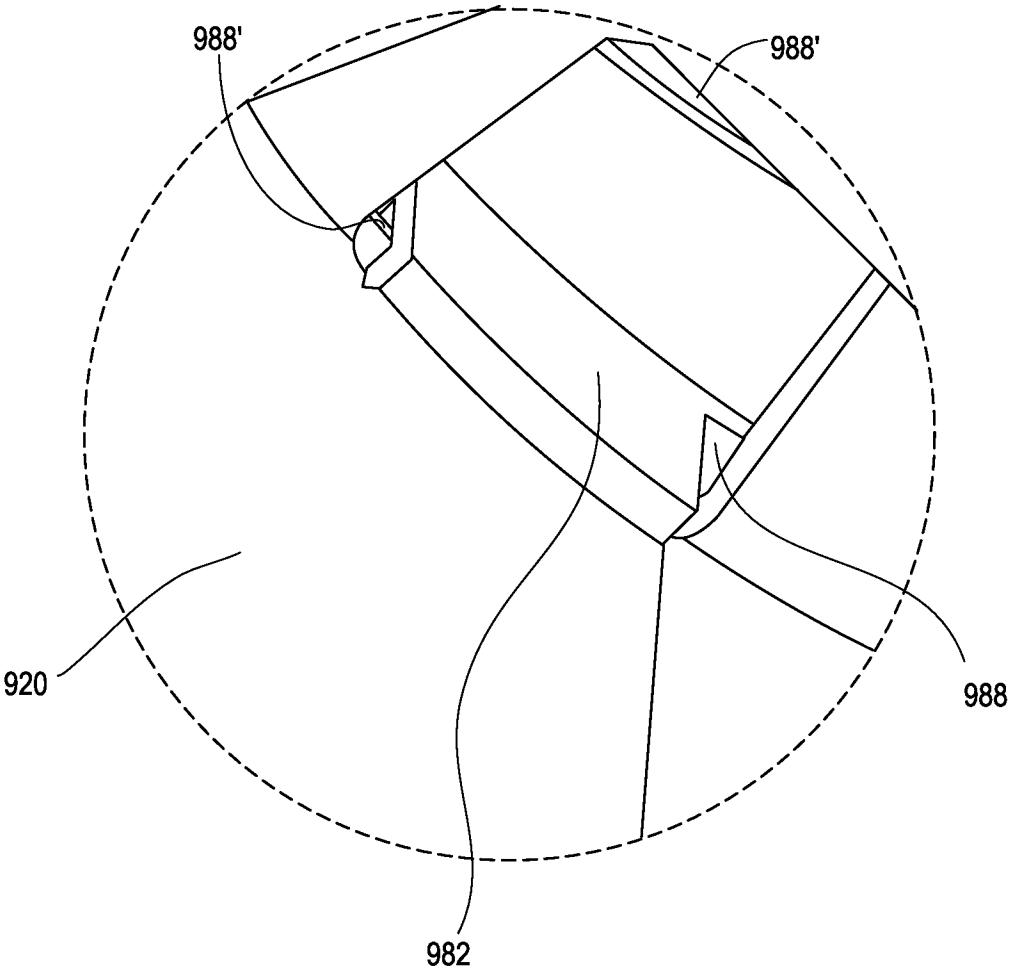
FIG. 59 is a partial perspective view of a hook-shaped extension of a closure cap of FIG. 56 in accordance with some embodiments.

FIG. 59 is a partial perspective view illustrating the hook shaped extension 982 and the cutout 988 of the base. In the initial closed configuration, the hook-shaped extension 982 may engage with the base while catching the first end 988' of the cutout 988 when the movable wall is in the first position as shown in FIG. 53 such that the engagement between the hook-shaped extension 982 and the base may inhibit a user from moving the flip-top lid from the initial closed position to the subsequent open position.

Figure 60:
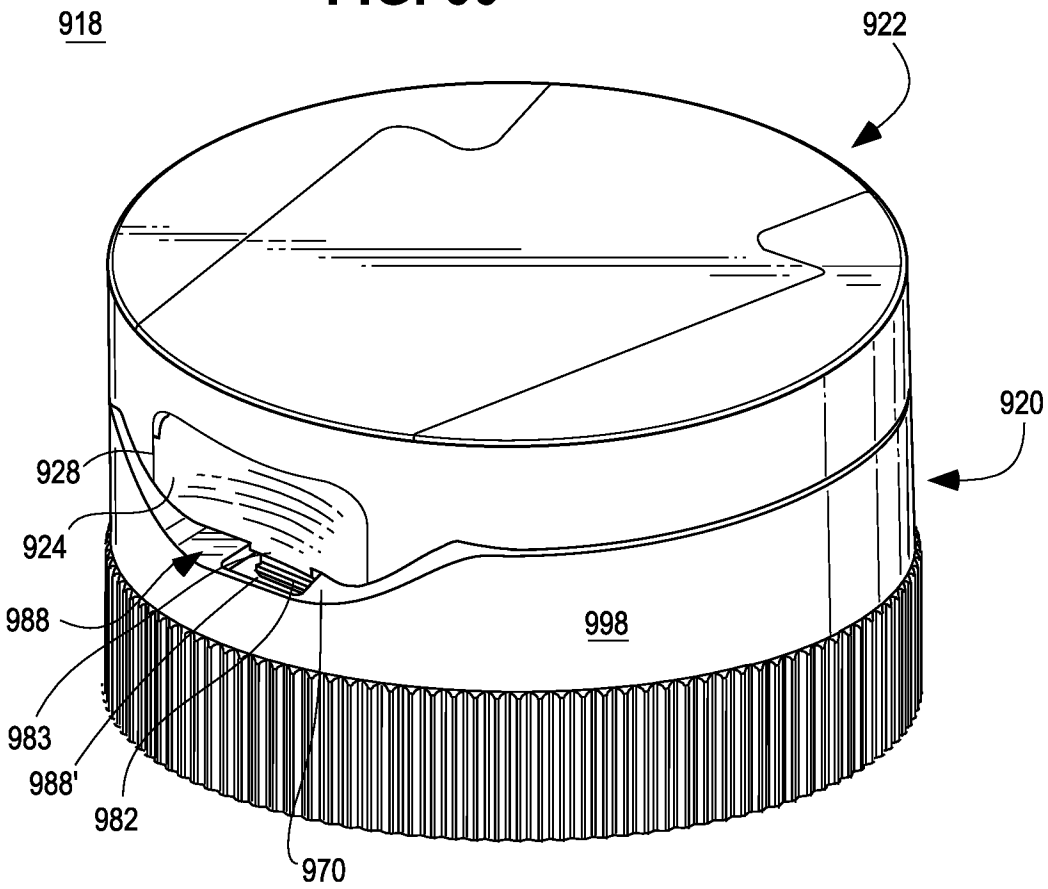
FIG. 60 is a perspective view of the closure cap of FIG. 56 wherein a movable wall is in a second position in accordance with some embodiments.
Figure 61:
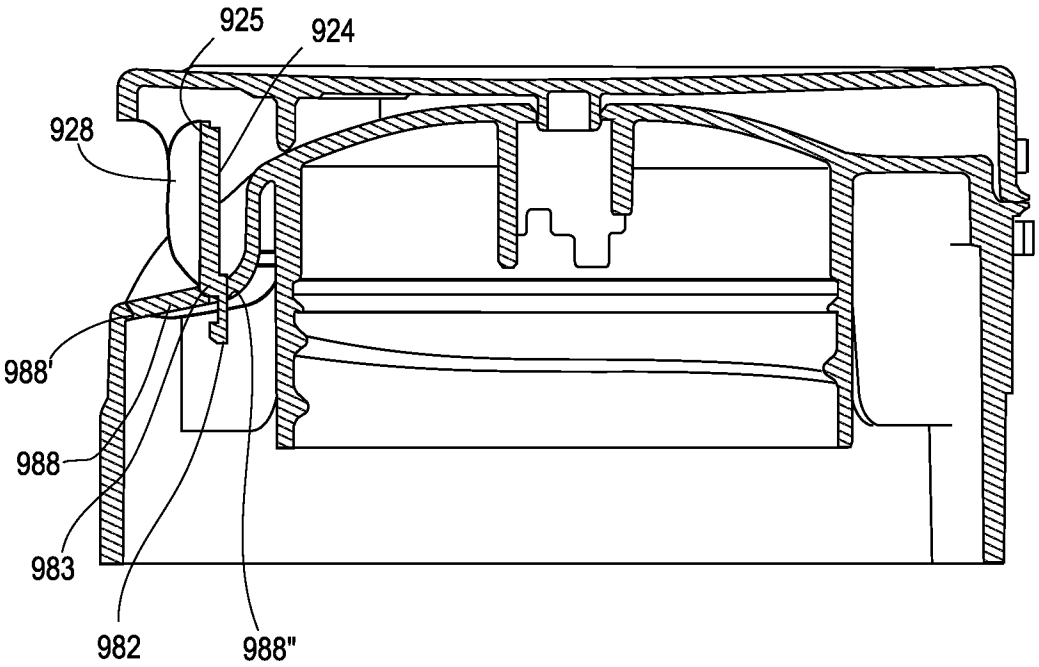
FIG. 61 is a cross sectional view of FIG. 60 in accordance with some embodiments.

FIG. 60 is a perspective view of the closure cap 918 illustrating the movable wall 924 is in the second position before the subsequent opening of the flip-top lid 922. FIG. 61 is a cross sectional view of the closure cap 918 of FIG. 60. As mentioned, the movable wall 924 may be moved from the first position (FIG. 57) to the second position (FIG. 60). The movable wall 924 may be moved from the first position to the second position when a user applies a force pushing the movable wall (or at least a middle portion thereof) into the recess. Even when the movable wall moves from the first position to the second position, the movable wall 924 may be continuously attached to the flip-top lid 922 via the side connection 928. When a sufficient force is applied, the movable wall 924 may snap, thereby flipping the orientation of its curvature. In the second position, the movable wall 924 may be inwardly curved into the recess. For example, the movable wall 924 may compress and permanently deform as it moves from the first position to the second position. In some embodiments, the extension tab may be securely attached to the movable wall such that the extension tab may move along with the movable wall as the movable wall moves from the first position to the second position. When the movable wall moves from the first position toward the second position, the hook-shape extension may disengage with the base while releasing the first end 988' of the cutout 988. When the movable wall is in the second position, the hook-shaped extension may be disposed at the second end 988" of the cutout 988. When the movable wall is in the second position, the inwardly curved movable wall may allow a user to access and use some portion of the recess. By accessing and using the allowed portion of the recess in front of the movable wall, a user may easily apply a force to the flip-top lid 922 in a direction substantially away from the base 920. Because the hook-shaped extension disengages with the base, the hook-shaped extension may not disturb a user from opening the flip-top lid after deformation or adjustment of the movable wall 824 from the outward to the inward configuration.

Figure 62:
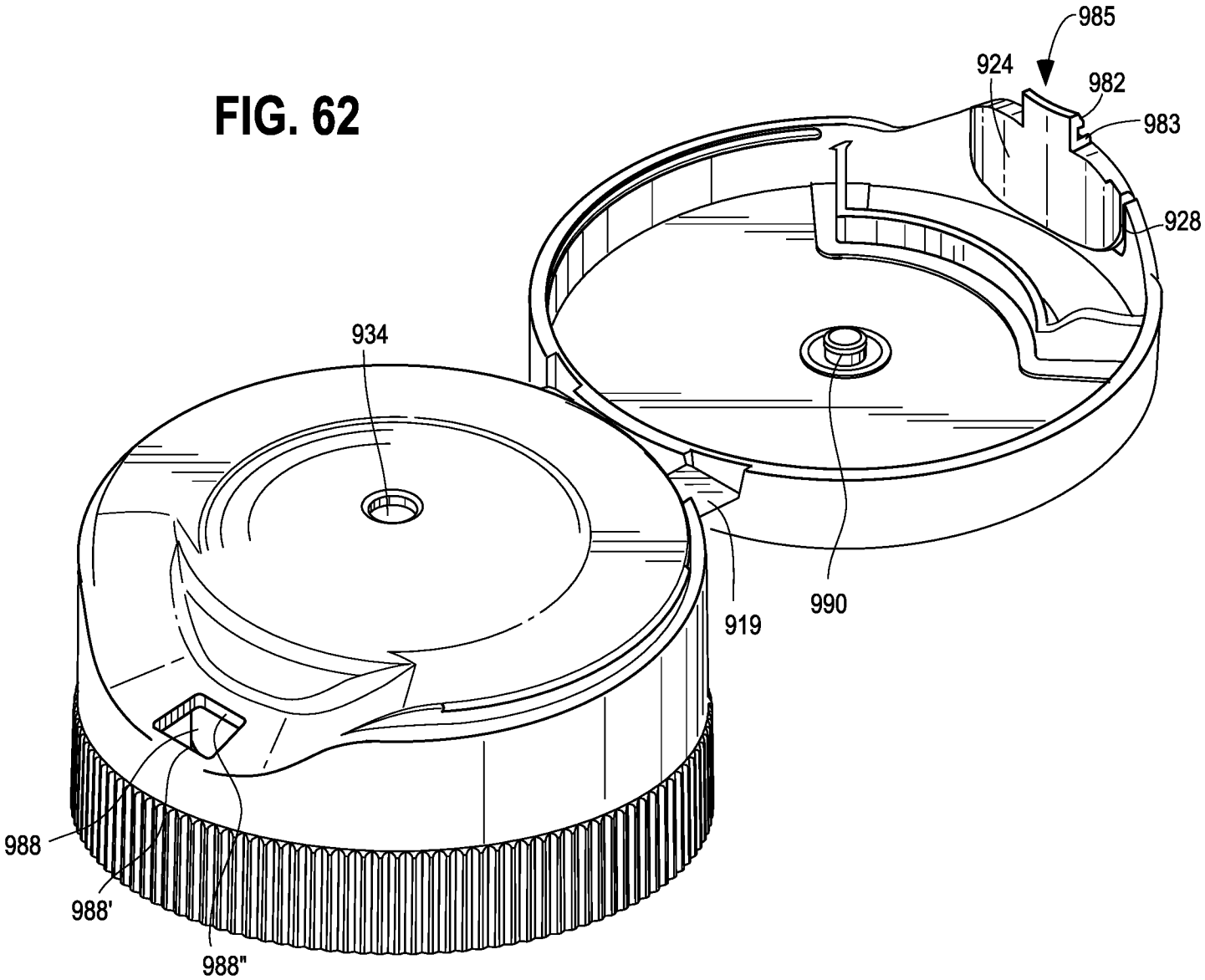
FIG. 62 is a perspective view of the closure cap of FIG. 56 in a subsequent open configuration in accordance with some embodiments.

FIG. 62 is a perspective view of the closure cap 918 in the subsequent open configuration in accordance with some embodiments. In some embodiments, the flip-top lid 922 may be moved from the closed position (FIG. 60) to the open position (FIG. 62). Even in the subsequent open configuration, the movable wall 924 may keep being coupled to the base 920. To easily move the flip-top lid from the closed position to the open position, a user may move the flip-top lid when the movable wall is in the second position. Therefore, the inwardly curved movable wall in the second position may function as a tamper evident structure indicating that the closure cap has been previously opened.

In some embodiments, a closure cap includes a base, a flip-top lid hingedly connected to the base, the flip-top lid being movable between an open position and a closed position, the flip-top lid and the base together forming a recess in an outer wall of the closure cap when the flip-top lid is in the closed position, where the recess allowing a user to apply a force to move the flip-top lid from the closed position to the open position. In addition, the closure cap may include a deformable or movable wall that is attached to one of the base and the flip-top lid, the movable wall being movable from a first position where the movable wall is outwardly curved and in substantially alignment with an adjacent sidewall of the closure cap to a second position where the movable wall is inwardly curved into the recess. The closure cap may further include a deformable or breakable member configured to break upon the movable wall being moved from the first position toward the second position.

In some embodiments, a dispensing bottle includes a container body with a thixotropic fluid therein, the container body having a neck with threads thereon, and a closure cap coupled to the container body. In one approach, the closure cap includes a base, a flip-top lid hingedly connected to the base, the flip-top lid being movable between an open position and a closed position, where the flip-top lid and the base together forming a recess in an outer wall of the closure cap when the flip-top lid is in the closed position, the recess allowing a user to apply a force to move the flip-top lid from the closed position to the open position. The closure cap also may include a movable wall being attached to one of the base and the flip-top lid, the movable wall being movable from a first position where the movable wall is outwardly curved and in substantially alignment with an adjacent sidewall of the closure cap to a second position where the movable wall is inwardly curved into the recess. By some configurations, the closure cap also includes a deformable or breakable member configured to break upon the movable wall being moved from the first position toward the second position.

In some embodiments, a method of opening a closure cap includes providing a closure cap including a base, a flip-top lid hingedly connected to the base, the flip-top lid and the base together forming a recess in an outer wall of the closure cap and having a movable wall being attached to the flip-top lid. In some configurations, the movable wall is moved from a first position where the movable wall is outwardly curved and in substantially alignment with an adjacent sidewall of the closure cap. In addition, the closure cap may include a deformable or breakable member that is disposed between the movable wall and the flip-top lid such that pushing the movable wall into the recess moves to the movable wall to a second position where the movable wall is inwardly curved into the recess. Further, once the movable wall is in the second position, a user may apply a force to a portion of the flip-top lid at the recess to move the flip-top lid about the hinged connection to the base to the open position. In addition, the breakable member may separate or breaks upon the movable wall moving from the first position to the second position.

In some embodiments, a method of manufacturing a filled dispensing bottle includes molding a receptacle having neck threads thereon, filling the receptacle with a thixotropic fluid, providing a closure cap comprising a base, a flip-top lid hingedly connected to the base, where the flip-top lid is movable between an open position and a closed position and the flip-top lid and the base together forming a recess in an outer wall of the closure cap when the flip-top lid is in the closed position. By some approaches, the recess allows a user to apply a force to move the flip-top lid from the closed position to the open position. The closure cap also may include a movable wall being attached to one of the base and the flip-top lid, where the movable wall is adjustable or movable from a first position where the movable wall is outwardly curved and in substantially alignment with an adjacent sidewall of the closure cap to a second position where the movable wall is inwardly curved into the recess. As suggested above, the closure cap also may include a breakable member configured to break upon the movable wall being moved from the first position toward the second position.

Those skilled in the art will recognize that a wide variety of other modifications, alterations, and combinations can also be made with respect to the above-described embodiments without departing from the scope of the disclosure, and that such modifications, alterations, and combinations are to be viewed as being within the ambit of the inventive concept.

What is claimed:

1. A closure cap comprising:

a base;

a flip-top lid hingedly connected to the base, the flip-top lid being movable between an open position and a closed position, the flip-top lid and the base together forming a recess in an outer wall of the closure cap when the flip-top lid is in the closed position, the recess forming a grasping area where a user applies a force to move the flip-top lid from the closed position to the open position;

a movable wall being attached to the base or the flip-top lid, the movable wall being rotatable from a first position where the movable wall is substantially aligned with an adjacent sidewall of the closure cap to a second position where an edge of the movable wall is disposed inward into the recess;

an extension tab extending from the movable wall and fixedly attached to the base or the flip-top lid prior to subsequent opening, the extension tab having a flange and a latching projection extending from the flange;

a retaining slot disposed in the base or the flip-top lid opposite the movable wall and the extension tab, where the latching projection of the extension tab engages the retaining slot upon initial closure of the closure cap and secures the extension tab within the retaining slot; and a breakable member disposed between the extension tab and the movable wall, wherein the breakable member is configured to break upon the movable wall being rotatably moved from the first position toward the second position.

2. The closure cap of claim 1 wherein the latching projection comprises a pair of hooks, where each end of the hooks extends outwardly away from one another.

3. The closure cap of claim 1 wherein the latching projection comprises a barb.

4. The closure cap of claim 1 wherein the movable wall is attached to one of the base and the flip-top lid via a hinged connection and wherein the retaining slot has a receiving opening through which the latching projection extends upon initial closure.

5. The closure cap of claim 4 wherein the movable wall is attached to the flip-top lid via the hinged connection and wherein the base has the receiving opening.

6. The closure cap of claim 4 wherein the movable wall is attached to the base via the hinged connection and wherein the flip-top lid has the receiving opening.

7. The closure cap of claim 4 wherein the receiving opening is in a sidewall of the base disposed below the recess.

8. The closure cap of claim 4 wherein the receiving opening is in a sidewall of the flip-top lid disposed above the recess.

9. The closure cap of claim 4 wherein the receiving opening is in an upper surface of the base at the recess.

10. The closure cap of claim 1 wherein an upper surface of the base includes an indented portion configured to engage the flange of the extension tab.

11. The closure cap of claim 1 wherein a sidewall of the base includes an indented portion configured to engage the flange of the extension tab.

12. The closure cap of claim 1 wherein a sidewall of the flip-top lid has an indented portion configured to engage the flange of the extension tab.

13. The closure cap of claim 1 wherein the movable wall is attached to the base via a hinged connection and wherein the extension tab is fixed to the flip-top lid via a mounting member disposed on an inner surface of a sidewall of the flip-top lid.

14. The closure cap of claim 1 wherein the movable wall extends from the flip-top lid and has a hinge at a top of the movable wall and wherein the flip-top lid further comprises a lip disposed inwardly of the hinge to secure a lower end of the movable wall after the lower end of the movable wall has been rotated sufficiently inward relative to the recess.

15. The closure cap of claim 1 wherein the retaining slot comprises an elongated retaining slot and the latching projection comprises a pair of flexible projections having hooks thereon for fixedly securing the extension tab to the elongated retaining slot.

16. A closure cap comprising:

a base;

a flip-top lid hingedly connected to the base by a hinge, the flip-top lid movable between an open position and a closed position;

a recess formed in an outer wall of the closure cap when the flip-top lid is in the closed position;

a tamper panel extending from the flip-top lid at the recess in the outer wall, the tamper panel being rotatable from a first position where the tamper panel is substantially aligned with an adjacent sidewall of the closure cap to a second position where an edge of the tamper panel is disposed inward into the recess when the closure cap is in the closed position;

an extension tab extending from the tamper panel and in substantial alignment therewith in an initial configuration;

a retaining slot disposed in the base opposite the tamper panel; and a breakable member disposed between the extension tab and the tamper panel in the initial configuration, wherein the breakable member is configured to break upon the tamper panel being rotatably moved from the first position toward the second position;

wherein the closure cap is molded with the flip-top lid in the initial configuration and the flip-top lid is moved to the closed position by rotating the flip-top lid about the hinge and the extension tab engaging the retaining slot upon movement of the flip-top lid from the initial configuration to the closed position.

17. The closure cap of claim 16 wherein the extension tab comprises a flange and at least one latching projection extending from the flange.

18. The closure cap of claim 16 wherein the retaining slot comprises an elongated retaining slot and the extension tab further comprises a pair of flexible projections with enlarged prongs configured to extend into the elongated retaining slot to fixedly attach the extension tab to the elongated retaining slot.

19. A closure cap comprising:

a base;

a flip-top lid hingedly connected to the base by a hinge, the flip-top lid movable between an open position and a closed position;

a recess formed in an outer wall of the closure cap when the flip-top lid is in the closed position;

a tamper panel extending from the base at the recess in the outer wall, the tamper panel being rotatable from a first position where the tamper panel is substantially aligned with an adjacent sidewall of the closure cap to a second position where an edge of the tamper panel is disposed inward into the recess when the closure cap is in the closed position;

an extension tab extending from the tamper panel and in substantial alignment therewith in an initial configuration;

a retaining slot disposed in the flip-top lid opposite the tamper panel; and a breakable member disposed between the extension tab and the tamper panel in the initial configuration, wherein the breakable member is configured to break upon the tamper panel being rotatably moved from the first position toward the second position;

wherein the closure cap is molded with the flip-top lid in the initial configuration and the flip-top lid is moved to the closed position by rotating the flip-top lid about the hinge and the extension tab engaging the retaining slot upon movement of the flip-top lid from the initial configuration to the closed position.

20. The closure cap of claim 19 wherein the extension tab comprises a flange and at least one latching projection extending from the flange.

21. The closure cap of claim 19 wherein the retaining slot comprises an elongated retaining slot and the extension tab further comprises a pair of flexible projections with enlarged prongs configured to extend into the elongated retaining slot to fixedly attach the extension tab to the elongated retaining slot.

* * * * *